US009878455B1

(12) United States Patent
Perez

(10) Patent No.: US 9,878,455 B1
(45) Date of Patent: Jan. 30, 2018

(54) FOLDING KNIFE ASSEMBLY

(71) Applicant: Michael Gregory Perez, Miami Springs, FL (US)

(72) Inventor: Michael Gregory Perez, Miami Springs, FL (US)

( * ) Notice: Subject to any disclaimer, the term of this patent is extended or adjusted under 35 U.S.C. 154(b) by 26 days.

(21) Appl. No.: 14/865,449

(22) Filed: Sep. 25, 2015

Related U.S. Application Data

(63) Continuation-in-part of application No. 13/834,867, filed on Mar. 15, 2013, now abandoned, and a continuation-in-part of application No. 12/927,765, filed on Nov. 23, 2010, now Pat. No. 8,468,701.

(60) Provisional application No. 62/150,775, filed on Apr. 21, 2015, provisional application No. 61/711,271, filed on Oct. 9, 2012, provisional application No. 61/710,741, filed on Oct. 7, 2012, provisional application No. 61/700,585, filed on Sep. 13, 2012, provisional application No. 61/636,606, filed on Apr. 20, 2012, provisional application No. 61/390,054, filed on Oct. 5, 2010, provisional application No. 61/388,412, filed on Sep. 30, 2010, provisional application No. 61/386,534, filed on Sep. 26, 2010, provisional application No. 61/380,279, filed on Sep. 6, 2010, provisional application No. 61/334,614, filed on May 14, 2010, provisional application No. 61/333,578, filed on May 11, 2010, provisional application No. 61/333,316, filed on May 11, 2010, provisional application No. 61/332,768, filed on May 8, 2010, provisional application No. 61/326,744, filed on Apr. 22, 2010, provisional application No. 61/283,629, filed on Jan. 9, 2010, provisional application No. 61/264,015, filed on Nov. 24, 2009.

(51) Int. Cl.
*B26B 1/04* (2006.01)

(52) U.S. Cl.
CPC ..... *B26B 1/048* (2013.01)

(58) Field of Classification Search
CPC ..... B26B 1/04–1/048; B26B 1/10
USPC ..... 30/153, 155–161
See application file for complete search history.

(56) References Cited

U.S. PATENT DOCUMENTS 633,854 A 9/1899 Kuhn
847,206 A * 3/1907 Saunderson ..... B26B 1/04 30/153
1,056,081 A * 3/1913 Yerzley ..... B26B 1/02 30/155

(Continued)

*Primary Examiner* — Jason Daniel Prone
(74) *Attorney, Agent, or Firm* — Malloy & Malloy, P.L.

(57) ABSTRACT

A folding knife assembly includes a blade system which is disposable between an open configuration and a closed configuration using a single hand. The blade system includes a fixed blade portion and a movable blade portion, wherein the fixed blade portion and moveable blade portion are cooperatively structured to engage one another in an interlocked configuration when the blade system is disposed in an open configuration. The folding knife assembly also includes a positioning assembly structured to facilitate disposition of the blade system between an open configuration and a closed configuration. A locking assembly is provided and is structured to operatively engage at least a portion of the positioning assembly to releasably secure the blade system in the open configuration, and to operatively disengage the positioning assembly to permit disposition of the blade system into a closed configuration.

20 Claims, 45 Drawing Sheets

(56) References Cited

U.S. PATENT DOCUMENTS 1,412,373 A * 4/1922 Shields ..... B26B 1/06 30/159
1,647,405 A 11/1927 Giesen
1,687,958 A * 10/1928 Waiwat ..... B26B 1/048 30/160
2,304,601 A 12/1942 Schrade
3,868,774 A 3/1975 Miori
3,942,249 A * 3/1976 Poehlmann ..... B26B 1/046 30/160
4,099,327 A * 7/1978 Pesa ..... B26B 1/042 30/161
4,120,088 A 10/1978 Phelps
4,240,201 A * 12/1980 Sawby ..... B26B 1/046 30/161
4,404,748 A * 9/1983 Wiethoff ..... B26B 1/046 30/161
4,439,922 A * 4/1984 Sassano ..... B26B 1/046 30/161
4,535,539 A * 8/1985 Friedman ..... B26B 1/046 30/159
4,541,175 A * 9/1985 Boyd ..... B26B 1/046 30/161
4,604,803 A * 8/1986 Sawby ..... B26B 1/048 30/155
4,670,984 A * 6/1987 Rickard ..... B26B 1/046 30/161
4,719,700 A 1/1988 Taylor, Jr.
4,750,267 A * 6/1988 Boyd ..... B26B 1/046 30/161
4,893,409 A * 1/1990 Poehlmann ..... B26B 1/048 30/155
4,947,551 A 8/1990 Deisch
5,025,557 A * 6/1991 Perreault ..... B26B 1/048 30/151
5,131,149 A 7/1992 Thompson et al.
5,293,690 A * 3/1994 Cassady ..... B26B 1/046 30/154
5,331,741 A 7/1994 Taylor, Jr.
RE34,979 E 6/1995 Gringer
5,425,175 A 6/1995 Rogers
5,495,674 A 3/1996 Taylor, Jr.
5,615,484 A * 4/1997 Pittman ..... B26B 1/048 30/155
5,661,908 A 9/1997 Chen
5,722,168 A * 3/1998 Huang ..... B23D 51/10 30/160
5,953,821 A 9/1999 Mearns
5,966,816 A 10/1999 Roberson
5,979,065 A * 11/1999 Hsu ..... B23D 51/01 30/161
6,158,127 A 12/2000 Taylor
6,212,779 B1 * 4/2001 Mitchell ..... B26B 1/046 30/161
6,305,085 B1 10/2001 Stallegger et al.
6,360,443 B1 3/2002 Remus
6,430,816 B2 * 8/2002 Neveux ..... B26B 1/046 30/155
6,446,341 B1 9/2002 Wang et al.
6,668,460 B2 12/2003 Feng
6,836,967 B1 1/2005 Sakai
6,941,661 B2 * 9/2005 Frazer ..... B26B 1/048 30/160
7,032,315 B1 * 4/2006 Busse ..... B26B 1/048 30/153
7,124,510 B2 10/2006 Frazer
7,152,327 B2 12/2006 Rudisill et al.
7,181,849 B2 2/2007 Menter
7,231,718 B2 6/2007 Outen
7,246,441 B1 * 7/2007 Collins ..... B26B 1/042 30/159
7,249,417 B2 7/2007 Chu
7,325,312 B1 2/2008 Janich
7,513,045 B2 * 4/2009 Kain ..... B26B 1/02 30/151
7,555,839 B2 * 7/2009 Koelewyn ..... B26B 1/048 30/159
7,581,321 B2 9/2009 Kain
7,627,951 B2 * 12/2009 Glesser ..... B26B 1/04 30/153
RE41,259 E 4/2010 McHenry et al.
7,774,940 B2 8/2010 Frank
7,854,067 B2 12/2010 Lake
7,979,990 B2 7/2011 Hawk et al.
8,356,415 B2 1/2013 Lin
8,375,589 B2 * 2/2013 Bremer ..... B26B 1/046 30/155
8,468,701 B1 6/2013 Perez
8,490,288 B1 * 7/2013 Mollick ..... B26B 1/046 30/155
8,499,461 B1 * 8/2013 Mollick ..... B26B 1/046 30/160
8,584,367 B2 * 11/2013 Chu ..... B26B 1/04 30/151
8,646,184 B2 * 2/2014 Westerfield ..... B26B 1/046 30/155
8,707,564 B2 * 4/2014 Burch ..... B23D 51/01 30/155
8,745,878 B2 6/2014 Glesser
8,959,779 B2 * 2/2015 Wen ..... B26B 1/046 30/155
8,978,253 B2 * 3/2015 Snyder ..... B26B 1/02 30/155
8,978,257 B2 3/2015 Quimby et al.
2004/0031155 A1 2/2004 Hitchcock et al.
2004/0158991 A1 * 8/2004 Freeman ..... B26B 1/048 30/161
2005/0097755 A1 5/2005 Galyean et al.
2005/0262701 A1 12/2005 Lai
2006/0168817 A1 8/2006 Kao
2006/0272157 A1 12/2006 Zeng
2007/0256310 A1 11/2007 Pool et al.
2009/0193664 A1 * 8/2009 Galyean ..... B26B 1/046 30/161
2009/0260234 A1 * 10/2009 Lai ..... B23D 51/01 30/161
2009/0277015 A1 * 11/2009 Duey ..... B26B 1/046 30/160
2010/0192381 A1 * 8/2010 Sakai ..... B26B 1/048 30/160
2011/0010947 A1 1/2011 Freeman
2011/0067246 A1 3/2011 Perez
2012/0023753 A1 * 2/2012 Wen ..... B26B 1/046 30/156
2012/0324738 A1 12/2012 Chu et al.
2013/0160300 A1 * 6/2013 Liu ..... B26B 1/048 30/159
2013/0283621 A1 * 10/2013 Snyder ..... B26B 1/046 30/161
2014/0047718 A1 * 2/2014 Fellows ..... B26B 1/048 30/161
2014/0115898 A1 * 5/2014 Collins ..... B26B 1/044 30/159
2014/0115900 A1 5/2014 Ikoma
2014/0259687 A1 * 9/2014 Griffey ..... B26B 1/044 30/159
2015/0239134 A1 * 8/2015 Duey ..... B26B 1/046 30/159
2015/0343650 A1 * 12/2015 Valdez ..... B26B 1/02 30/159
2017/0120461 A1 * 5/2017 Tom ..... B26B 1/048 30/159
2017/0144316 A1 * 5/2017 Trull ..... B26B 1/04 30/155
2017/0165849 A1 * 6/2017 DeBaker ..... B26B 1/044 30/160
2017/0167172 A1 * 6/2017 Jelbert ..... B26B 1/04 30/155

* cited by examiner

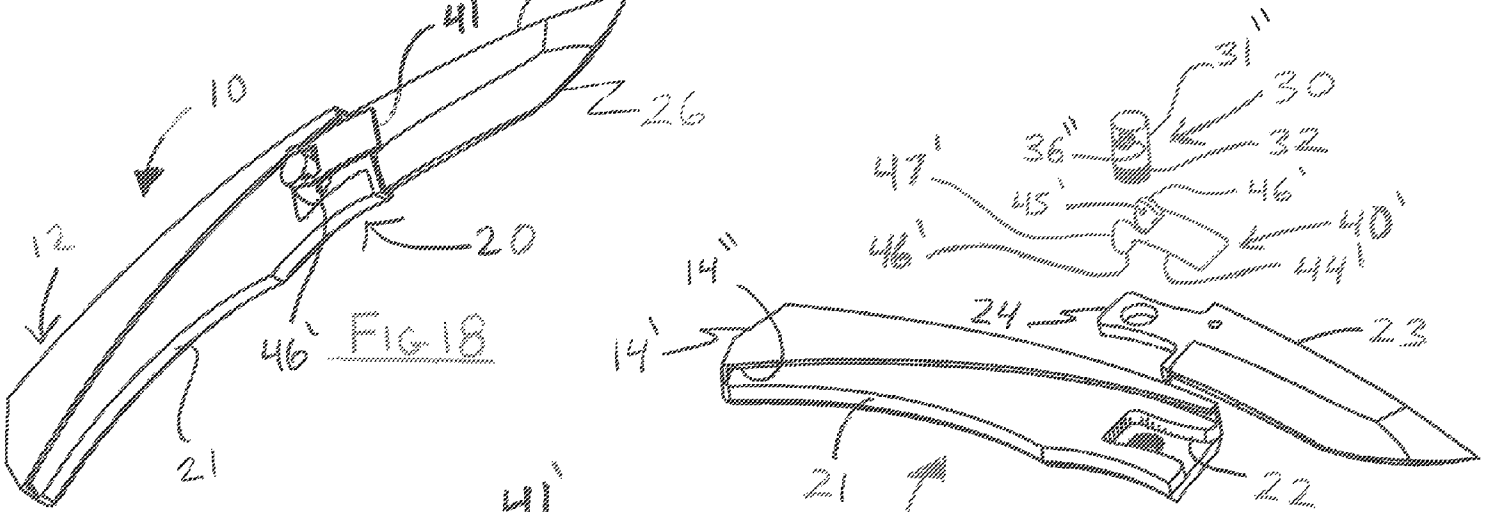
Fig 18
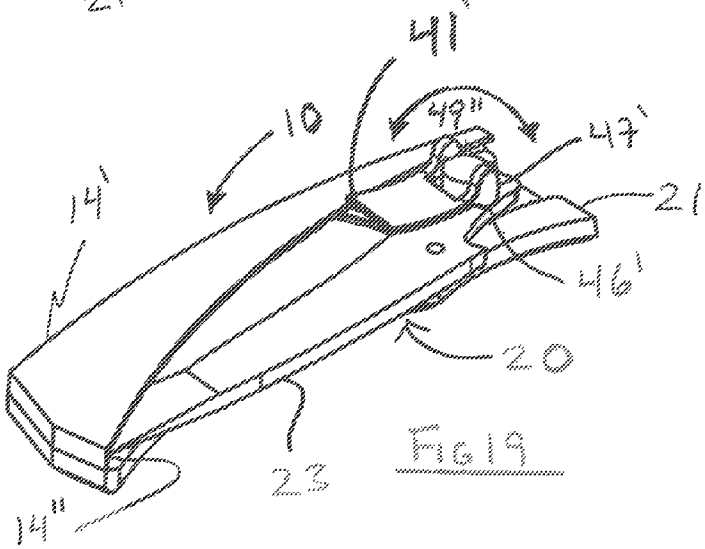
Fig 19
Fig 20

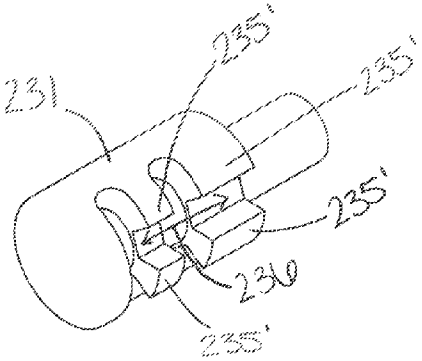
FIG 42A
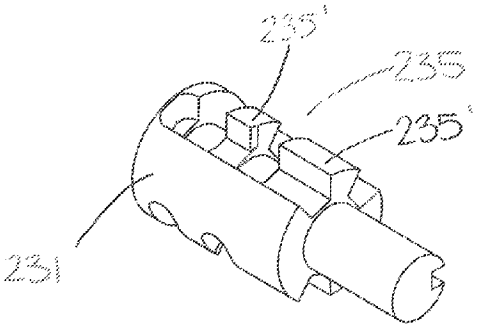
FIG 42B
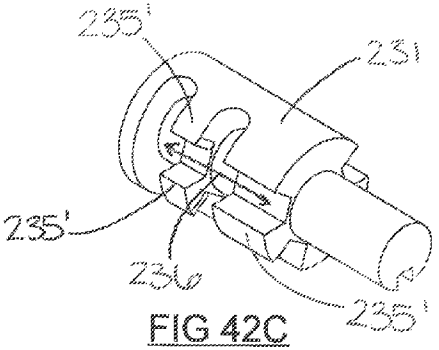
FIG 42C
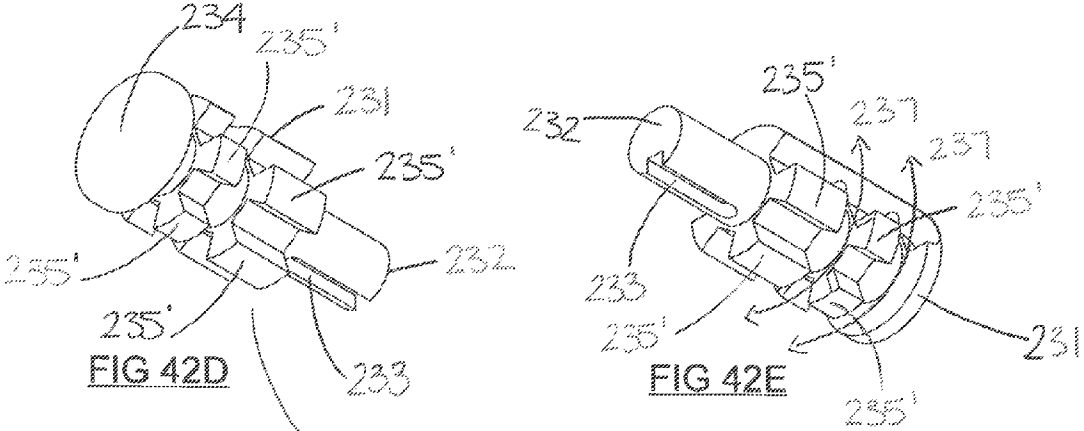
FIG 42D
FIG 42E
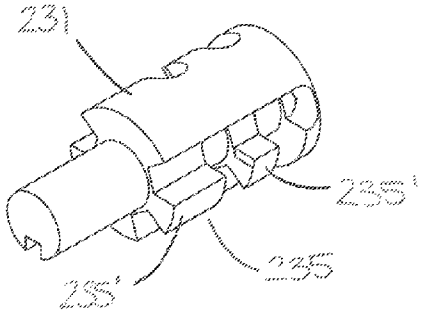
FIG 42F

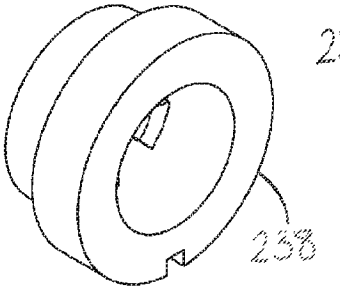
FIG 43A
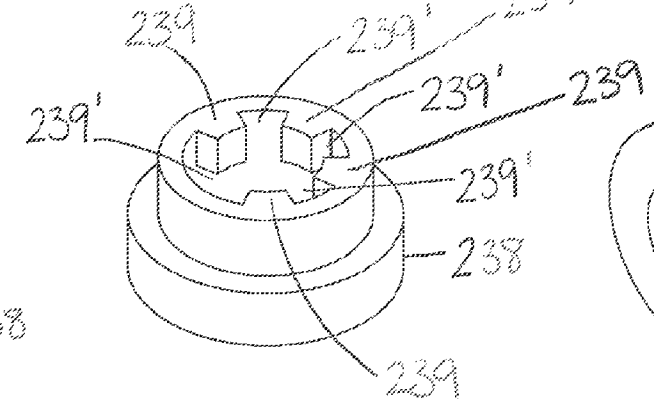
FIG 43B
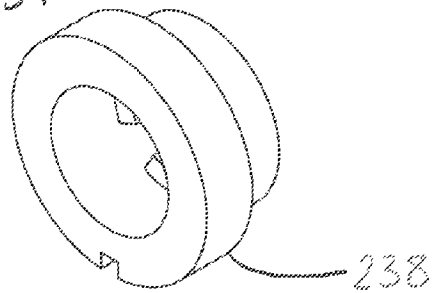
FIG 43C
FIG 43D
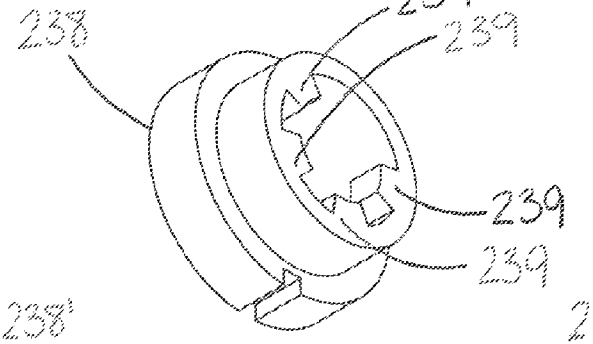
FIG 43E
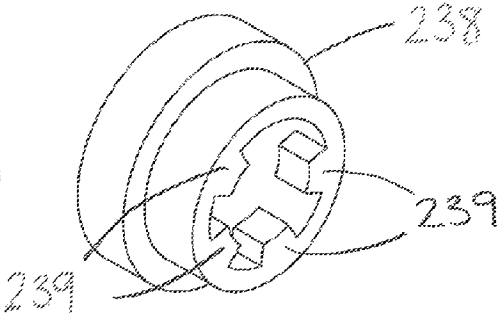
FIG 43F

FOLDING KNIFE ASSEMBLY

BACKGROUND OF THE INVENTION

Field of the Invention

The present application is directed to a folding knife assembly having a blade system comprising a fixed blade portion and a movable blade portion, wherein the fixed and moveable blade portions are structured and disposed to interlock with one another when the blade system is disposed in an open configuration.

Description of the Related Art

Knives are among the oldest and most common tools employed by modern mankind. As such, knives are available in a myriad of shapes, sizes, and designs for a wide variety of functions. As an example, the art related to knives range from large butcher knives for carving meat to tiny precision surgical knives, such as are employed in arthroscopic surgical procedures, with numerous variations in between. Further, given the usefulness of knives for a variety of purposes, folding knives have been developed over the years to make these tools safe for a user to carry on his or her person, yet remain readily available to be deployed when needed.

Typically, folding knives consist of a movable blade that is fixed to some type of pivot point within a handle, the handle being structured to shield the sharpened edge of the knife blade while it is in a closed position for a transport and/or storage. An important variation on the standard folding knife is a folding knife having a lock or stop such that a user must actuate some type of release mechanism in order to free the blade so that it may be moved from an open to a closed position. Some folding knives also incorporate a deployment mechanism, such as a spring assisted opening mechanism, commonly known as spring assisted opening knives or switch-blade knives, however, it is noted that such spring assisted opening mechanisms are illegal in many jurisdictions. A variation of such a spring assisted opening knife is a stiletto type knife, wherein the blade does not fold into the handle, but rather, is deployed lengthwise in and out of one an open end of a knife handle.

As with knives in general, folding knives have been developed for a wide variety of uses. For example, a miniaturize folding knife assembly commonly known as a pen knife are small enough to be carried on a keychain and are utilized for extremely light duty tasks such as cutting string, plastic, tape, etc. At the opposite end of the spectrum, folding knife assemblies employed substantially standard size knife blades made of hardened steel and being structured for heavy duty applications are often used by persons in the construction industry, sportsman, and other such rigorous activities wherein a heavy duty knife assembly is required. Typically, the user such a large folding knife assembly will utilize a sheath or other holder in order to comfortably and safely carry the knife on his or her person, such as attached to a belt loop, tool belt, or other such article. Between these extremes, are a variety of intermediate sized folding knife assemblies commonly referred to as pocket knives. Once again, these pocket knives typically include a single movable blade which is attached to the handle via pivot member which allows the blade to be opened and closed. In addition, a good number of pocket knives employ some form of lock or stop in order to avoid possible injury to a user as a result of inadvertent closure of the blade while the knife is in use. A significant problem common to all of the folding knives noted above is a utilization of a single blade member which is only secured at one end by a pivot structure, which also serves to attach the blade member to the handle. More in particular, upon rotating the single blade from a closed to an opened position about its pivot point, only a small portion of the single blade member is retained within and supported by the knife handle. As a result, a substantial weak point exists in known folding knives when the blade is deployed in an open configuration, i.e., the weak point being the interface of the single blade member and the handle. In contrast, a fixed handle knife of similar dimensions will include a significant portion of a single fixed blade member, i.e., the tang or shank, being secured between opposing handle members. Thus, a single fixed blade knife assembly provides significantly greatly strength and stability to the overall knife blade versus a folding knife assembly of similar dimension, i.e., useable blade length, and materials of construction of the blade, tang, handle, and connecting hardware.

As noted above, a number of folding knives include some form of lock or stop which is designed to retain the blade in an open or closed position until such time as the user actuates the release mechanism. It is also common for folding knives employing such a lock to require two handed operation by the user, more specifically, one hand to grasp the handle and actuate a release mechanism and the other hand to grasp and physically reposition the blade between open and closed positions. It is well known, however, that in many applications, it is not convenient or may not even be possible for a user to have both hands free in order to open and close a folding knife.

As such, it would be beneficial to provide a folding knife assembly which approaches the structural integrity of a single fixed blade knife of comparable dimensions in quality of materials. More in particular, it would be desirable to provide a folding knife assembly wherein a substantial portion of the blade assembly remains fixedly secured to at least a portion of the handle while another portion of the blade is deployed in an open configuration. It would also be helpful to provide such a folding knife assembly wherein deployment of at least the portion of the blade between open and closed configuration may be accomplished using only one hand. Yet another advantage may be realized by incorporating a self cleaning means into a folding knife assembly in order to prevent, or at least minimize the accumulation of dirt or debris from the inner workings of knife assembly so as to minimize maintenance and increase the useable life of the same. It would also be beneficial to provide such a folding knife assembly to comprise a minimal number of moving parts, once again, to minimize the need for maintenance and to assure a long useable life of such a folding knife assembly.

SUMMARY OF THE INVENTION

The present invention comprises a folding knife assembly. The folding knife assembly includes a handle which, in at least one embodiment, comprises a fixed member and a positionable member. The folding knife assembly of the present invention further comprises a blade assembly having a fixed blade portion and a movable blade portion. The blade assembly is disposable between an open configuration and a closed configuration, as described in further detail hereinafter. In at least one embodiment, the handle is structured to substantially overlie the blade assembly while the blade assembly is disposed in the closed configuration.

In each embodiment of the present invention, the fixed blade portion comprises a fixed interlock and the movable blade portion comprising a movable interlock, wherein the movable interlock is structured and disposed to releasably engage the fixed interlock in an interlocked orientation when the blade assembly is disposed in an open configuration. More in particular, the blade assembly may initially comprise a single unitary construction, and the moveable blade portion may be separated from the fixed blade portion by any of a number of techniques including, but not limited to, wire electrical discharge machining, laser cutting, die cutting, or pressing, such that the movable blade portion and the fixed blade portion may be realigned with one another along their cooperatively structured interface.

The folding knife assembly of the present invention also includes a positioning assembly structured to permit disposition of the blade assembly between the open configuration and the closed configuration. In at least one embodiment, the positioning assembly includes at least one positioning pin, and in one further embodiment, the positioning pin is structured and disposed to securely yet movable engage the movable blade portion, thereby permitting the movable blade portion of the blade assembly to be positioned into and out of the open configuration.

The at least one positioning pin comprises a positioning channel which is cooperatively structured with an engagement member of a lock mechanism to allow the blade assembly to be secured in the open configuration while in use. More in particular, the folding knife assembly of the present invention includes a locking assembly structured to operatively engage the positioning assembly and releasably secure the blade assembly in the open configuration.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 9 is a perspective cross-sectional view of the positioning pin of FIG. 8 along lines 9-9 thereof.

FIG. 10 is a perspective cross-sectional view of the positioning pin of FIG. 8 along lines 10-10 thereof.

FIG. 18 is a perspective view illustrative of another embodiment of a folding knife assembly in accordance with the present invention, disposed in an open configuration.

FIG. 19 is a perspective view of the illustrative embodiment of FIG. 18, disposed in a closed configuration.

FIG. 20 is an exploded perspective view of the illustrative embodiment of the folding knife assembly of FIG. 18.

FIGS. 42A through 42F are different perspective views of one illustrative embodiment of a positioning pin in accordance with the present invention.

FIGS. 43A through 43F are different perspective views of one illustrative embodiment of a positioning sleeve in accordance with the present invention.

Like reference numerals refer to like parts throughout the several views of the drawings.

DETAILED DESCRIPTION OF THE PREFERRED EMBODIMENT

Figure 2:
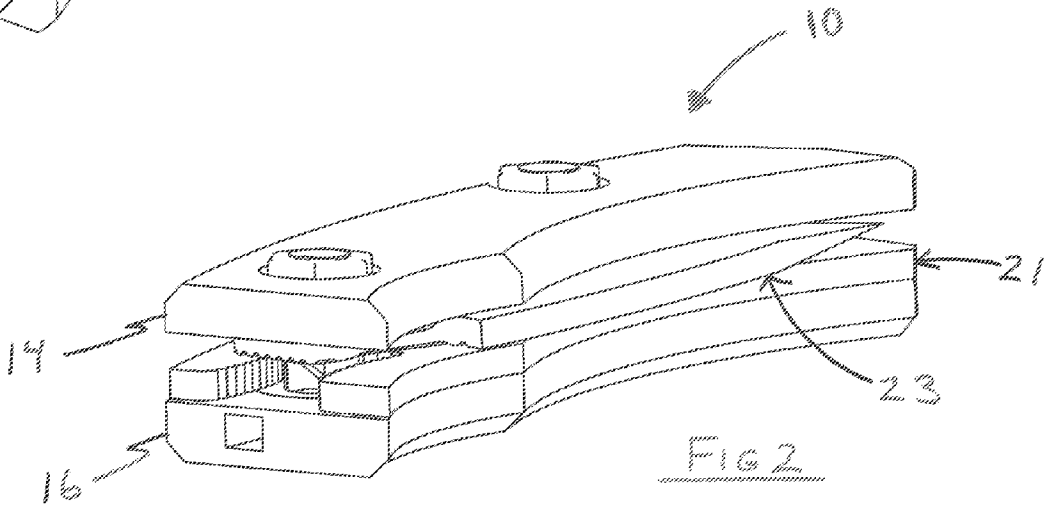
FIG. 2 is a perspective view of the illustrative embodiment of FIG. 1 disposed in a closed configuration.

The present application is directed to a folding knife assembly generally as shown as 10 throughout the figures. More in particular, the present folding knife assembly 10, in at least one embodiment, includes a handle 12 having a fixed handle member 14 and a positionable handle member 16 which are cooperatively structured to substantially overlie a blade assembly 20, while the blade assembly 20 is disposed in a closed configuration, such as is illustrated in FIG. 2. In at least one alternate embodiment, such as illustrated in FIGS. 18 through 20, the handle 12 of the folding knife assembly 10 has a unitary construction comprised of a single, unitary fixed handle member 14', wherein the unitary fixed handle member 14' comprises a retention channel 14" structured to overlie at least the cutting edge 26 of the blade assembly 20, while disposed in a closed configuration as illustrated in FIG. 19. It will be appreciated that any of a number of materials of construction may be selected that will be suitable for a handle 12, or portions thereof, in accordance with the present invention. A few examples include, but in no manner are limited to, a G-10 fiberglass resin laminate, or a high pressure laminates of linen, canvas, paper, fiberglass, carbon fiber or other fabric in a thermosetting plastic, for example, MICARTA® manufactured by Norplex-Micarta Industrial Composites, NYLON®, fiberglass reinforced nylon (FRN), such as ZYTEL® manufactured by DuPont, NYLON®, or other synthetic materials exhibiting similar strength, handling, and manufacturability characteristics. It is well within the scope and intent of the present invention to incorporate one or more additional or alternative materials of construction into a handle 12 or portions thereof including, but not limited to, titanium, and/or aluminum.

As noted above, the handle 12 of the present folding knife assembly 10 is structured to house a blade assembly 20. The blade assembly 20, common to each embodiment of the folding knife assembly 10 in accordance with the present invention, comprises a fixed blade portion 21 and a moveable blade portion 23, as best illustrated in FIGS. 3 through 6. As illustrated in the figures, the fixed blade portion 21 includes a fixed interlock 22 which comprises a cut-out of one end of the fixed blade portion 21. In at least one embodiment, the fixed interlock 22 comprises an hourglass configuration, as best illustrated in FIG. 5. As noted above, the blade assembly 20 further comprises a movable blade portion 23, wherein the movable blade portion 23 comprises a movable interlock 24.

Figure 3:
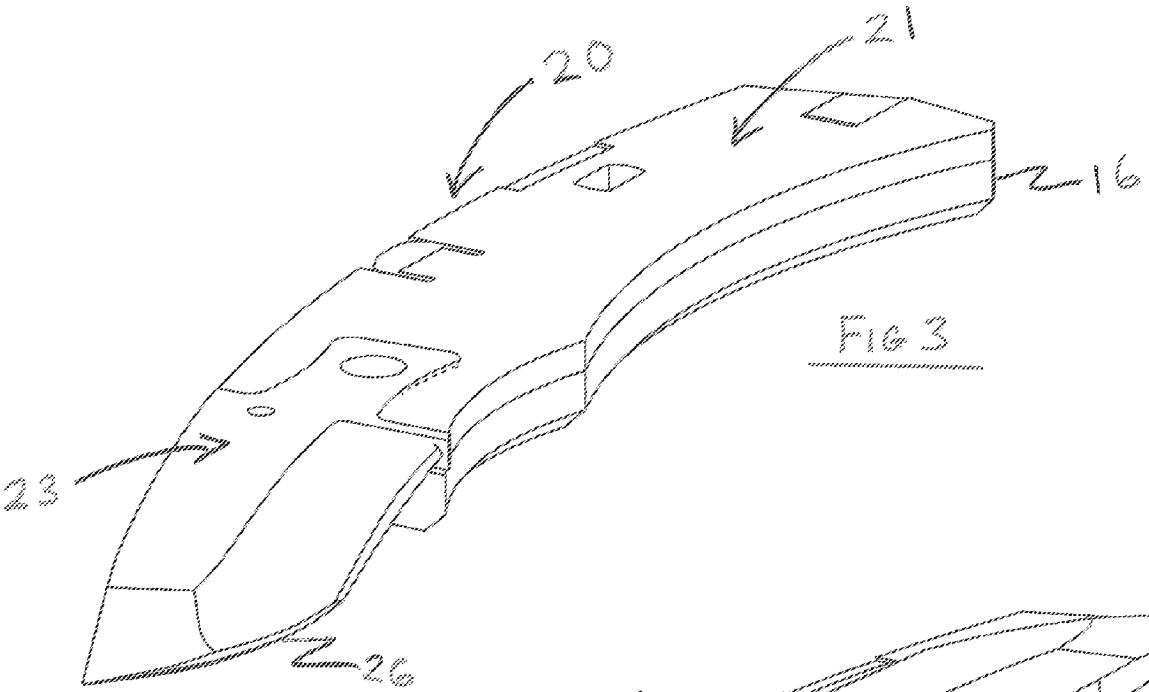
FIG. 3 is a partial cutaway view of the illustrative embodiment of FIG. 1 disposed in an open configuration.

Looking to FIG. 3, which is a partial cut-away view illustrative of one embodiment of a folding knife assembly 10 in accordance with the present invention, a movable interlock 24 of movable blade portion 23 is disposed in an interlocked orientation with a fixed interlock 22 of fixed blade portion 21. As demonstrated in FIG. 3, while the blade assembly 20 is disposed in an open configuration, the fixed blade portion 21 and the movable blade portion 23 are disposed in an interlocked orientation with one another so as to create quasi-single blade element, part of which remains closed within the handle 12, i.e., the fixed blade portion 21, and part of which remains exposed in an open configuration from the handle 12, i.e., the movable blade portion 23, to permit use of the same. Looking again to FIG. 3, while disposed in an open configuration, fixed blade portion 21 and movable blade portion 23 are disposed in substantially planar arrangement relative to one another. More in particular, this planar arrangement results in combining the fixed blade portion 21 and the movable blade portion 23 of the blade assembly 20 to form a quasi-single blade element which will exhibit improved strength and handling characteristics comparable to those of a single blade knife having part of the blade; i.e., the blade tang, fixedly secured in a handle member.

It is within the scope and intent of the present invention to initially forge a blade assembly 20 as a single unitary blade, and then separate the single unitary blade into its separate components, i.e., fixed blade portion 21 and moveable blade portion 23, by any of a number of techniques including, but not limited to, wire electrical discharge machining, laser cutting, die cutting, or pressing the single unitary blade to from fixed interlock 22 and corresponding moveable interlock 24 thereon, respectively. This procedure will not only simplify the manufacturing process, but will insure structural compatibility of the fixed blade portion 21 and the movable blade portion 23 of each blade assembly 20, in accordance with the present invention.

Figure 4:
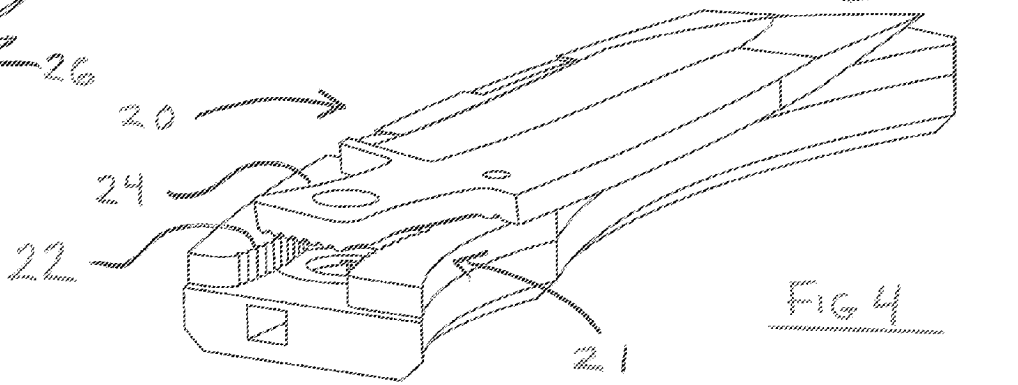
FIG. 4 is a partial cutaway view of the illustrative embodiment of FIG. 2 disposed in a closed open configuration.
Figure 5:
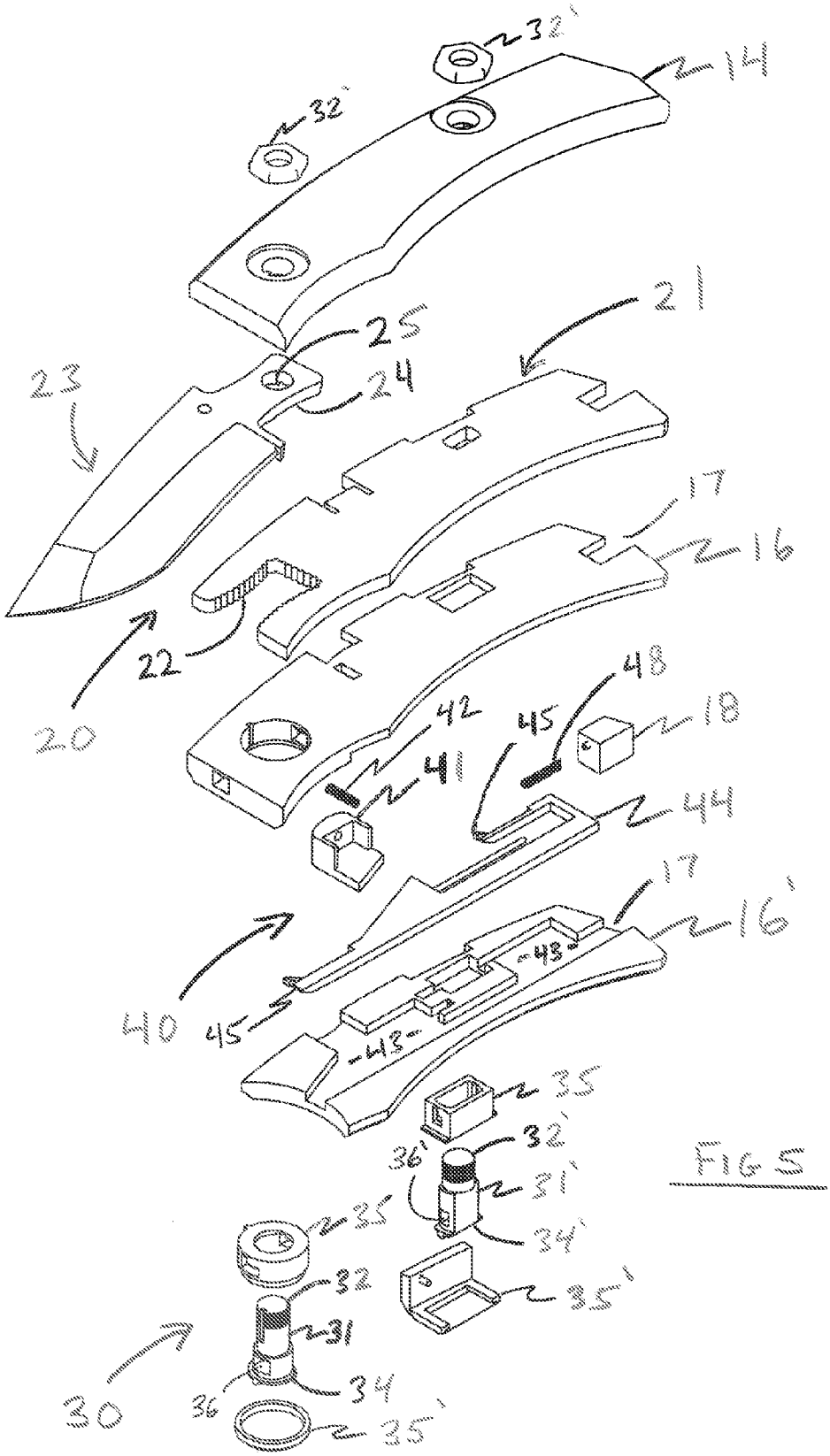
FIG. 5 is an exploded view of the illustrative embodiment of the folding knife assembly of FIG. 1.
Figure 6:
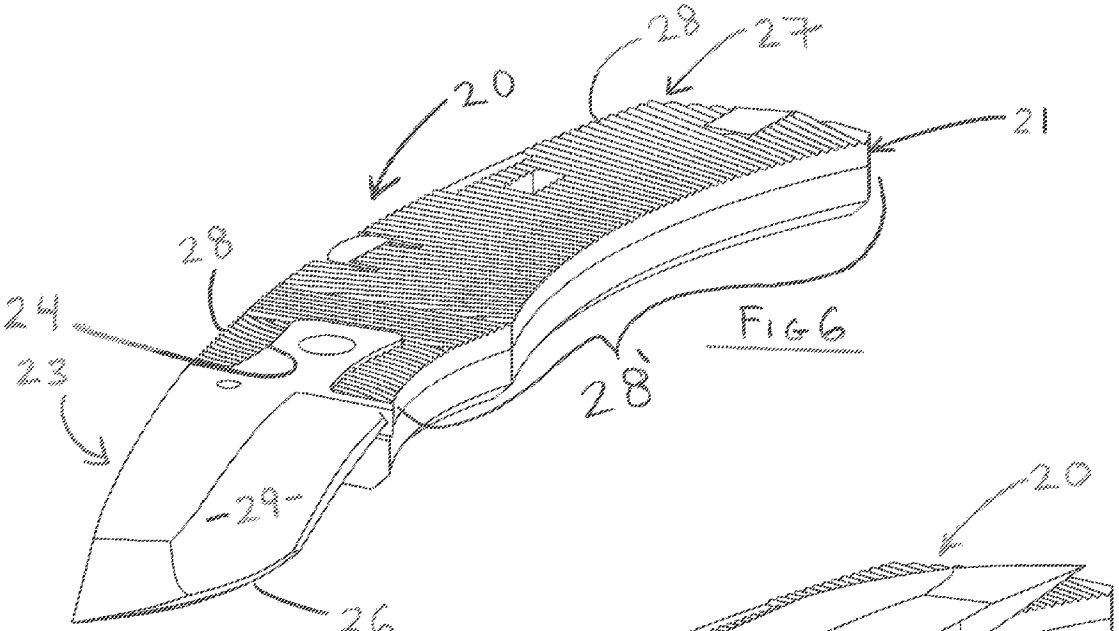
FIG. 6 is a partial cutaway view of another embodiment of a folding knife assembly in accordance with the present invention disposed in an open configuration and illustrating a plurality of debris channels disposed in a predetermined array.
Figure 7:
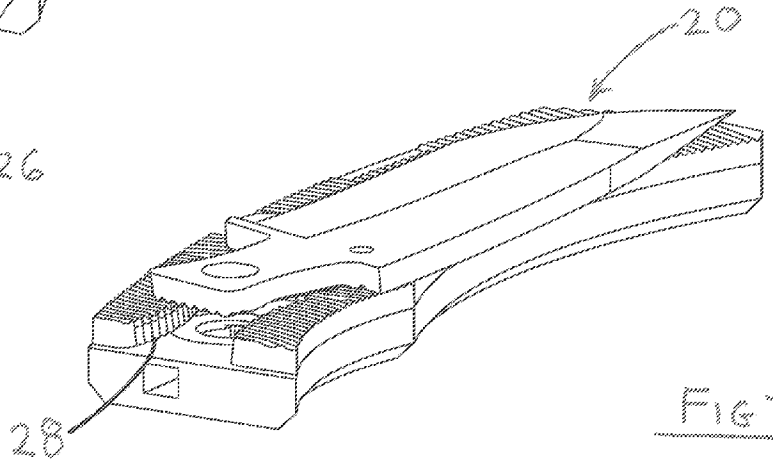
FIG. 7 is a partial cutaway view of the embodiment of FIG. 6 disposed in a closed configuration.

FIG. 4 is illustrative of one embodiment of a blade assembly 20 in a closed configuration, wherein the fixed blade portion 21 and the movable blade portion 23 are disposed in a substantially overlying arrangement with one another. It is noteworthy from FIG. 4 that the fixed blade portion 21 and movable blade portion 23 are no longer disposed in a substantially planar arrangement with one another while the blade assembly 20 is disposed in a closed configuration.

As illustrated in the embodiments of FIGS. 2 and 4, the moveable blade portion 23 is configured such that the cutting edge 26 is substantially concealed by the handle 12 when the blade assembly 20 is disposed in a closed configuration. However, in at least one embodiment, the movable blade portion 23 may comprise an extended length such that at least a section of the cutting edge 26 of the movable blade portion 23 remains exposed and useable even while the blade assembly 20 is disposed in the closed configuration. Of course, in such an embodiment, a sheath or other appropriate storage means may be employed to permit safe transport and storage of the folding knife assembly 10.

In at least one embodiment, the blade assembly 20 comprises a self cleaning means 27 in order to minimize and/or prevent dirt and debris from accumulating which may impede movement of the blade assembly 20 between open and closed configurations. The self cleaning means 27 may comprise a coating 29 on the surface of the movable blade portion 23 and/or along the surface of fixed blade portion 21, to reduce friction on the corresponding surface or surfaces. In at least one embodiment, the movable blade portion 23 and/or the fixed blade portion 21 may be polished to a Grade A mirror finish or Grade B mirror finish.

When a coating 29 is employed, it will comprise substantial friction reduction properties so as to prevent the accumulation or adherence of dirt and/or debris to either movable blade portion 23 or fixed blade portion 21, which could impede the opening and closing of the folding knife assembly 10. The coating 29 selected must be compatible with the material of construction of the blade assembly 20 itself, which may comprise 440C stainless steel, 420 stainless steel, S7 tool steel, A2 tool steel, carbon steel alloy, or other such materials exhibiting similar strength and hardness properties. In addition, the coating 29 must have sufficient inherent structural integrity to withstand the rigorous operating condition to which a knife blade may be subjected, such as is exhibited by various high wear diamond-like coatings. Examples of suitable coatings 29 include, but are not limited to, high wear coatings such as aluminum titanium nitride or aluminum chromium nitride. The coating 29 may be applied by a number of known processes, such as physical vapor deposition or heat treatment.

In at least one other embodiment, the self cleaning means 27 comprises a plurality of debris channels 28 on the surface of fixed blade portion 21 and/or fixed interlock 22. In at least one embodiment, the debris channels 28 comprise a predetermined geometry structured to facilitate the transport of dirt and debris therethrough. As shown in the illustrative embodiment of FIG. 6, the plurality of debris channels 28 may also be disposed in a predetermined array 28'. More in particular, the plurality of debris channels 28 are structured and disposed in the predetermined array 28' so as to provide clearance between the movable blade portion 23 and the fixed blade portion 21 and/or fixed interlock 22 to provide a pathway for dirt or debris which may adhere to the moveable blade portion 23 to be displaced and exit the interior of the folding knife assembly 10 of the present invention. As such, the plurality of debris channels 28 are structured and disposed so as to prevent, or at least minimize, impeding the operation of the folding knife assembly 10, specifically, preventing dirt and/or debris from impeding the positioning of the moveable blade portion 23 between open and closed configurations. In at least one embodiment, fixed handle member 14 may also comprise a plurality of debris channels 28 disposed in a predetermined array 28', so as to provide further clearance for dirt and debris which may adhere to movable blade portion 23.

In at least one further embodiment, handle 12 comprises an access port 17 to permit a user access to the interior of the folding knife assembly 10 to allow for cleaning and/or un-jamming of the lock mechanism 44 described below. An access plug 18 is provided to prevent dirt or debris from entering the interior of the folding knife assembly 10 via the access port 17, while the assembly 10 in use, transport, or storage.

Figure 1:
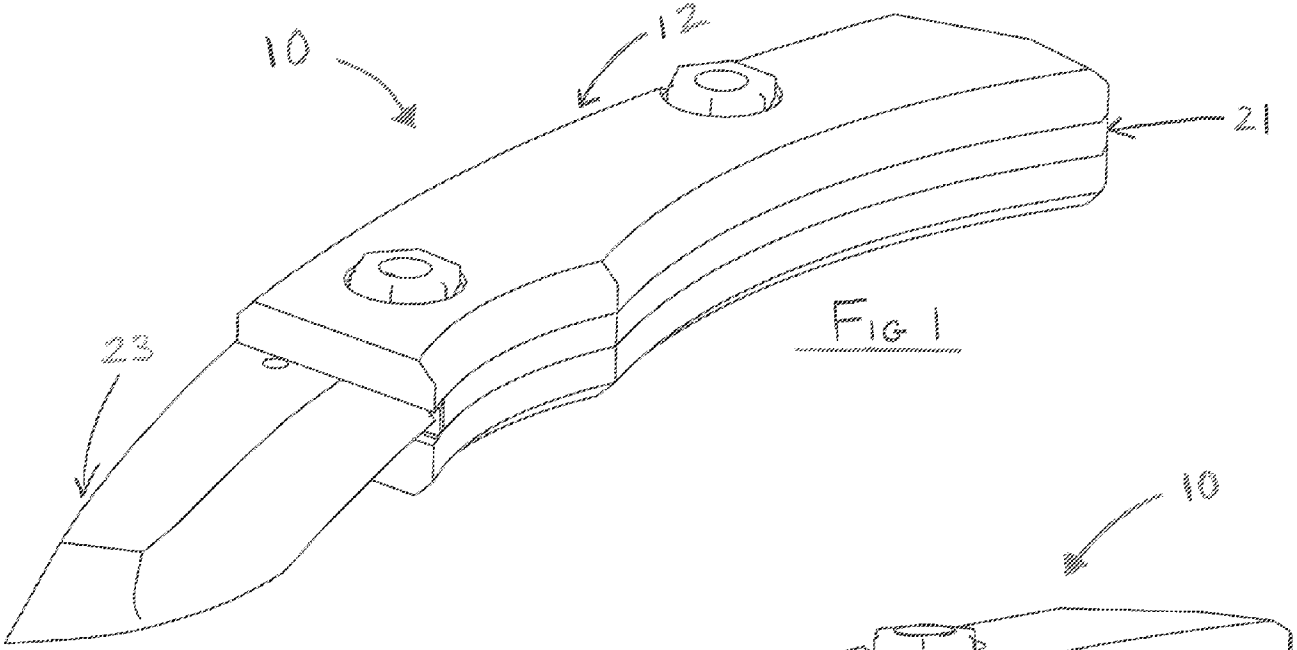
FIG. 1 is a perspective view of one illustrative embodiment of a folding knife assembly in accordance with the present invention disposed in an open configuration.

The folding knife assembly 10 in accordance with the present disclosure further includes a positioning assembly such as is shown at 30 throughout the figures. The positioning assembly 30 is structured to facilitate disposition of the blade assembly 20 between the open configuration, as illustrated in FIGS. 1 and 18, and the closed configuration, illustrated in FIGS. 2 and 19. Additionally, in at least one embodiment, the positioning assembly 30 is structured to facilitate positioning parts of the handle 12, and more in particular, fixed handle member 16 and positionable handle member 16, relative to one another, and as a result, relative to the blade assembly 20.

In accordance with the present invention, the positioning assembly 30 comprises at least one positioning pin 31 which is mounted to a portion of the handle 12 of the folding knife assembly 10. Further, at least one positioning pin 31 is structured to engage at least part of the movable blade portion 23 in such a manner that the movable blade portion 23 remains movable relative to the positioning pin 31.

In the illustrative embodiments of FIGS. 1 and 5, the positioning assembly 30 includes at least one positioning pin 31 structured to engage a part of movable blade portion 23, wherein the at least one positioning pin 31 has a fixed end 32 which is mounted to at least a portion of the handle 12 as illustrated in FIGS. 1 and 5. More in particular, as may be seen from FIG. 5, the fixed end 32 of positioning pin 31 is mounted to fixed handle member 14 via fastener 32'. The fixed end 32 and fastener 32', as illustrated herein, comprise cooperatively structured threaded interconnections, however, it is well within the scope and intent of the present invention for other mechanical fastening means to be employed to securely attach a fixed end 32 of a positioning pin 31 to a portion of a handle 12 in accordance with the present invention including, but not limited to, riveting, welding, adhesives, etc. In the alternate embodiment of a folding knife assembly 10 illustrated in FIGS. 18 through 20, at least one positioning pin 31 is mounted to a portion of the unitary fixed handle member 14', and is structured to engage a part of movable blade portion 23, as will described in greater detail below.

Figure 16A:
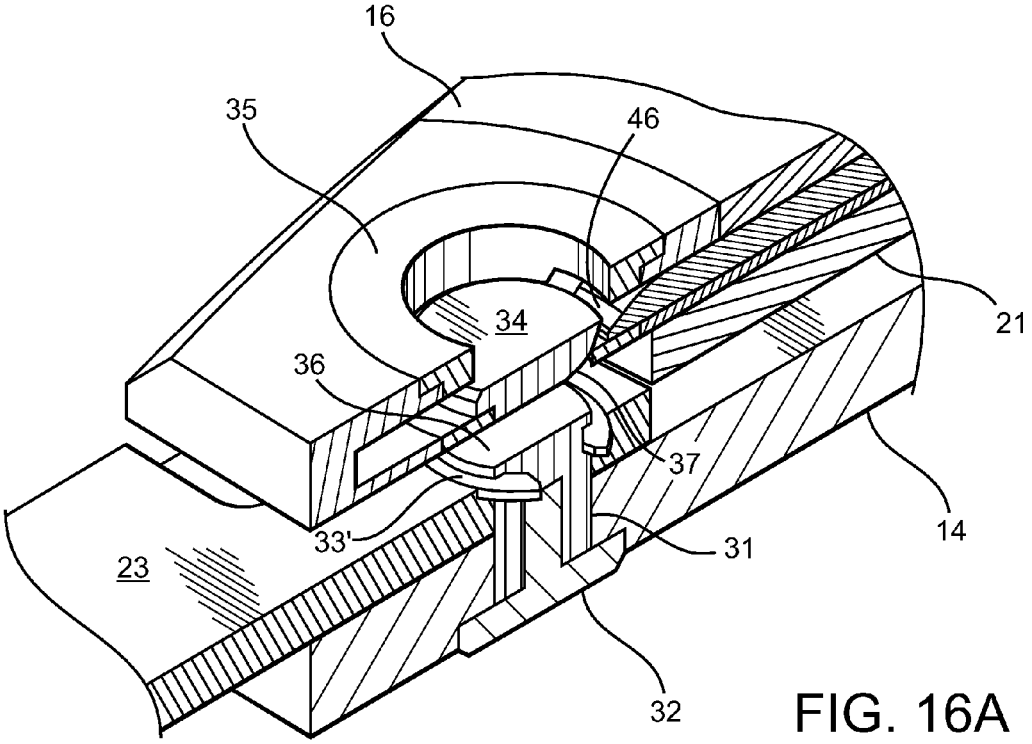
FIGS. 16A through 16C are partial cross-sectional perspective views of one embodiment of an engagement member relative to a positioning pin disposed in an unlocked, partially locked, and locked orientation, respectively, in accordance with the present invention.
Figure 17A:
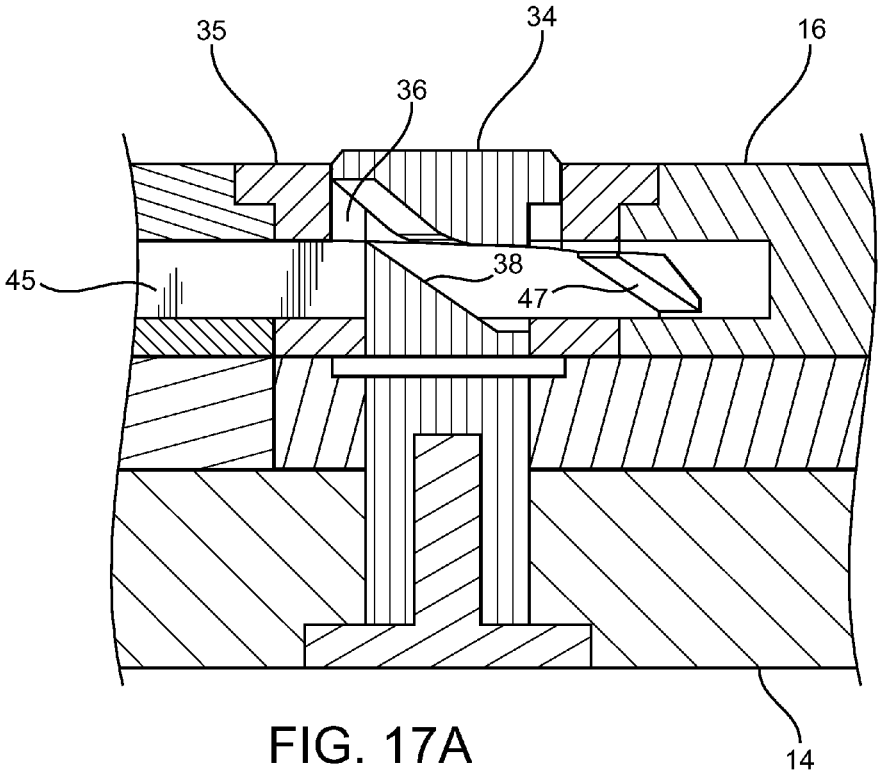
FIGS. 17A through 17C are partial cross-sectional views of one embodiment an engagement member relative to a positioning pin disposed in a locked, partially unlocked, and unlocked orientation, respectively, in accordance with the present invention.
Figure 17B:
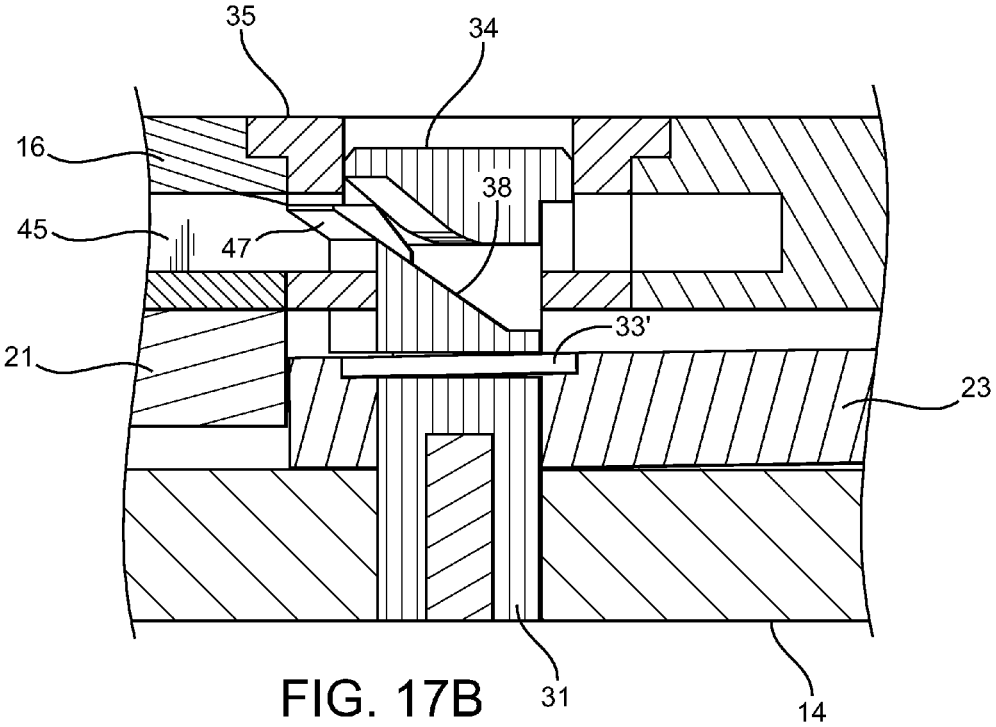
Figure 17C:
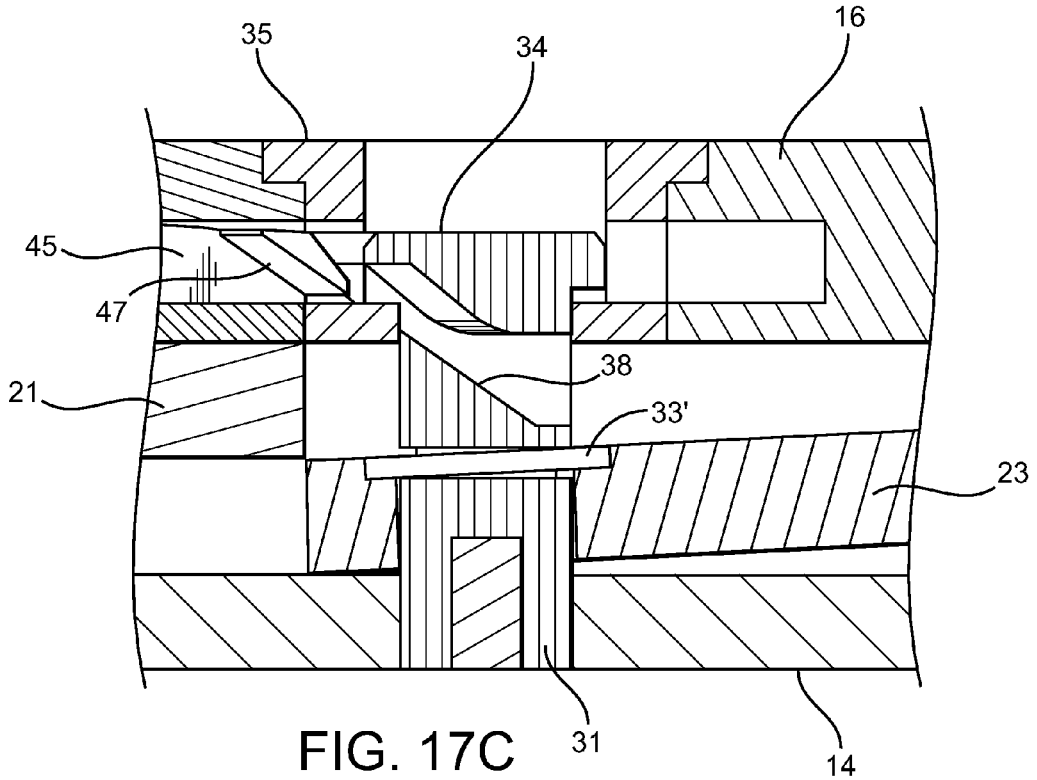

In at least one embodiment, and as illustrated best in FIG. 5, movable blade portion 23 comprises a pivot aperture 25 disposed through a portion of movable interlock 24. The pivot aperture 25 of movable blade portion 23 is structured to engage a positioning pin 31 in a manner that allows the movable blade portion 32 to be positionable about and relative to positioning pin 31. In at least one embodiment, positioning pin 31 comprises a blade retaining mechanism 33, wherein the blade retaining mechanism 33 is structured and disposed to moveably secure the movable blade portion 23 to at least a portion of the positioning pin 31. In at least one embodiment, the blade retaining mechanism 33 comprises a step or ledge formed in the shaft of the positioning pin 31 itself, as illustrated best in FIGS. 8 through 10. In one further embodiment, the blade retaining mechanism 33 comprises a blade retainer 33' structured to moveably secure the moveable blade portion 23 immediately adjacent fixed handle member 14 about the shaft of positioning pin 31, as best illustrated in FIGS. 16A and 17C.

Looking again to the illustrative embodiment of FIG. 5, the positioning assembly 30 may comprise a plurality of positioning pins 31, 31' structured to facilitate the relative positioning of parts of the handle 12 and the blade assembly 20 relative to one another. In the illustrative embodiment of the present invention wherein the positioning assembly 30 comprises a plurality of positioning pins 31, 31', the moveable blade portion 23 is structured to operatively engage only one of the plurality of positioning pins 31, such as via pivot aperture 25 as described above. In an embodiment of the present invention comprising a plurality of positioning pins 31, 31', at least one of the positioning pins 31 is primarily structured to facilitate movement of the fixed handle member 12 and the positionable handle member 16 toward and apart from one another during operation of a locking assembly 40, as is discussed in further detail below.

Figure 8:
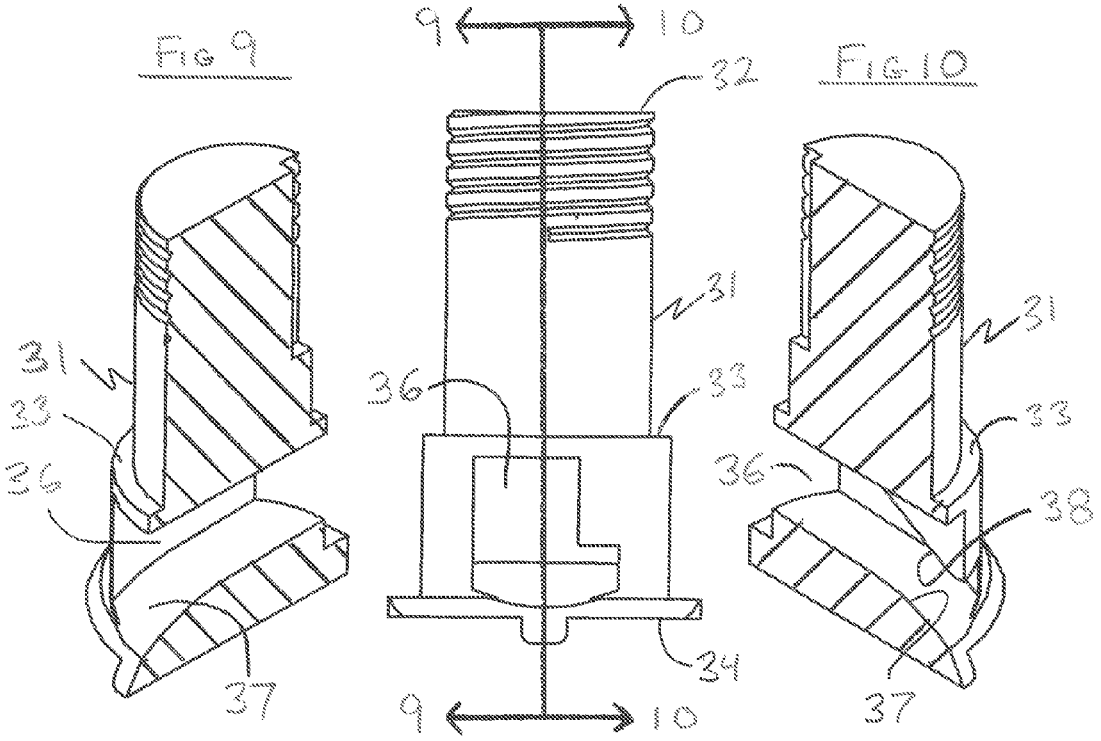
FIG. 8 is an elevation of one illustrative embodiment of a positioning pin in accordance with the present invention.

FIGS. 8 through 10 are representative of at least one embodiment of a positioning pin 31 in accordance with the present invention. As noted above, in at least one embodiment, positioning pin 31 includes a fixed end 32 and a free end 34. As illustrated in FIGS. 8 through 10, fixed end 32 of positioning pin 31 is threaded to facilitate secure attachment of the fixed end 32 to a part of the handle 12, and in at least one embodiment, to the fixed handle member 14. FIG. 8 is also illustrative of at least one embodiment of a positioning channel 36 formed through at least a portion of the positioning pin 31. As will be described in further detail below, positioning channel 36 is structured to receive at least a portion of an engagement member 45 of a lock mechanism 44 therein.

More in particular, looking to FIG. 9, the positioning channel 36 comprises a closing surface 37 which is configured to correspond to a closing element 46 of an engagement member 45, as will be described in greater detail below with reference to FIGS. 16A through 16C. In at least one embodiment, closing surface 37 is configured to slope in an upwardly direction from the mouth of the positioning channel 36, as shown in FIG. 8, into the interior thereof.

Figure 8A:
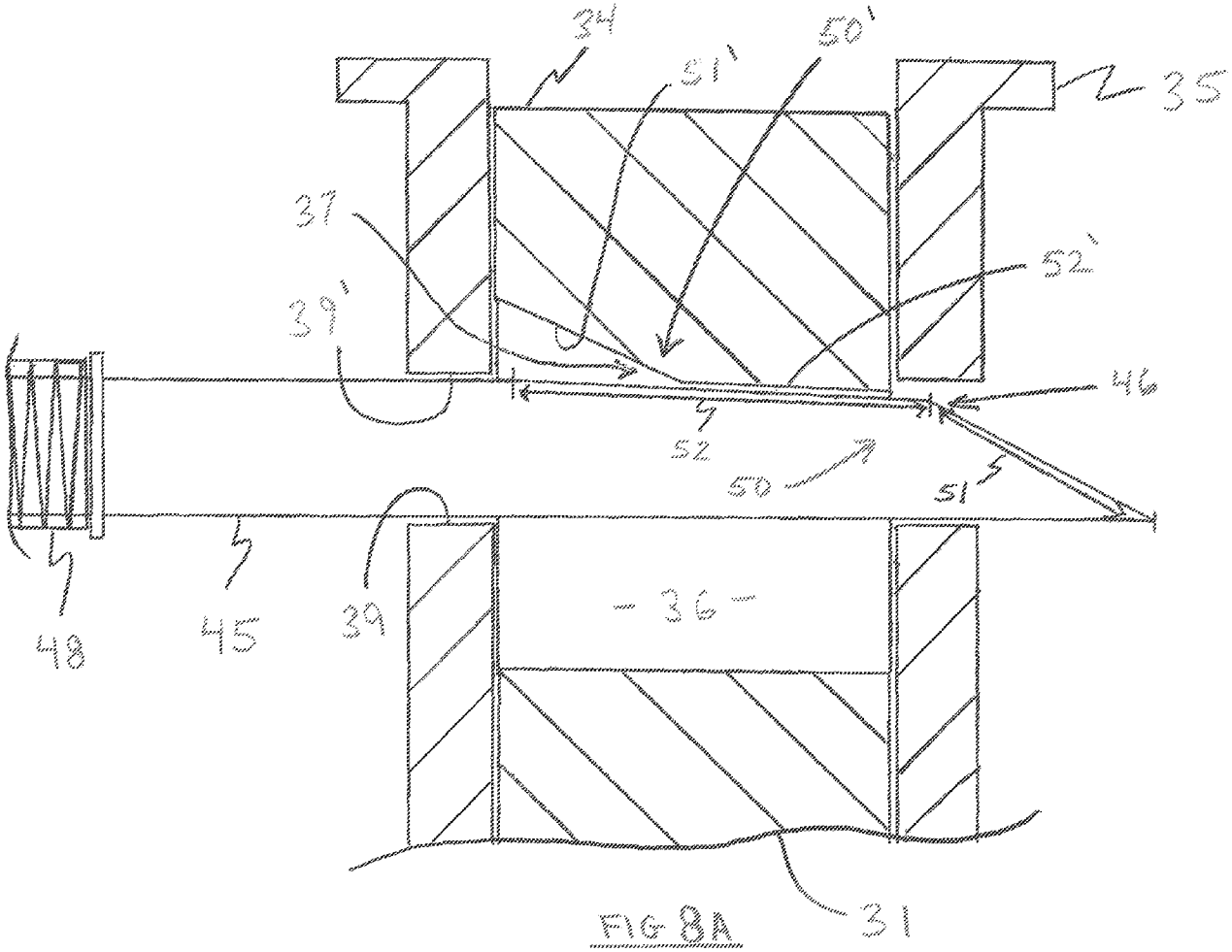
FIG. 8A is a partial cross-sectional view of an engagement member disposed in an operative engagement with a positioning pin in accordance with one embodiment of the present invention.

In at least one further embodiment, as illustrated best in FIG. 8A, the closing surface 37 comprises a composite slope 50', the composite slope 50' having an initial slope 51' of approximately thirty degrees followed by a secondary slope 52' of about two degrees, relative to the substantially planar free end 34 of positioning pin 31. Similarly, and as also illustrated in FIG. 8A, a corresponding and cooperatively structured closing element 46 of engagement member 45 comprises a composite slope 50 having an initial slope 51 of about thirty degrees and a secondary slope 52 of approximately two degrees. The purpose of the composite slope configurations 50, 50' are such that upon initial entry of the closing element 46 into the positioning channel 36, the initial slope 51 of closing element 46 will engage the initial slope 51' of the closing surface 37, thereby causing movement of the fixed blade portion 21 and the movable blade portion 23 into an interlocked orientation with one another. Further, once the closing element 46 of the engagement member 45 has substantially passed through positioning channel 36, as is shown in FIG. 8A, the secondary slope 51 of the closing element 46 operatively engages the secondary slope 51' of closing surface 37 to exert sufficient frictional forces on one another to restrict movement of the engagement member 45 from the positioning channel 36 without a significant and purposeful effort upon a release mechanism, such as release 41 discussed below. The frictional forces generated between the closing elements 46 and closing surface 37, as a result of the interaction between corresponding secondary slopes 52, 52', respectively, also serves to maintain a tight tolerance between handle members 14, 16 and the blade assembly 20, while the blade assembly 20 is disposed in an open configuration. Further, the secondary slopes 52, 52' serve to provide wear surfaces between the closing element 47 and closing surface 37, thereby assuring an extended useful life of the folding knife assembly 10 in accordance with the present invention.

Figure 8B:
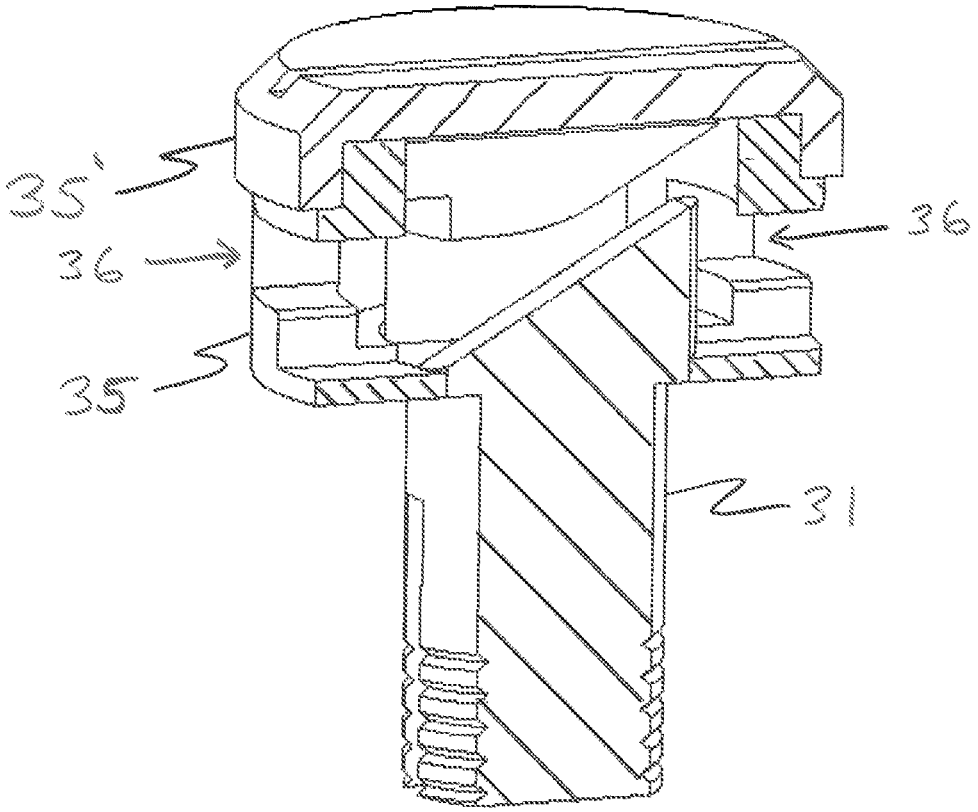
FIG. 8B is a partial cross sectional view of a positioning pin and collar in accordance with one embodiment of the present invention.

FIG. 8A also illustrates closing supports 39 and opening supports 39' of collar 35. In operation, when engagement member 45 passes into or out of positioning channel 36, a portion of the engagement member 45 contacts either closing supports 39 or opening supports 39', respectively. The closing supports 39 and opening supports 39' provide a leverage surface for the engagement member 45 to cause movement of the free end 34 of the positioning pin 31 within collar member 35 via its operative engagement of closing surface 37 or opening surface 38, respectively. FIG. 8B is a partial cross section of collar 35 and collar retainer 35' disposed in an operative orientation relative to a positioning pin 31.

Furthermore, FIG. 10 illustrates an opening surface 38 disposed in a spaced apart and opposing relationship to the closing surface 37 in the positioning channel 36 of positioning pin 31. As shown in FIG. 10, opening surface 38 is structured and disposed to slope upwardly from the mouth of positioning channel 36 towards the interior thereof, in an approximately parallel arrangement with the closing surface 37. As noted above with regard to opening surface 37, closing surface 37 is cooperatively structured to be operatively engaged by an opening element 47 of an engagement member 45, once again, as is described in greater detail below with reference FIGS. 17A through 17C. Opening surface 38 may comprise a slope being configured to operatively engage a slope of a cooperatively structured opening element 47 of an engagement member 45. In at least one embodiment, the slope of the opening surface 38 and corresponding opening element 48 are each approximately thirty degrees.

It is noted that FIGS. 8 through 10 are illustrative of only one embodiment and configuration of a positioning channel 36 and corresponding closing and opening surfaces 37 and 38, respectively. As one example, FIG. 5 illustrates positioning pin 31' having a substantially rectangular shaped free end 34 and a correspondingly rectangular shaped positioning channel 36' extending therethrough. As yet another example, positioning pin 31" as illustrated in FIG. 20 comprises positioning channel 36" having a substantially curvilinear configuration which is cooperatively structured for engagement by the "quick release" type lock mechanism 44', as will be described in greater detail below. Of course, it is well within the scope and intent of the present invention for a positioning channel 36 and/or closing surface 37 and/or opening surface 38 to comprise any of a plurality of alternative or additional geometric configurations which are cooperatively structured to be operatively engaged by an engagement member 45, 45' of a lock mechanism 44, 44'.

Figure 11:
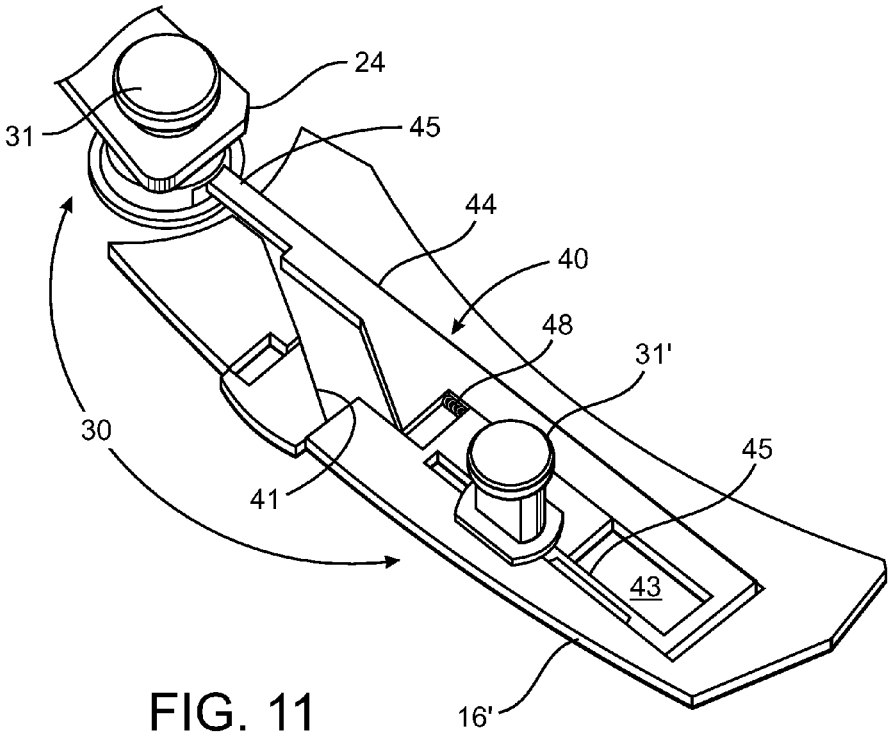
FIG. 11 is partial cutaway perspective view of one embodiment of a locking assembly disposed in an unlocked orientation relative to a positioning assembly, in accordance with the present invention.
Figure 12:
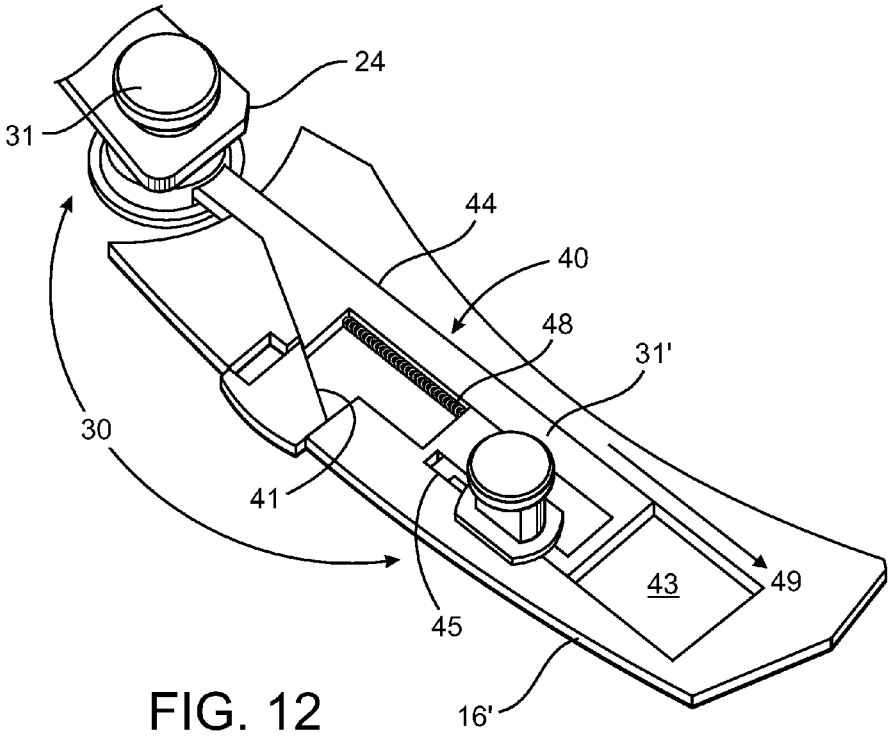
FIG. 12 is partial cutaway perspective view of the embodiment of the locking assembly of FIG. 11 disposed in a locked orientation relative to the positioning assembly.

As indicated above, the folding knife assembly 10 in accordance with the present invention comprises a locking assembly generally as shown at 40 or 40' throughout the Figures. FIGS. 11 and 12, are illustrative of one embodiment of a locking assembly 40 in accordance with the present invention. More in particular, FIGS. 11 and 12 present a partial cutaway perspective view of a lock mechanism 44 disposed in a lock mechanism chamber 43 which is formed in cover member 16' of positionable handle member 16. It will be understood and appreciated from the figures that when cover member 16' is attached to positionable handle member 16, the lock mechanism 44 will be moveably secured and operable in the lock mechanism chamber 43.

FIG. 11 illustrates the locking assembly 40 in an unlocked orientation relative to positioning assembly 30. As shown in FIG. 11, the locking assembly 40 comprises a lock mechanism 44 having a plurality of engagement members 45 which are offset from one another and are structured and disposed to engage a different one of positioning pins 31, 31' of positioning assembly 30. In at least one embodiment, lock assembly 40 includes a biasing member 48 which is structured to reposition the lock mechanism 44 between unlocked and locked orientations relative to the positioning assembly 30. As illustrated in FIG. 11, a biasing member 48 is disposed in a compressed state between the cover member 16' and the lock mechanism 44. Further, FIG. 11 is illustrative of the lock mechanism 44 disposed in an unlocked orientation and as it is positioned just prior to movement into a locked orientation with positioning assembly 30, as is demonstrated by the end of each of engagement member 45 being disposed adjacent to and abutting a corresponding positioning pin 31 and 31'. In the illustrative embodiment of the folding knife assembly as shown in FIGS. 1 through 17, lock mechanism 44 is structured to be retained in the unlocked orientation as illustrated in FIGS. 11 and 13, while movable blade portion 23 is disposed in an at least partially overlying arrangement with fixed blade portion 21.

However, upon positioning of the movable blade portion 23 such that the moveable interlock 24 moves into alignment with fixed interlock 22, such as by rotating the moveable blade portion 23 from the closed configuration of FIGS. 2 and 4, to the open configurations of FIGS. 1 and 3, engagement members 45 of lock assembly 44 are forced through corresponding positioning channels 36 of positioning pins 31 and 33' into the locked orientation, as illustrated in FIG. 12, via the force of biasing member 48. Furthermore, movement of engagement members 45 of lock mechanism 44 through the corresponding positioning channels 36 of positioning pins 31, 31' causes fixed handle member 14 and positionable handle member 16 to move towards one another thereby forcing movable interlock 24 of movable blade portion 23 into an interlocked orientation with fixed interlock 22 of fixed blade portion 21, thus securing the blade assembly 20 in an open configuration. FIGS. 16A through 16C, described below, are illustrative of the interaction of an engagement member 45 of lock mechanism 44 with positioning channel 36 of positioning pin 31 so as to cause movement of fixed handle member 14 and positioning handle member 16 towards one another, and disposition of movable blade portion 23 into an interlocked orientation with fixed blade portion 21.

Looking once again to FIG. 12, biasing member 48 is disposed in an uncompressed state between the portion of cover member 16' and lock mechanism 44. Further, at least a portion of a release 41 is disposed in engagement with a portion of lock mechanism 44. More in particular, in the embodiment of FIG. 12, release 41 comprises a sloped surface which is cooperatively structured to engage a sloped surface of lock mechanism 44 such that the force of pressing downwardly and inwardly on release 41 is sufficient to force lock mechanism 44 to slide rearward, as indicated by directional arrow 49, thereby retracting engagement members 45 from corresponding positioning pins 31 and 31' and returning the locking assembly 40 to the unlocked configuration as shown in FIG. 11. A biasing element may be utilized to return release 41 to an outwardly extended position once the locking assembly 40 has been returned to the unlocked configuration. More in particular, while in the unlocked configuration of FIG. 11, movable blade portion 23 may be rotated about positioning pin 31 and back into an overlying arrangement with fixed blade portion 21, thereby disposing blade assembly 20 into the closed configuration such as is illustrated best in FIG. 2. FIGS. 17A through 17C as described below are illustrative of the interaction between engagement member 45 of lock mechanism 44 and positioning channel 36 of positioning pin 31 so as to reposition the locking assembly 40 from a locked orientation, as illustrated in FIG. 12, into the unlocked orientation, as illustrated in FIG. 11.

Figure 13:
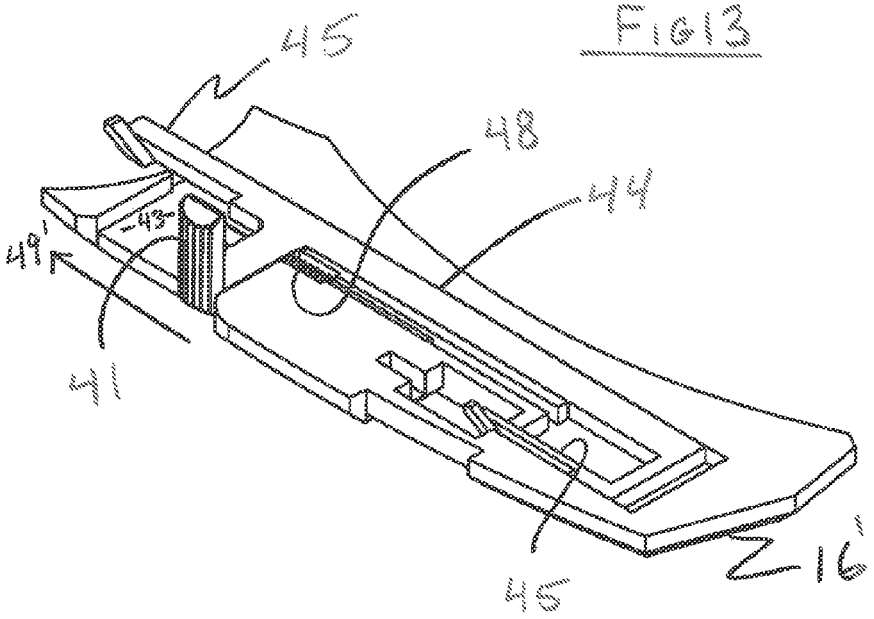
FIG. 13 is partial cutaway perspective view of one alternate embodiment of a locking assembly disposed in an unlocked orientation, in accordance with the present invention.
Figure 14:
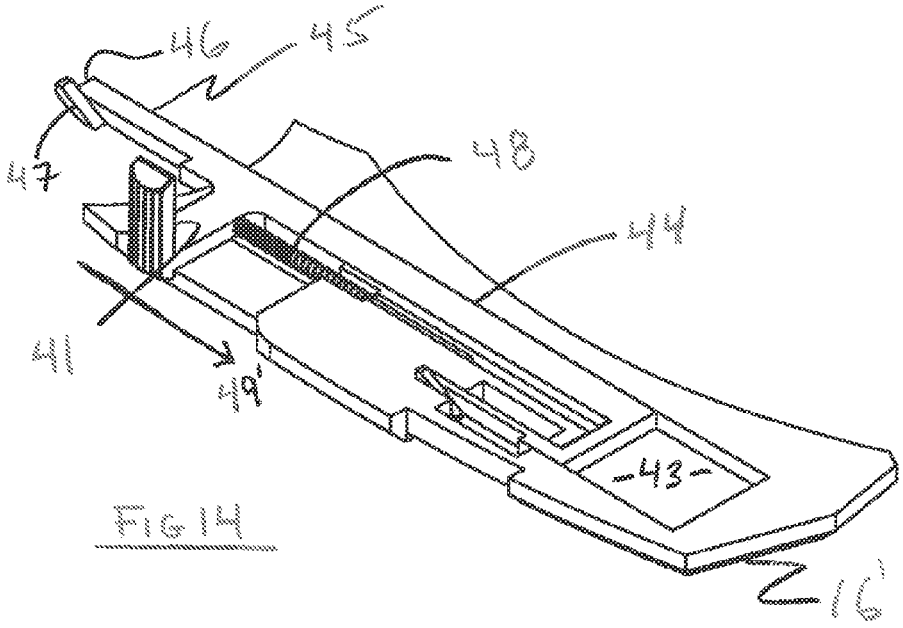
FIG. 14 is partial cutaway perspective view of the embodiment of the locking assembly of FIG. 13 disposed in a locked orientation.
Figure 15:
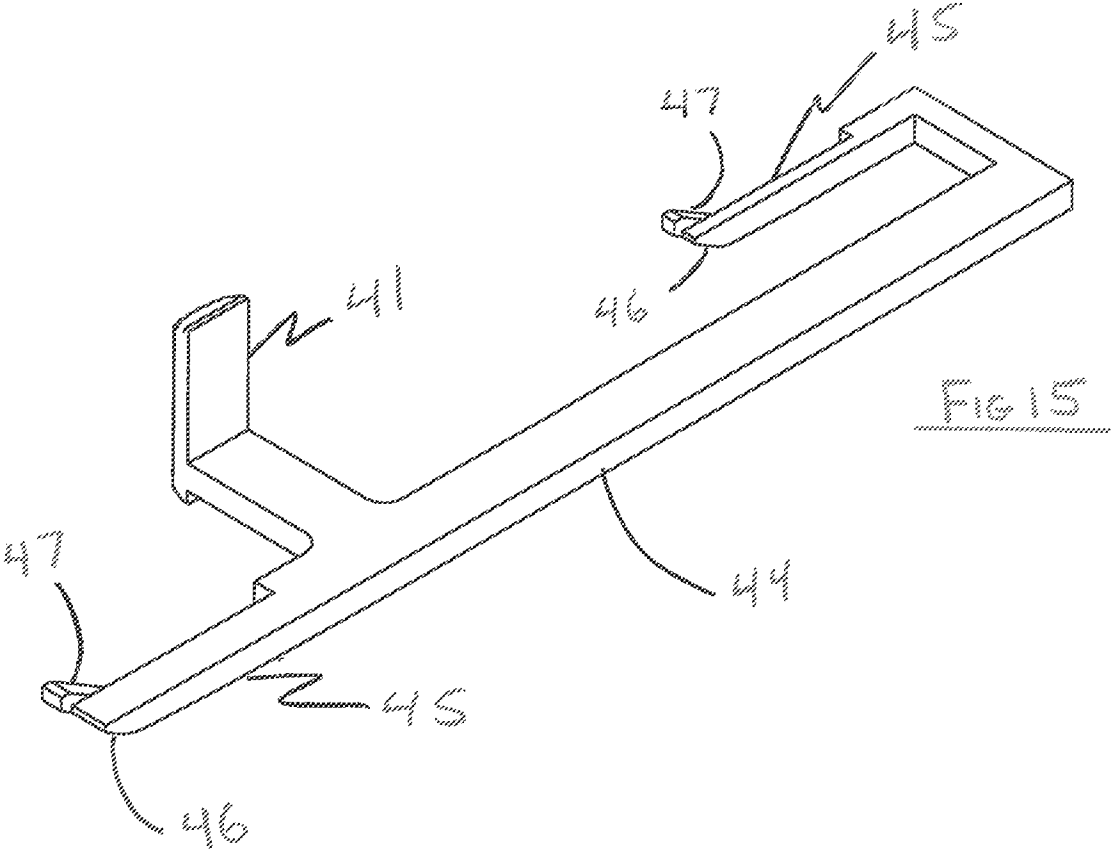
FIG. 15 is perspective view of a lock mechanism in accordance with the alternate embodiment of locking assembly illustrated in FIG. 13.

FIGS. 13 through 15 are illustrative of one alternate embodiment of a lock mechanism 44 in accordance with the present invention. More in particular, lock mechanism 44 of the illustrative embodiment of FIGS. 13 through 15 includes a release 41 being fixedly attached to lock mechanism 44. As such, engagement members 45 of lock mechanism 44 may be moved into and out of engagement with corresponding positioning pins 31 and 31' by directly moving release 41 forward or backward, indicated by directional arrows 49', against the force of biasing member 48. As shown in FIG. 15, the alternate embodiment of lock mechanism 44 comprises a unitary construction comprising release 41. FIG. 15 is further illustrative of closing elements 46 and opening elements 47 of corresponding engagement members 45 which, as previously noted are cooperatively structured to operatively engage corresponding closing surface 37 and opening surface 38 in positioning channel 36 of positioning pin 31, 31'.

Figure 16B:
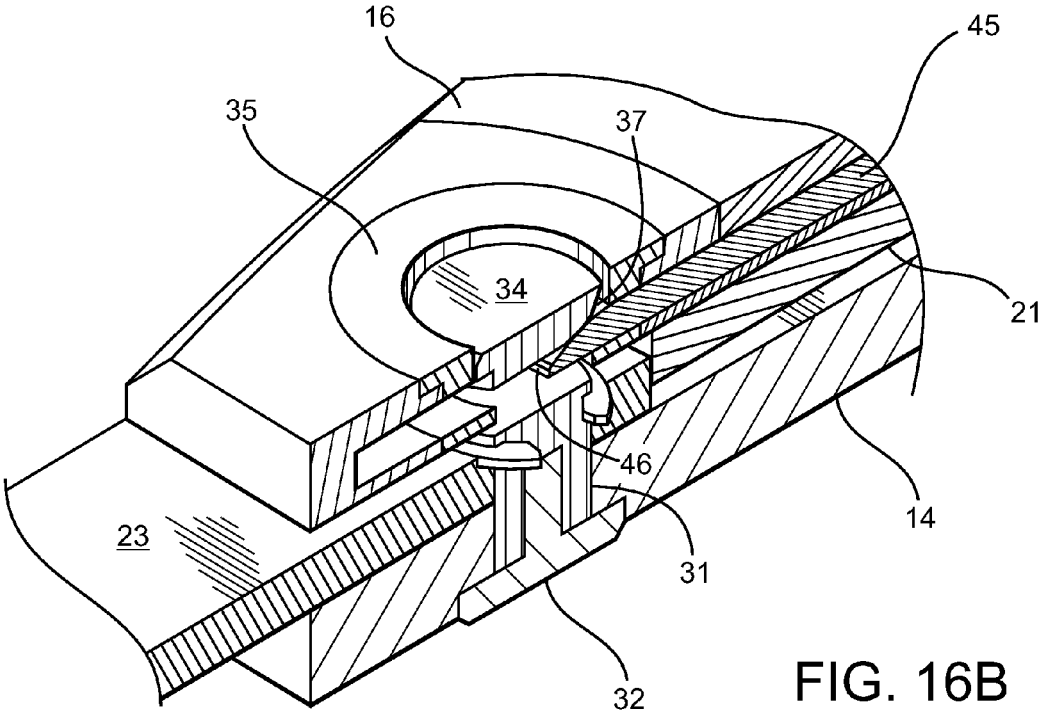
Figure 16C:
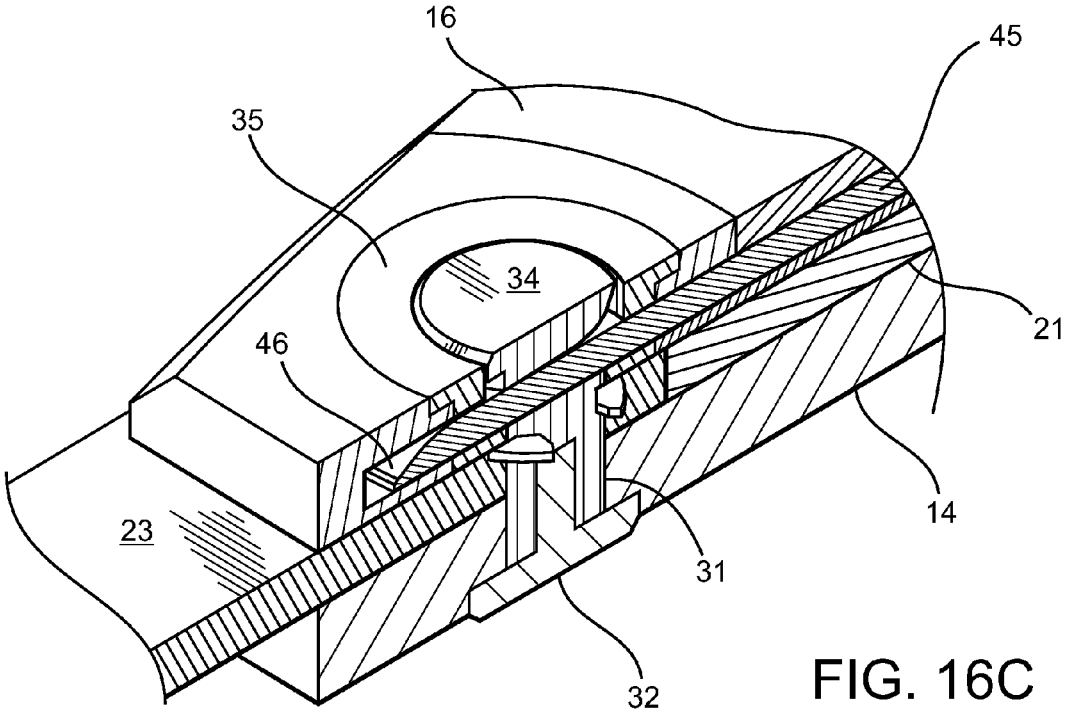

FIGS. 16A through 16C are illustrative of one embodiment of a folding knife assembly 10 in accordance with the present invention wherein an engagement member 45 of a lock assembly 44 engages a positioning pin 31 of a positioning assembly 30 causing fixed handle member 14 and positionable handle member 16 to move towards one another and thereby releasably securing fixed blade portion 21 and movable blade portion 23 of blade assembly 20 in an open configuration. As shown in FIG. 16A, fixed blade portion 21 is affixed to positionable handle member 16 and movable blade portion 23 is moveable secured to fixed handle member 14 via blade retainer 33'. FIG. 16A further illustrates that, at least initially, fixed blade portion 21 is off-set from movable blade portion 23 by a distance slightly greater than the thickness of movable blade portion 23. Closing element 46 of engagement member 45 is disposed adjacent closing surface 37 of positioning pin 31, as also shown in FIG. 16A, and the free end 34 of positioning pin 31 is recessed in and substantially surrounded by collar 35. Collar 35 is fixedly attached to a part of positionable handle member 16, and in at least one embodiment, a collar retainer 35' may be utilized to facilitate fixedly attaching collar 35 to positionable handle member 16. In at least one embodiment, the collar retainer 35' further serves as a cover to prevent dust, dirt, or debris from entering the interior of the folding knife assembly 10. Also illustrated is blade retainer 33' which serves to movably secure movable blade portion 23 about positioning pin 31, and fixed end 32 of positioning pin 31 is fixedly attached to a part of fixed handle member 14.

Looking next to FIG. 16B, engagement member 45 is approximately midway through positioning channel 36, and the interaction of closing element 46 pushing upwardly against closing surface 37 of positioning pin 31 causes positionable handle member 16 to move downward towards fixed handle member 14. This occurs as a result of lock mechanism 44 being movably secured within lock mechanism chamber 43 in positionable handle member 16, and fixed end 32 of positioning pin 31 being fixedly secured to a part of fixed handle member 14. More in particular, as the closing surface 46 of engagement member 45 passes through positioning channel 36, lock mechanism 44, and subsequently, positionable handle member 16, are pulled in a downward direction as shown in FIGS. 16B and 16C. This is best illustrated in FIG. 16B wherein collar 35, which is fixedly attached to positionable handle member 16, is displaced from its original position shown in FIG. 16A, to be substantially flush with the top of free end 34 of positioning pin 31. Also, FIG. 16B illustrates the fixed blade portion 21 abutting at least a part of movable blade portion 23 at their interface.

FIG. 16C is illustrative of engagement member 45 of lock mechanism 44 disposed in a fully locked orientation relative to positioning pin 31. As shown in FIG. 16C, closing element 46 has passed completely through positioning channel 36 of positioning pin 31, collar 35 is fully retracted around free end 34 of positioning pin 31, and, movable blade portion 23 is disposed in a substantially planar arrangement with fixed blade portion 21, as is clearly demonstrated at the interface of blade portions 21, 23. FIG. 16C is also illustrative of the lock mechanism 44 securely yet releasably retaining moveable blade portion 23 of blade assembly 20 in an open configuration, and that movable blade portion 23 will remain in said open configuration until engagement member 45 is fully retracted through and out of positioning channel 36, thereby allowing positionable handle member 16 to move apart from fixed handle member 14. In doing so, fixed blade portion 21 moves apart from movable blade portion 23, thereby allowing movable blade portion 23 to be rotated about positioning pin 31 into a closed configuration, such as illustrated in FIG. 2.

Release of lock mechanism 44 from a locked orientation to an unlocked orientation relative to positioning pin 31 is illustrated in FIGS. 17A through 17C. Looking first to FIG. 17A, engagement member 45 is disposed substantially through positioning channel 36 of positioning pin 31 in a fully locked orientation. As illustrated in FIG. 17A, opening element 47 of engagement member 45 is configured and cooperatively structured to engage opening surface 38 of positioning pin 31, such as is illustrated best in FIG. 17B. FIG. 17B, also illustrates blade retainer 33' securely yet movably retaining movable blade portion 23 in position adjacent fixed handle member 14 while fixed blade portion 21 moves upwardly with positionable handle member 16. FIG. 17B also illustrates collar 35 moving upwardly around free end 34 of positioning pin 31. Finally, looking to FIG. 17C, engagement member 45 is fully retracted from positioning channel 36 and movable blade portion 23 is offset from fixed blade portion 21 a sufficient distance such that movable blade portion 23 may be rotated about pivot pin 31, thereby disposing blade assembly 20 into a closed configuration, such as illustrated in FIG. 2.

Turning next to FIGS. 18 through 20, an alternate embodiment of a folding knife assembly 10 in accordance with the present invention is illustrated therein. More in particular, FIGS. 18 through 20 are illustrative of an alternate embodiment of a folding knife assembly 10 having a "quick-release" type locking assembly as shown at 40'. FIG. 18 is a perspective view of the folding knife assembly 10 disposed in an open configuration. FIG. 19 is a perspective view of the folding knife assembly 10 having the blade assembly 20 in a closed configuration, wherein the cutting edge 26 of movable blade 23 is disposed in a retention channel 14" which is formed in unitary fixed handle member 14'.

Looking next to FIG. 20, "quick-release" locking assembly 40' includes a lock mechanism 44' comprised of a single component. More in particular, lock mechanism 44' includes engagement members 45' which are structured to engage corresponding positioning channel 36" of positioning pin 31". FIG. 20 further illustrates that lock mechanism 44' includes a plurality of locking elements 46' on either side, as well as a release surface 47'. As shown best in FIGS. 18 and 19, when disposed in a locked orientation, locking elements 46' of lock mechanism 44' are structured to engage a part of movable blade portion 23 and retain movable blade portion 23 in position relative to fixed blade portion 21 in either a substantially planar arrangement, such as in the open configuration of blade assembly 20 illustrated in FIG. 18, or in a substantially overlying arrangement, such as in the closed configuration of the blade assembly 20 illustrated in FIG. 19. In order to release movable blade portion 23 to allow movement between open and closed configurations, lock mechanism 44' comprises a release 41' which may be rotated in a direction shown by directional arrow 49" to a substantially perpendicular position relative to the movable blade portion 23, thereby allowing movable blade portion 23 to pivot about positioning pin 31 into and out of the open configuration illustrated in FIG. 18. The locking elements 46' of lock mechanism 44' in combination with the curvelinear configuration of positioning channel 36" of positioning pin 31" provide for the application of sufficient force to retain movable blade portion 23 in either the open configuration of FIG. 18 or the closed configuration of FIG. 19. Furthermore, release surface 47' is structured to release said force and provide sufficient clearance between moveable blade portion 23 and fixed blade portion 21 when lock mechanism is rotated such that release surface 47' is disposed in a substantially parallel configuration with the part of movable blade portion 23 and engagement members 45' are repositioned in curvilinear positioning channel 36", thereby allowing movement of movable blade portion 23 into and out of the open and closed configurations.

Figure 21:
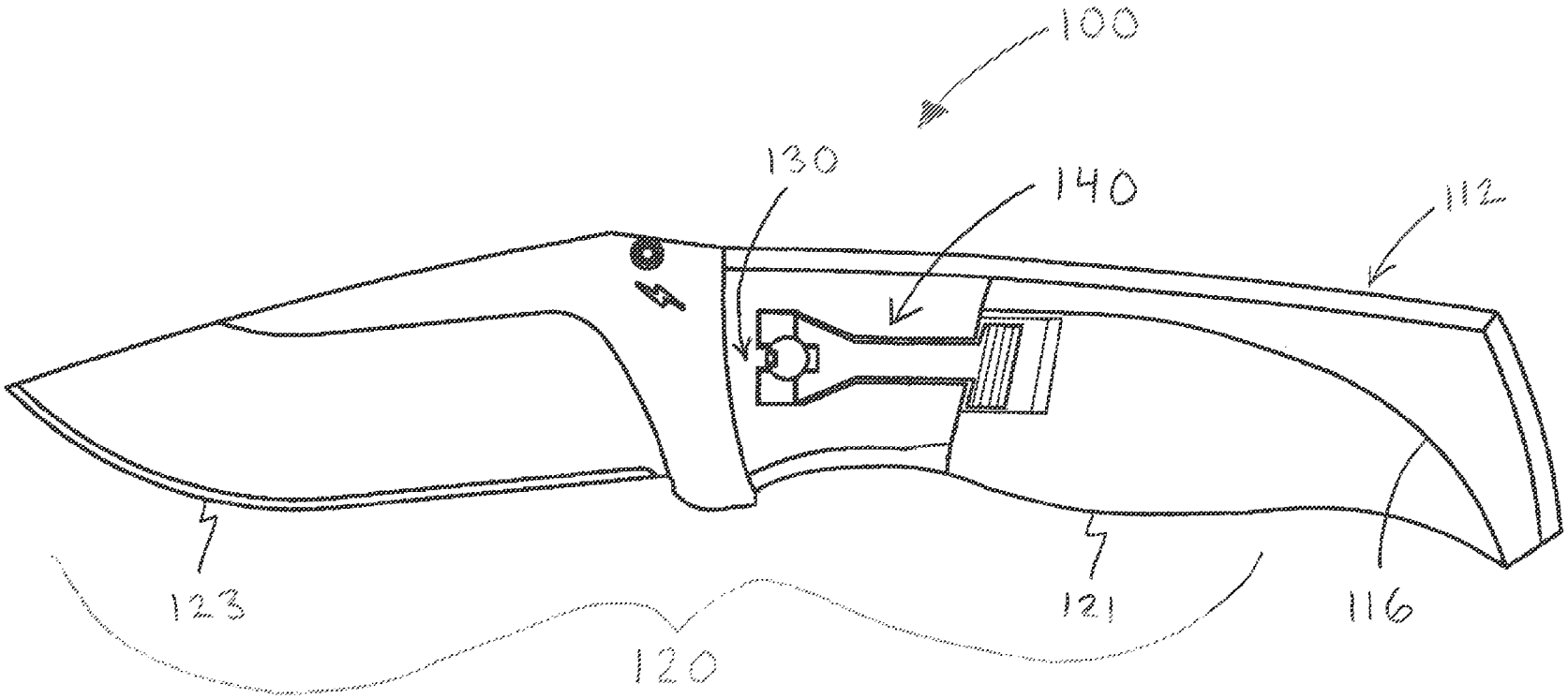
FIG. 21 is a plan view of one side of yet one further illustrative embodiment of a folding knife assembly in accordance with the present invention, disposed in an open configuration.
Figure 22:
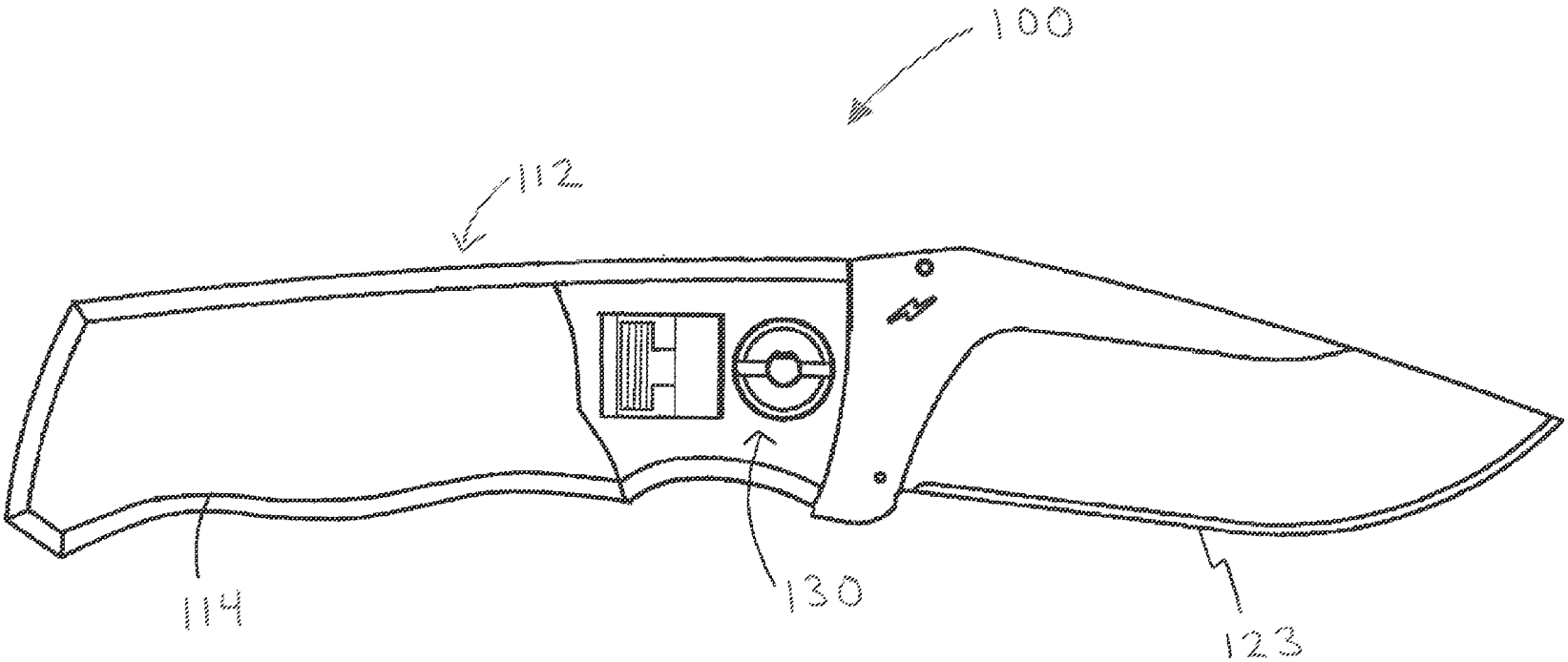
FIG. 22 is a plan view of the opposite side of the illustrative embodiment of the folding knife assembly of FIG. 21, disposed in an open configuration.

FIGS. 21 through 24 are illustrative of yet one further alternative embodiment of a folding knife assembly as shown as at 100 therein, in accordance with the present invention. Specifically, FIGS. 21 through 24 present an alternative embodiment of a folding knife assembly 100 having a cam type locking assembly, generally shown as 140 throughout the figures. FIG. 21 is a plan view of one side of the folding knife assembly 100 illustrating a blade assembly 120, including fixed blade portion 121 and movable blade portion 123 disposed in an open configuration. FIG. 22 is a plan view of the other side of the folding knife assembly 100 as shown in FIG. 21, once again, showing a blade assembly 120 disposed in an open configuration. As shown in FIG. 22, in at least one embodiment, the fixed blade handle member 114 comprises a palm swell along its lower edge to facilitate ease in handling the present folding knife assembly 100, whether in an open or closed configuration.

Figure 23:
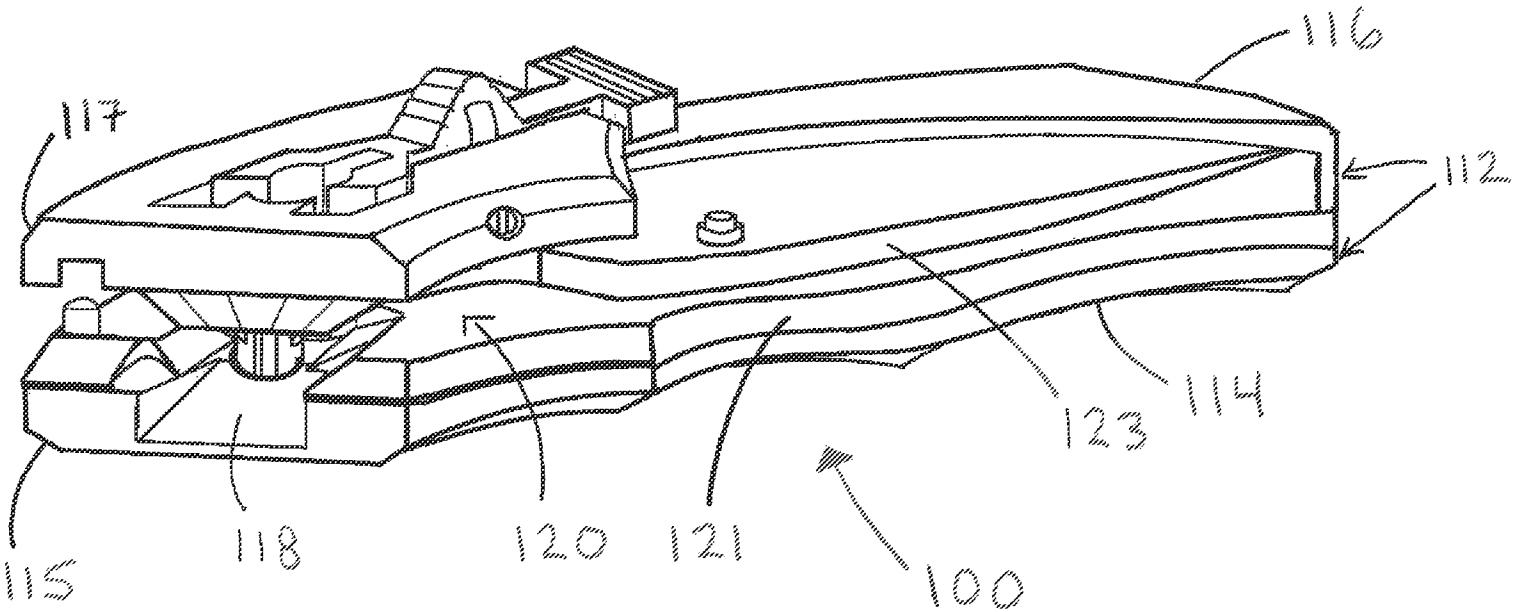
FIG. 23 is a perspective view of an illustrative embodiment of a folding knife assembly in accordance with FIGS. 21 and 22 disposed in a closed configuration.

A perspective view of the folding knife assembly 100 in accordance with the present embodiment is illustrated in FIG. 23, wherein the blade assembly 120 comprises a fixed blade portion 121 and a movable blade portion 123, as in previously disclosed embodiments of the folding knife assembly 10 herein. Also as before, FIG. 23 demonstrates that while in a closed configuration, movable blade portion 123 is disposed in a substantially overlying relation to fixed blade portion 121, as opposed to the substantially planar orientation of the fixed blade portion 121 and the movable blade portion 123 while disposed in an open configuration, such as is illustrated in FIG. 21. As before, this planar arrangement results in the fixed blade portion 121 and the movable blade portion 123 of the blade assembly 120 forming a quasi-single blade element which will exhibit improved strength and handling characteristics comparable to those of a single blade knife having part of the blade; i.e., the blade tang, fixedly secured in a handle member.

FIG. 23 further illustrates a handle 112 including a fixed blade handle member 114 disposed adjacent a fixed blade portion 121, and a movable blade handle member 116 which is fixedly attached to fixed blade handle member 114 and/or fixed blade portion 121. The movable blade handle member 116 forms a channel with the fixed blade handle member 114 and/or the fixed blade portion 121 into which movable blade portion 123 is positioned while the folding knife assembly 100 is disposed in a closed configuration, once again, as shown in FIG. 23. In addition to the handle 112, in at least one embodiment, the folding knife assembly 100 in accordance with the present invention comprises one or more bolster such as, by way of example, fixed blade bolster 115 and/or movable blade bolster 117 as described in further detailed below.

Figure 24:
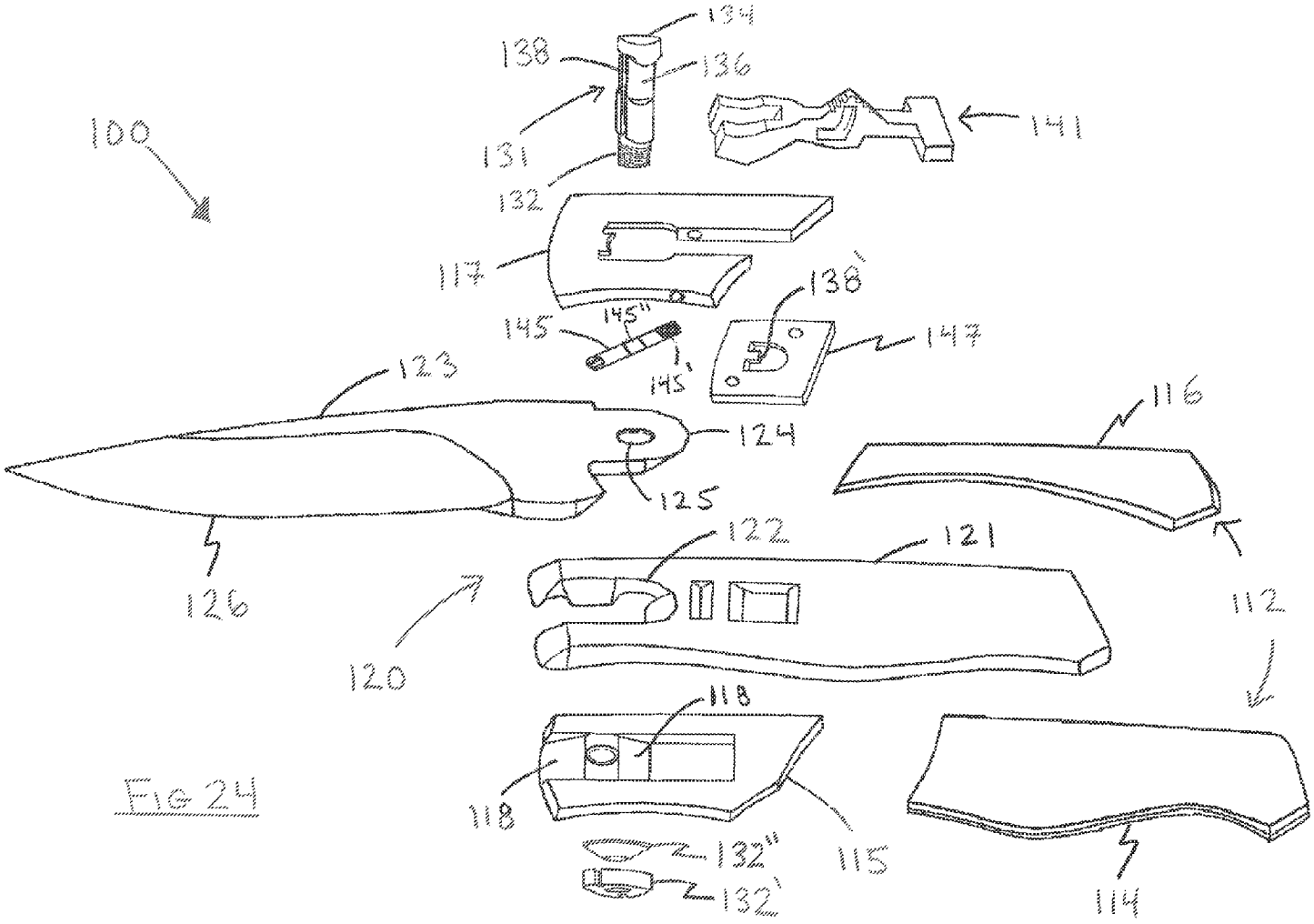
FIG. 24 is an exploded perspective view of the illustrative embodiment of the folding knife assembly of FIG. 21.

FIG. 24 is an exploded perspective view of the individual components comprising a folding knife assembly 100 in accordance with at least one embodiment of the present invention. As an initial matter, FIG. 24 illustrates a fixed blade portion 121 comprising a fixed interlock 122 which is configured and dimensioned to removably receive a movable interlock 124 of a movable blade portion 123 therein, similar to fixed interlock 22 and movable interlock 24 of previously disclosed embodiments of a folding knife assembly 10 in accordance with the present invention. FIG. 24 also illustrates a cam lock member 141 and a wear plate 147 which combine to partially define an "over-center" cam type locking assembly 140 in accordance with at least one embodiment of the present invention. FIG. 24 is further illustrative of a handle 112 comprising a fixed blade handle member 114 and a movable blade handle member 116, as well as a fixed blade bolster 115 and a movable blade bolster 117.

As before, the components of a folding knife assembly 100 in accordance with the present invention may be constructed from any of a variety of suitable materials including, but not limited to, metals and/or metals alloys and/or synthetic materials, such as previously indicated. As one example, the blade assembly 120, and more in particular, the fixed blade portion 121 and the movable blade portion 123, may be constructed from 440C stainless steel, 420 stainless steel, carbon steel alloy, etc. In one further example, all contacting surfaces of the fixed blade portion 121 and the movable blade portion 123 comprise a diamond like coating ("DLC"), and/or are heat treated to 58-60 RC, or equivalent. In yet one further embodiment, the components of the blade assembly 120 in accordance with the present invention are manufactured to tolerances of +/−0.001 inch.

With regard to the handle 112, and in particular, the fixed blade handle member 114 and the movable blade handle 116 comprise a fiberglass reinforced nylon ("FRN") material, for example, ZYTEL® FRN materials manufactured by DuPont may be utilized. Alternatively, a G-10 fiberglass resin laminate, or a high pressure laminate of linen, canvas, paper, fiberglass, carbon fiber or other fabric in a thermosetting plastic, such as MICARTA® manufactured by Norplex-Micarta Industrial Composites, NYLON®, etc., as disclosed above may be utilized for a components of handle 112. In one further embodiment, titanium and/or aluminum are utilized to form fixed blade handle member 114 and/or movable blade handle member 116. Similar to blade assembly 120 in at least one embodiment, the components of the handle 112 are manufactured to tolerances of +/−0.001 inch.

The fixed blade bolster 115 and the movable blade bolster 117, in at least one embodiment, are manufactured from 420 stainless steel having a DLC and/or are heat treated to 58-60 RC, or equivalent. The manufacturing tolerances for the fixed blade bolster fixed 115 and movable blade bolster 117 in accordance with one embodiment of the present invention are +/−0.0005 inch. In one further alternate embodiment, either or both the fixed blade bolster 115 and the movable blade bolster 117 may be coated with ZYTEL® FRN materials, a G-10 fiberglass resin laminate, MICARTA®, NYLON®, etc., as disclosed above. In one further embodiment, titanium and/or aluminum or other suitable composite material and/or steel alloy. Furthermore, a fixed blade handle member 114 and a fixed blade bolster 115 comprise a single unitary construction in accordance with at least one embodiment of the present invention.

Figure 25:
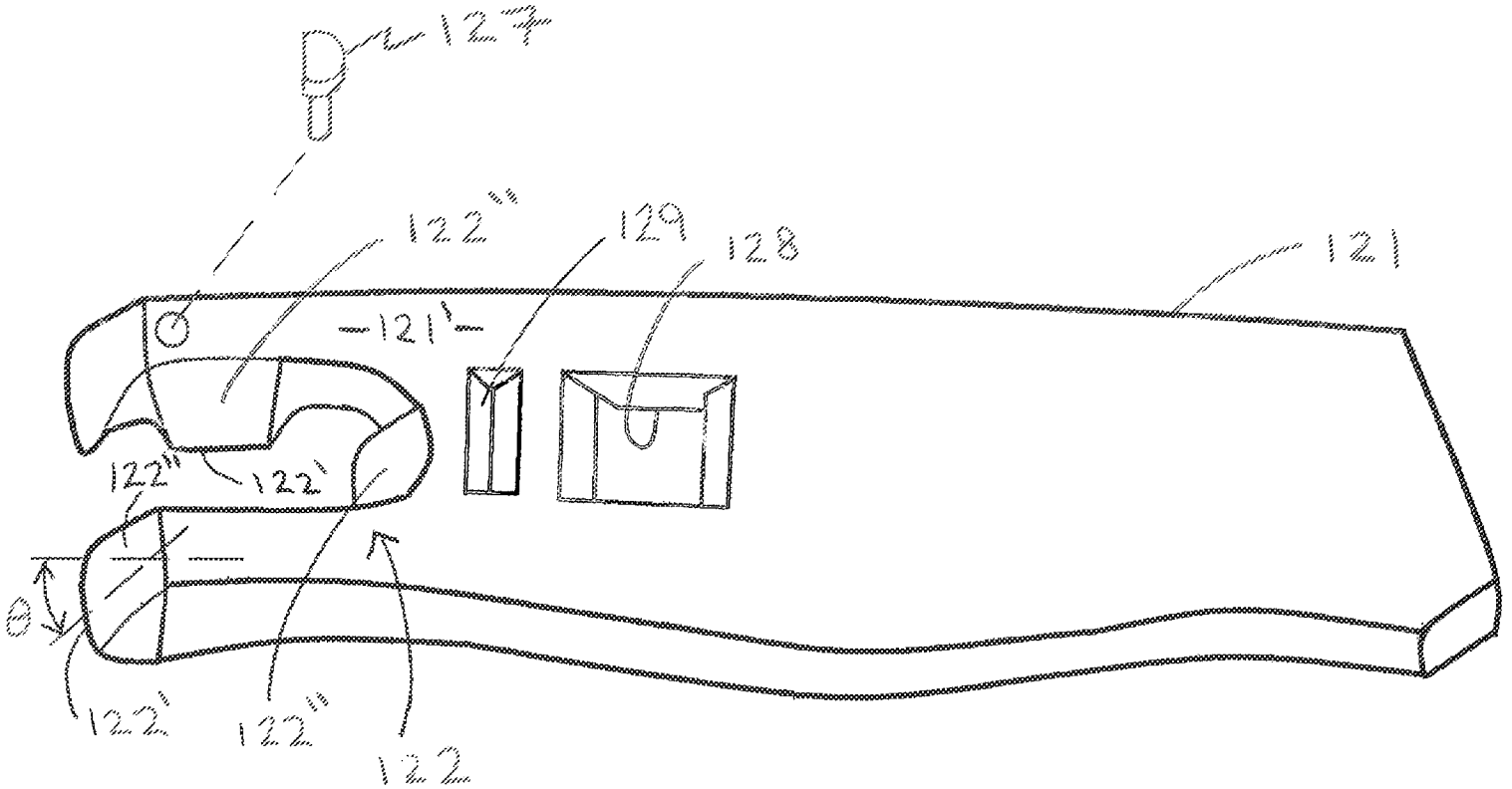
FIG. 25 is perspective view of an illustrative embodiment of a fixed blade portion in accordance with present invention.
Figure 26:
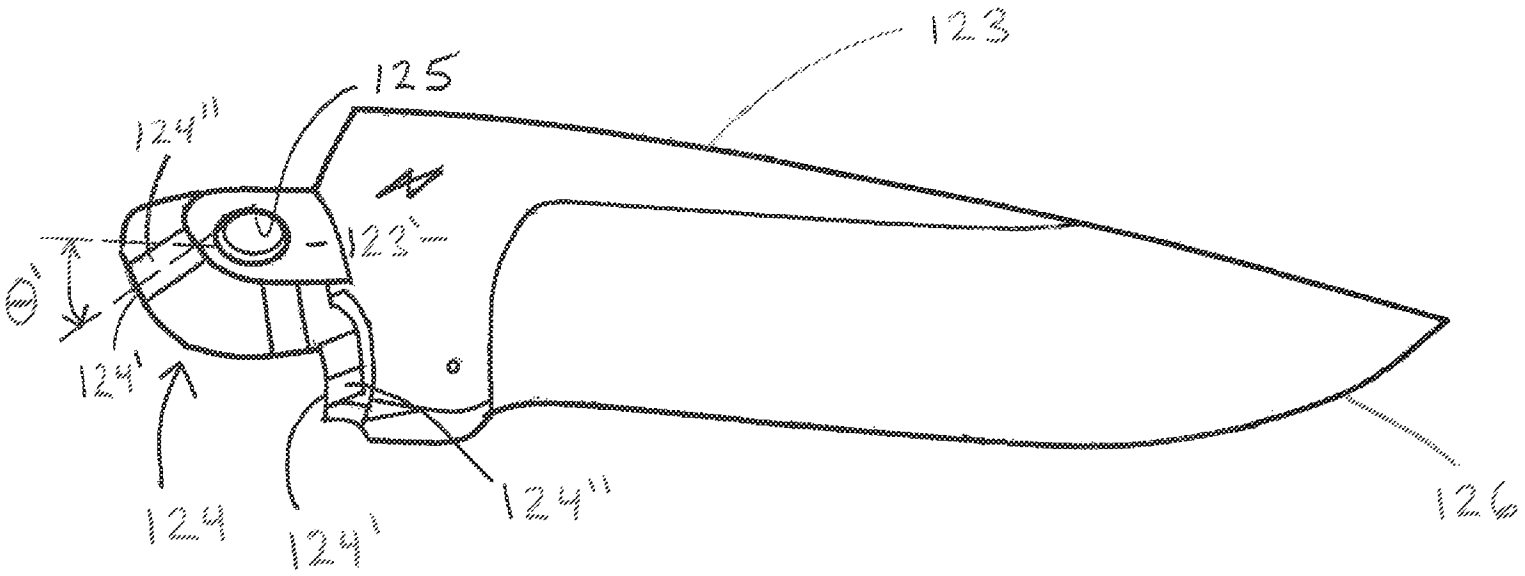
FIG. 26 is perspective view of an illustrative embodiment of a movable blade portion in accordance with present invention.

Looking next to FIGS. 25 and 26, the individual components of a blade assembly 120, namely, a fixed blade portion 121 and a movable blade portion 123 having a fixed interlock 122 and a movable interlock 124, respectively, are presented in greater detail. As before, the movable interlock 124 is structured and disposed to releasably engage the fixed interlock 122 in an interlocked orientation, while the blade assembly 120 is disposed in an open configuration, such that the fixed blade portion 121 and the movable blade portion 123 are disposed in a substantially planar arrangement relative to one another.

With particular reference to FIG. 25, a fixed blade portion 121 comprises a fixed interlock 122 at one end thereof, as previously disclosed. Of particular interest, and as shown in FIG. 25, a plurality of fixed tabs 122' are provided in fixed interlock 122, wherein each fixed tab 122' extends downwardly and outwardly from an inner surface 121' of fixed blade portion 121. As FIG. 25 further illustrates, by virtue of this downward and outward extension, each fixed tab 122' defines a fixed slope 122" associated therewith. In one embodiment, the fixed slope 122" is at least partially defined by an angle θ which is in a range of about 30 to 60 degrees formed between a plane through inner surface 121' and a plane through fixed slope 122", as shown in FIG. 25. In another embodiment, the fixed slope 122" is at least partially defined by an angle θ which is less than about 45 degrees formed between a plane through inner surface 121' and a plane through fixed slope 122", and in still one further embodiment, the fixed slope 122" is at least partially defined by an angle θ which is in a range of about 40 to 45 degrees.

FIG. 26, as previously noted, is illustrative of one embodiment of a movable blade portion 123 comprising a movable interlock 124 in accordance with the present invention. Further, the movable blade portion 123 comprises a pivot aperture 125 through a portion of the movable interlock 124 which is structured to operatively engage a portion of positioning assembly 130, as discussed hereinafter in more detail. FIG. 26 shows a plurality of sliding tabs 124' each of which correspond to a fixed tab 122' of a fixed blade portion 121. Similar to the fixed tabs 122' of the fixed blade portion 121, each of the plurality of sliding tabs 124' extend downwardly and outwardly from an inner face 123' of movable blade portion 123, thereby defining a corresponding sliding slope 124". In one embodiment, the sliding slope 124" is at least partially defined by an angle θ' which is in a range of about 30 to 60 degrees formed between a plane through inner face 123' and a plane through sliding slope 124", as shown in FIG. 26. In another embodiment, the sliding slope 124" is at least partially defined by an angle θ' which is greater than about 45 degrees formed between a plane through inner face 123' and a plane through sliding slope 124", and in still one further embodiment, the sliding slope 124" is at least partially defined by an angle θ' which is in a range of about 45 to 50 degrees.

As will be appreciated from FIGS. 25 and 26, the movable interlock 124 of movable blade portion 123, and in particular, the plurality of sliding tabs 124' are cooperatively constructed and configured to releasably engage fixed interlock 122, and once again, more in particular, a corresponding plurality of fixed tabs 122' therein, in an interlocked orientation, while the blade assembly 120 is disposed in an open configuration, such that the fixed blade portion 121 and the movable blade portion 123 are disposed in a substantially planar arrangement relative to one another. Thus, corresponding pairs of fixed tabs 122' and sliding tabs 124' are cooperatively structured and disposed such that the movable blade portion 123 releasably engages the fixed blade portion 121 when the movable interlock 124 is positioned in an operatively alignment with the fixed interlock 122.

It will further be appreciated that fixed slope 122" and sliding slope 124" of corresponding ones of the fixed tabs 122' and sliding tabs 124' comprise complementary angles having a sum of about 90 degrees. As one example, corresponding pairs of fixed tabs 122' and sliding tabs 124' may each comprise corresponding fixed slopes 122" and sliding slopes 124" each at least partially defined by angles θ, θ', respectively, of about 45 degrees. In one further embodiment, a fixed tab 122' comprises a fixed slope 122" at least partially defined by an angle θ of about 40 degree while a corresponding sliding tab 124' comprises a sliding slope 124" at least partially defined by an angle θ' of about 50 degrees.

A further advantage of the aforementioned configuration of corresponding ones of the fixed tabs 122' and sliding tabs 124', and more in particular, corresponding fixed slopes 122" and sliding slopes 124", is that the moveable interlock 124 of moveable blade portion 123 will easily rotate upward and outward out of fixed interlock 122 of fixed blade portion 121 while the locking assembly 140 is disposed in a released configuration. This allows the folding knife assembly 100 of the present invention to be closed using a single hand, as only minimal force is required to rotate the movable blade portion 123 from an open configuration to a closed configuration, by virtue of the dishing off effect between the corresponding fixed slopes 122" and sliding slopes 124".

As shown throughout the figures, fixed tabs 122' extend outwardly and into fixed interlock 122, and may be formed in this manner such as via wire electrical discharge machining, laser cutting, die cutting, or pressing, as previously disclosed. However, in at least one embodiment, fixed tabs 122' may be formed by etching the interior surfaces of fixed interlock 122. Similarly, sliding tabs 124' may be formed via etching the surfaces of movable interlock 124.

With further reference to FIG. 25, a stop 127 is mounted at one end of fixed blade portion 121 wherein the stop 127 is positioned and dimensioned to engage the movable blade portion 123 as is rotated into position prior to being locked into an open orientation. More in particular, the stop 127 engages the movable blade portion 123 and prevents further rotation of the movable blade portion 123 at the point where the movable interlock 124 is disposed in an operative alignment with the fixed interlock 122 of fixed blade portion 121.

Figure 27:
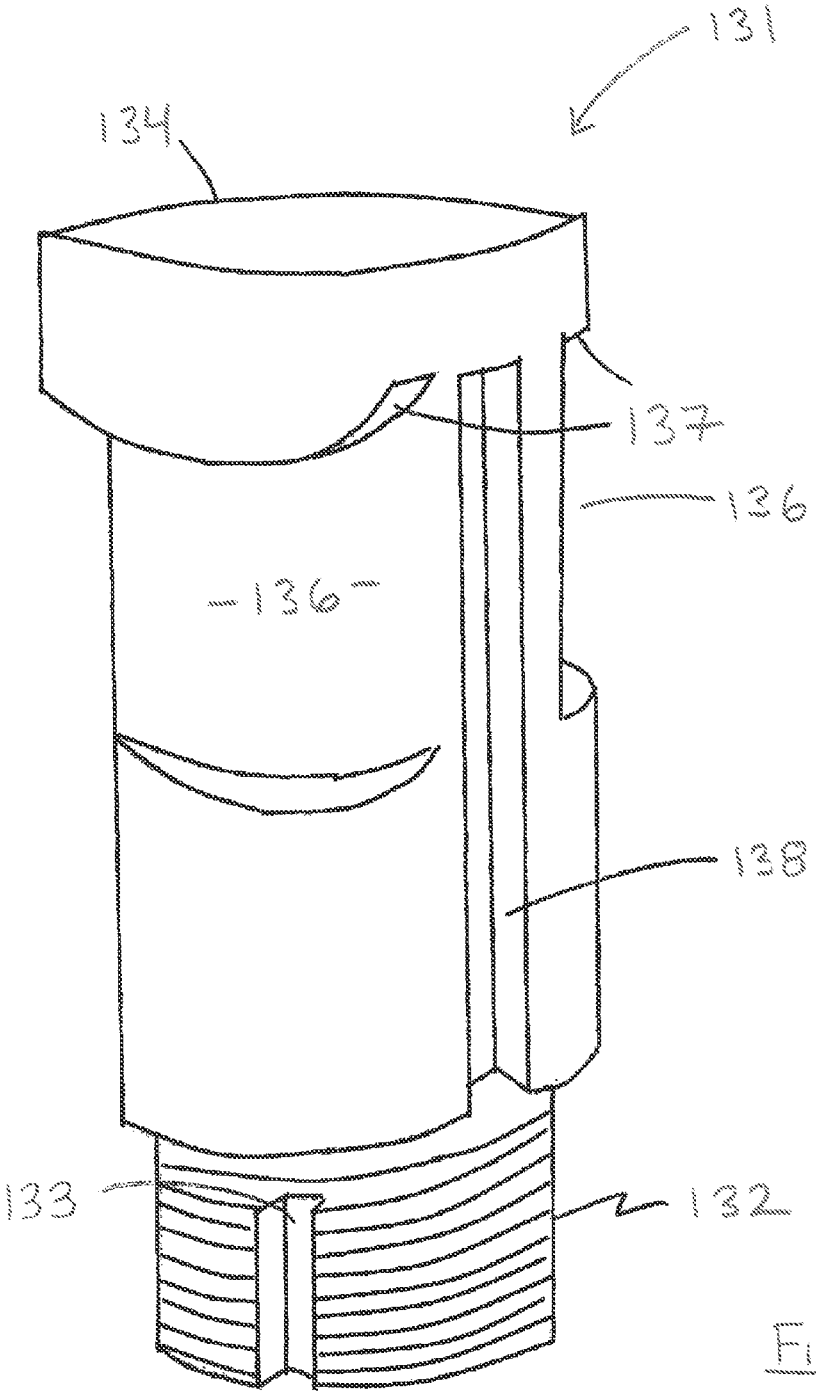
FIG. 27 is perspective view of an illustrative embodiment of a positioning pin in accordance with present invention.
Figure 28:
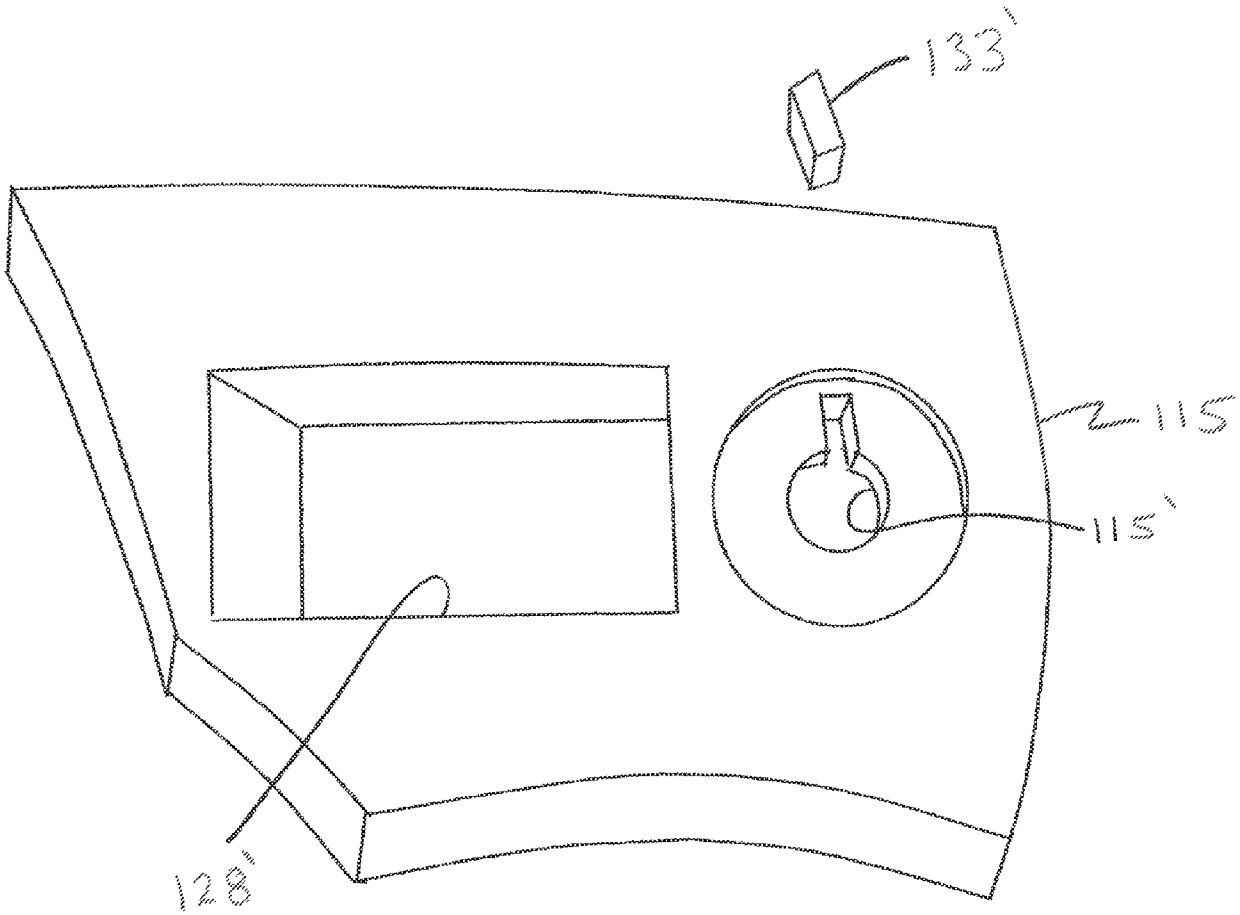
FIG. 28 is a perspective view of one embodiment of an outer surface of a fixed blade bolster in accordance with the present invention.

Looking next to FIG. 27, a perspective view, in detail, of a positioning pin 131 of the positioning assembly 130 is presented. As is readily seen from FIG. 27, the positioning pin 131 comprises a fixed end 132 structured to be fixedly secured to fixed blade handle member or bolster. In one embodiment, and as shown in FIG. 27, the closed end 132 comprises a threaded connection which is disposed through a corresponding mounting aperture 115' in fixed blade bolster 115, as shown in FIG. 28, and fastener 132' is attached thereto. In at least one embodiment, an adhesive, such as LOCTITE®, as manufactured and distributed by Henkel Corp., USA, is utilized to secure fastener 132' to the threads of fixed end 132 of positioning pin 131. In one further embodiment, a washer 132" is positioned around the fixed end 132 of the positioning pin 131 before the fastener 132' is secured thereto. In yet one further embodiment, a compressive washer, such as a conical spring or Belleville washer is utilized, as discussed below. In at least one embodiment, fastener 132' and washer 132" are constructed of at least 300 series stainless steel.

The fixed end 132 of positioning pin 131 further comprises an alignment notch 133, and a corresponding alignment tab 133' engages the alignment notch 133, once it is positioned through the mounting aperture 115', thereby assuring that positioning channel 136 and alignment channel 138 of positioning pin 131 are precisely oriented relative to the other components of the folding knife assembly 100 during assembly of the same.

The positioning pin 131 further comprises an elongated alignment channel 138, as noted above, which is disposed in alignment with an alignment pin 138' of a wear plate 147, to facilitate and maintain alignment between the positioning pin 131 and the movable blade bolster 117, to which the wear plate 147 is affixed, while the moveable blade bolster is positioned upwardly and downwardly along a length of the positioning pin 131 during operation of the folding knife assembly 100 in accordance with the present invention.

FIG. 27 is further illustrative of a positioning channel 136 along each side of positioning pin 131 and a positioning surface 137 corresponding to each, as in at least one embodiment of a positioning assembly 130 in accordance with the present invention. Each positioning channel 136 is structured and dimensioned to receive a portion of a locking assembly 140, while each positioning surface 137 is cooperatively structured and disposed to interact with a corresponding engagement surface 142 of a locking assembly 140. While corresponding positioning channels 136 and positioning surfaces 137 are illustrated throughout the figures, it is within the scope and intent of the present invention to utilize a single positioning channel 136 along either side of a positioning pin 131, and a single positioning surface 137 corresponding thereto. In yet one further embodiment, one or more positioning channel 136 is disposed through the positioning pin 131, with one or more corresponding positioning surface 137 disposed therein.

In at least one embodiment of the present invention, a positioning pin 131 is manufactured from 440C stainless steel, 420 stainless steel, or equivalent, having a DLC and/or are heat treated to 58-60 RC, or equivalent. At least one further embodiment of the present invention envisions manufacturing the positioning pin 131 from a 300 series stainless steel or equivalent. The manufacturing tolerances for a positioning pin 131 in accordance with one embodiment of the present invention are in the range of about +/−0.0005 inch.

As previously indicated, FIG. 28 is illustrative of one embodiment of a fixed blade bolster 115 in accordance with the present invention. As shown in FIG. 28, the fixed blade bolster 115 comprises a thumb lever channel 128', which is cooperatively dimensioned and positioned relative to thumb lever channel 128 through fixed blade portion 121, as shown in FIG. 25, so as to permit partial passage of a thumb lever 149 of the cam lock member 141 to pass partially therethrough while locking the blade assembly 120 in an open orientation.

With reference to FIG. 24, the fixed blade bolster 115 further comprises debris channels 118 to permit debris which may enter the interior of the folding knife assembly 100 of the present invention during use, to be discharged through the debris channels 118, such as, during movement of the movable blade portion 123 into and out of an open orientation. As shown in FIG. 24, in at least one embodiment, the debris channels 118 are sloped downwardly and outwardly from the interior of the folding knife assembly 100 to facilitate the transfer of debris from the interior to the exterior of the assembly 100. As will be further appreciated, and with reference to FIG. 23, the fixed tabs 122' of the fixed interlock 122 and the corresponding sliding tabs 124' of movable interlock 124 create a spacing between portions of the fixed interlock 122 and movable interlock 124, such that debris may pass therethrough and out via debris channel 118.

Figure 29:
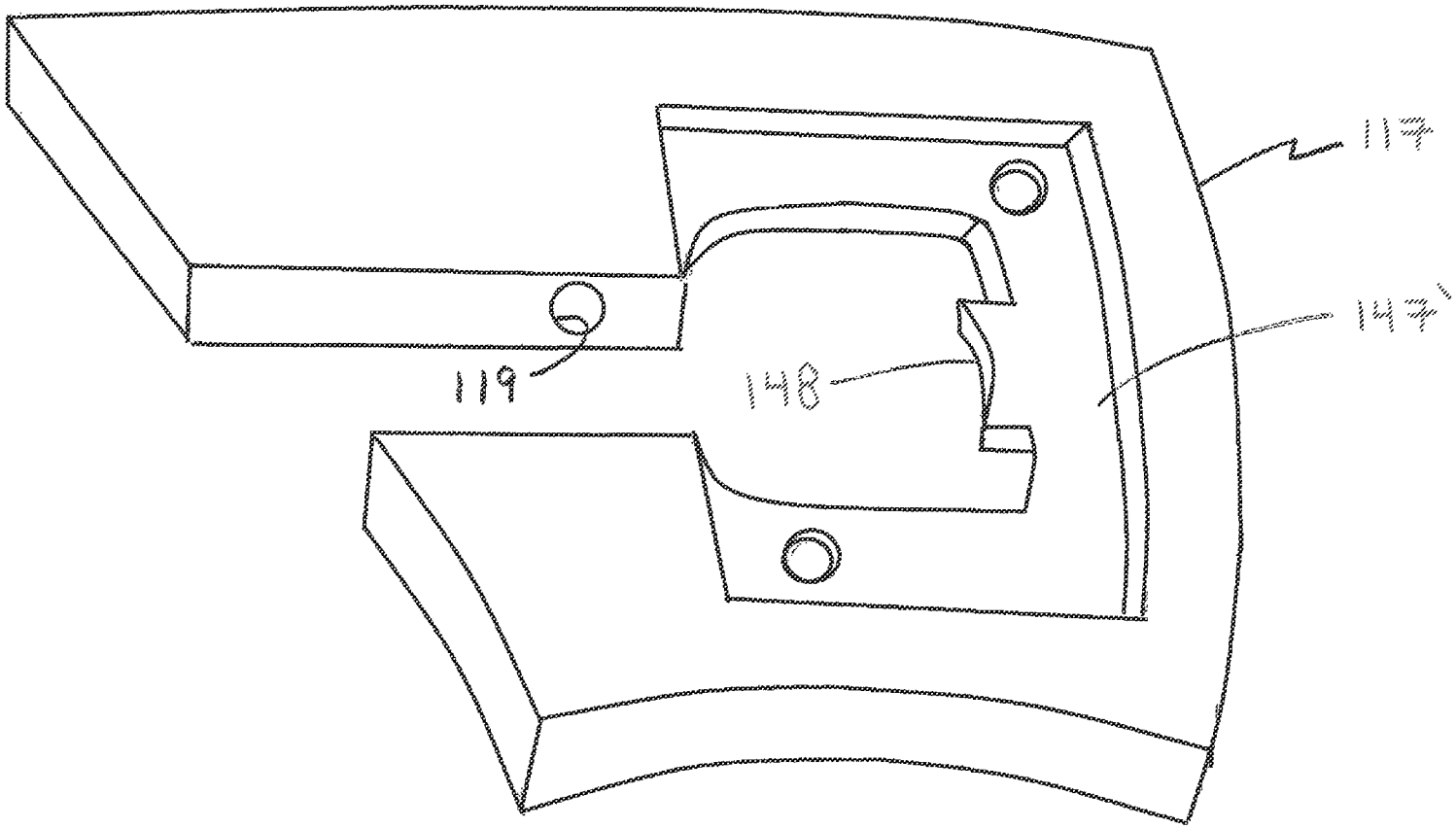
FIG. 29 is a perspective view of one embodiment of an outer surface of a movable blade bolster in accordance with the present invention.

FIG. 29 is illustrative of an outer surface of one embodiment of a movable blade bolster 117 in accordance with the present invention. The movable blade bolster 117 comprises a positioning pin guide 148 which comprises a concave inner facing surface which is configured to match the convex outer periphery of positioning pin 131. As such, the positioning pin guide 148 serves to maintain an axial alignment between the movable blade bolster 117 and the positioning pin 131, as the movable blade bolster 117 is positioned upwardly and downwardly along a length of positioning pin 131.

As also shown in FIG. 29, the movable blade bolster 117 comprises a wear plate seat 147' which is configures to receive a wear plate 147, such as is shown in FIG. 24. The wear plate 147 is structured for repeated contact with a biasing surface 143 of the cam lock member 141, as described in further detail below, and as such, in at least one embodiment, is manufactured from 440C stainless steel, or equivalent, having a DLC and/or is heat treated to 58-60 RC, to withstand the rigorous services demands. In one embodiment, screws are utilized to attach a wear plate 147 to a movable blade bolster 117 and, as described above with regard to positioning pin 131, an adhesive such as LOCTITE® is utilized to secure the threads of the screws to secure the wear plate 147 in position in wear plate seat 147'.

Figure 34:
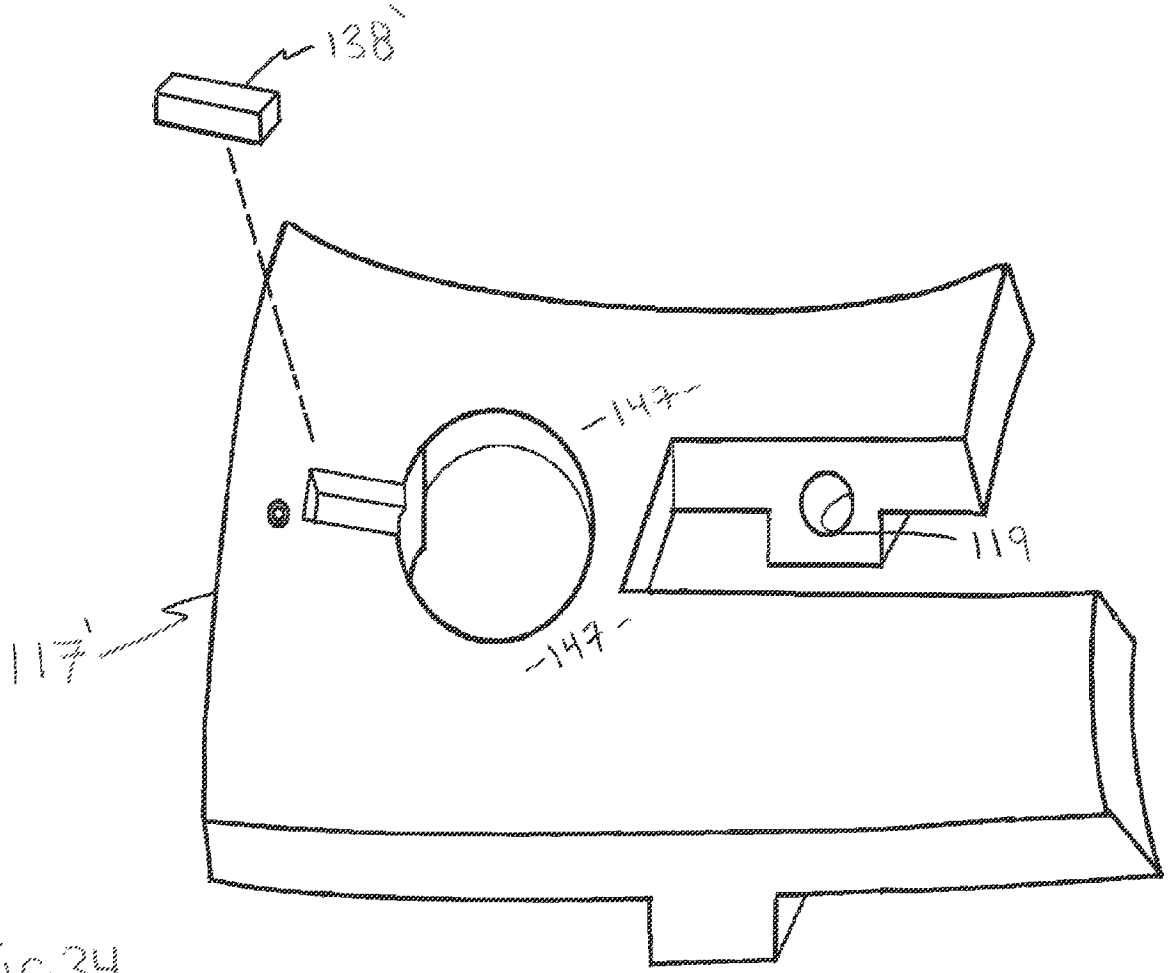
FIG. 34 is a perspective view illustrative of one alternate embodiment of an outer surface of a movable blade bolster in accordance with present invention.
Figure 35:
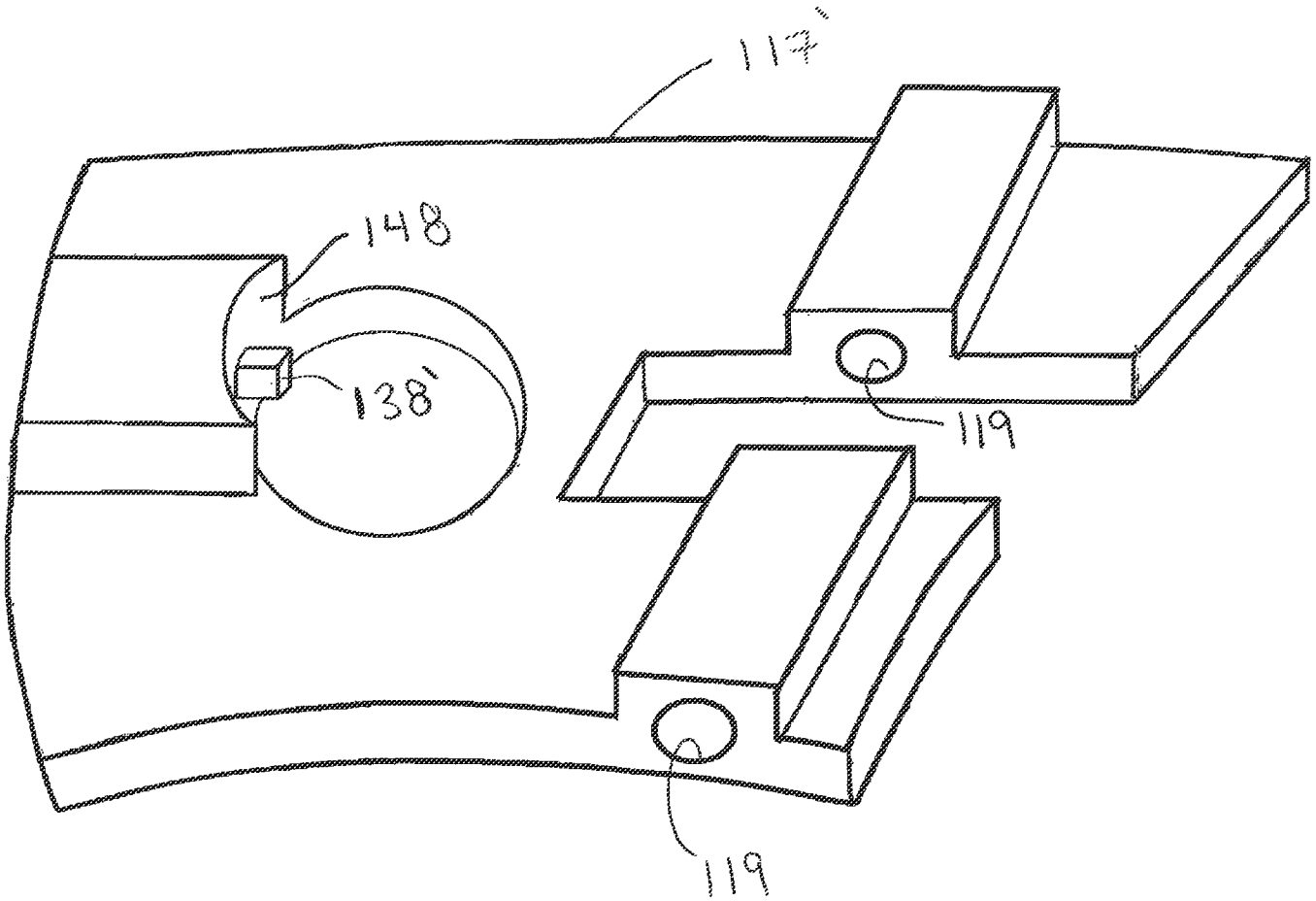
FIG. 35 is a perspective view illustrative of an inner surface of the movable blade bolster of FIG. 34.

In one further embodiment, such as is illustrated in FIGS. 34 and 35, a wear plate 147 is integrally constructed with a movable blade bolster 117'. In the embodiment of FIGS. 34 and 25, an alignment pin 138' is press fit into a corresponding slot, as shown in FIG. 34, and is secured therein, in at least one embodiment, via adhesive such as LOCTITE®. Of course, it will be understood and appreciated that alignment pin 138' may be secured to movable blade bolster 117' by other appropriate mechanical fastening means, such as, by way of example, via press fitting. FIG. 35 further illustrates pivot pin channels 119 disposed through at least a portion of each leg of movable blade bolster 117, the pivot pin channels 119 being positioned and dimensioned to receive a pivot pin 145 therein in an operative orientation.

The locking assembly 140 of the present folding knife assembly 100, as previously stated, comprises a cam type locking assembly. In at least one embodiment, the folding knife assembly 100 comprises an "over-center" cam type locking assembly actuated and released via a cam lock member 141, such as illustrated in FIG. 30, which is structured and disposed to be operable by a thumb of a user via thumb lever 149.

Figure 30:
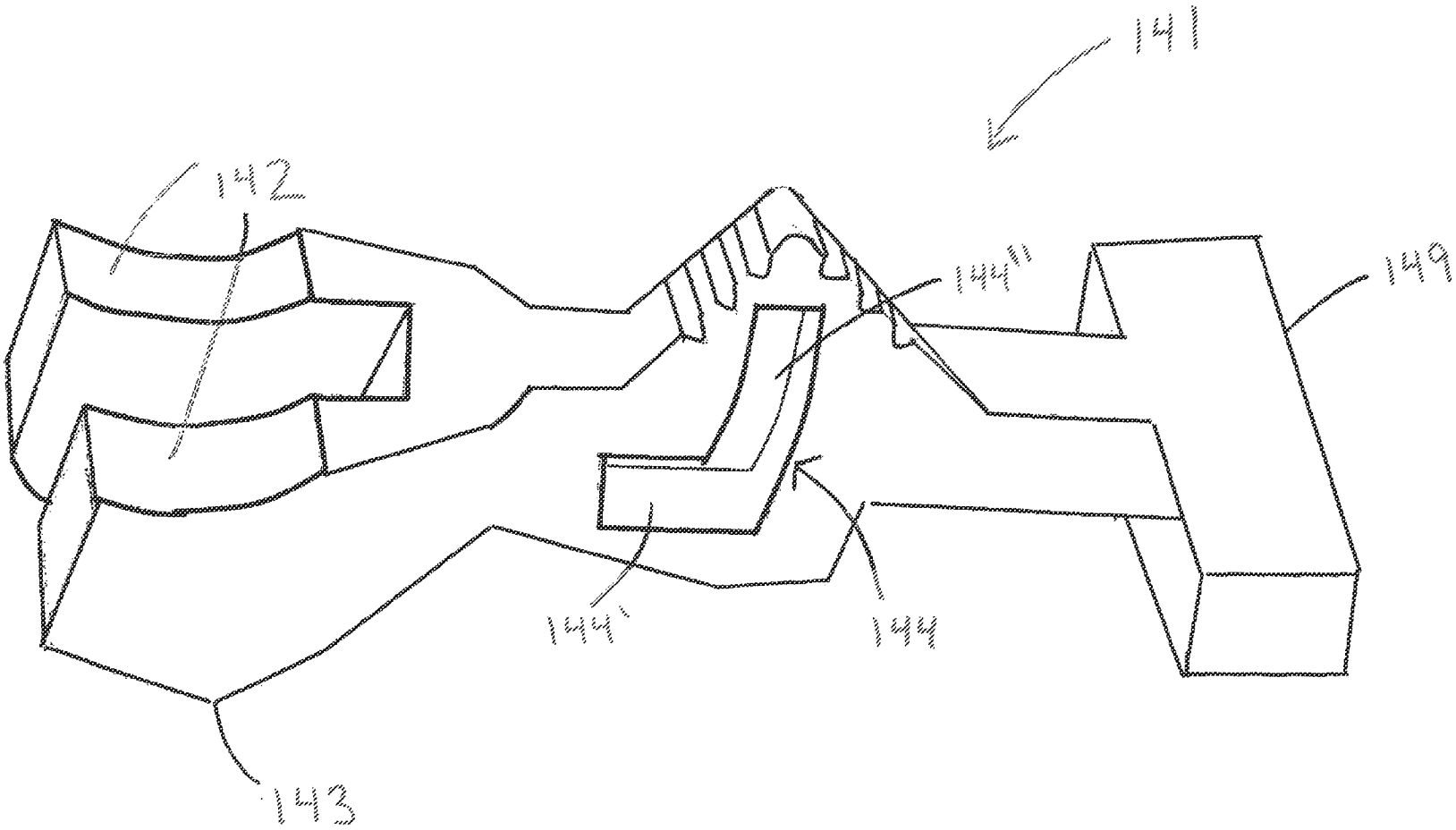
FIG. 30 is perspective view of an illustrative embodiment of a cam lock member in accordance with present invention.

As shown in FIG. 30, the cam lock member 141 comprises engagement surfaces 142 having convex configurations structured and dimensioned to correspond to concave positioning surfaces 137 of positioning pin 131, as shown in FIG. 27. While illustrated in the figures herein having corresponding convex and concave configurations, it will be appreciated that is within the scope and intent of the present invention for engagement surface(s) 142 and corresponding positioning surface(s) 137 to comprise alternate predetermined geometric configurations. Furthermore, while illustrated herein comprising corresponding pairs of engagement surfaces 142 and positioning surfaces 137, it is also within the scope and intent of the present invention to comprise a cam lock member 141 having a single engagement surface 142 being operative with a single positioning surface 137 of a positioning pin 131, as previously indicated.

Figure 31:
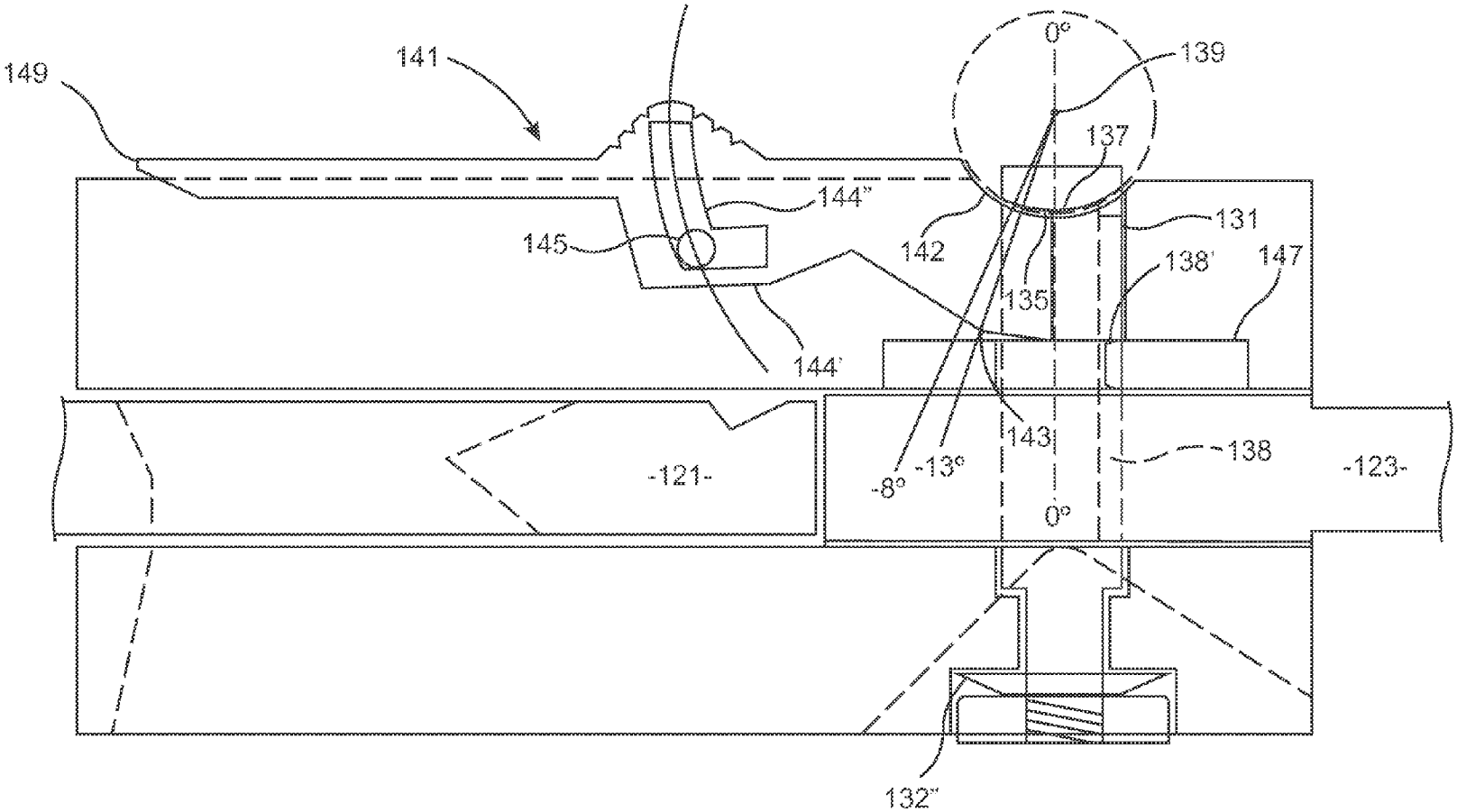
FIG. 31 is a partial cross-section of a folding knife assembly in accordance with the present invention illustrating a cam lock member in position to initiate a locking operation.
Figure 33:
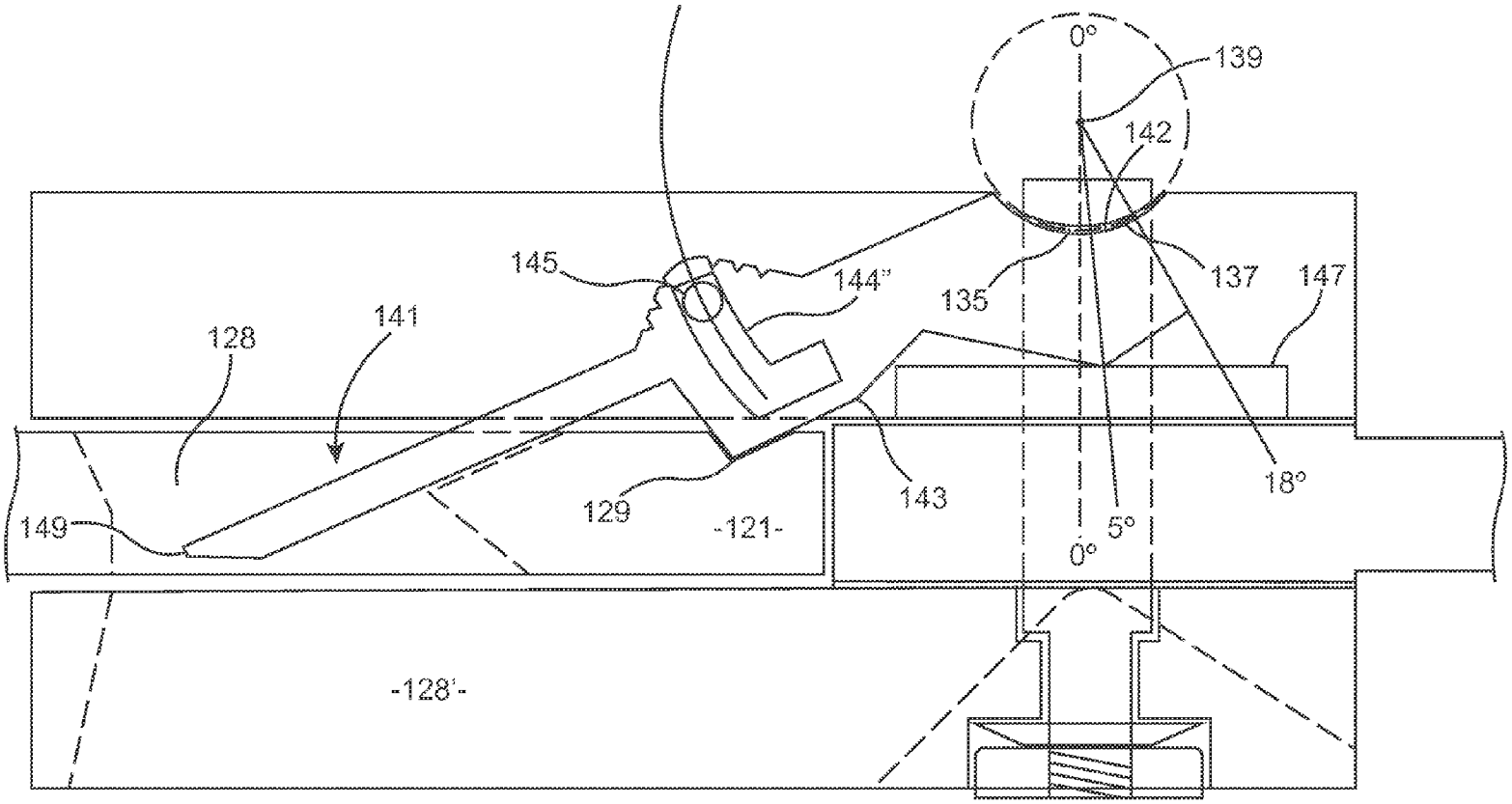
FIG. 33 is a partial cross-section of the folding knife assembly as shown in FIG. 31 illustrating the cam lock member in a fully locked orientation.

FIG. 30 further illustrates biasing surfaces 143 disposed opposite engagement surfaces 142 of cam lock member 141. The biasing surfaces 143 are operable against wear plate 147 when the engagement surfaces 142 are contacting positioning surfaces 137 of the positioning pin 131, and the cam lock member 141 is being positioned between an unlocked orientation, as shown in FIG. 31, and a locked orientation, as shown in FIG. 33. The cam lock member 141 further comprises a guide channel 144 to facilitate movement of the cam lock member 141 between unlocked and locked orientations. In at least one embodiment, such as is illustrated in FIG. 30, the guide channel 144 comprises a composite configuration having a release channel 144' which is disposed in a generally parallel orientation relative to blade assembly 120, and a locking channel 144" being disposed in a generally perpendicular orientation relative to blade assembly 120.

Figure 32:
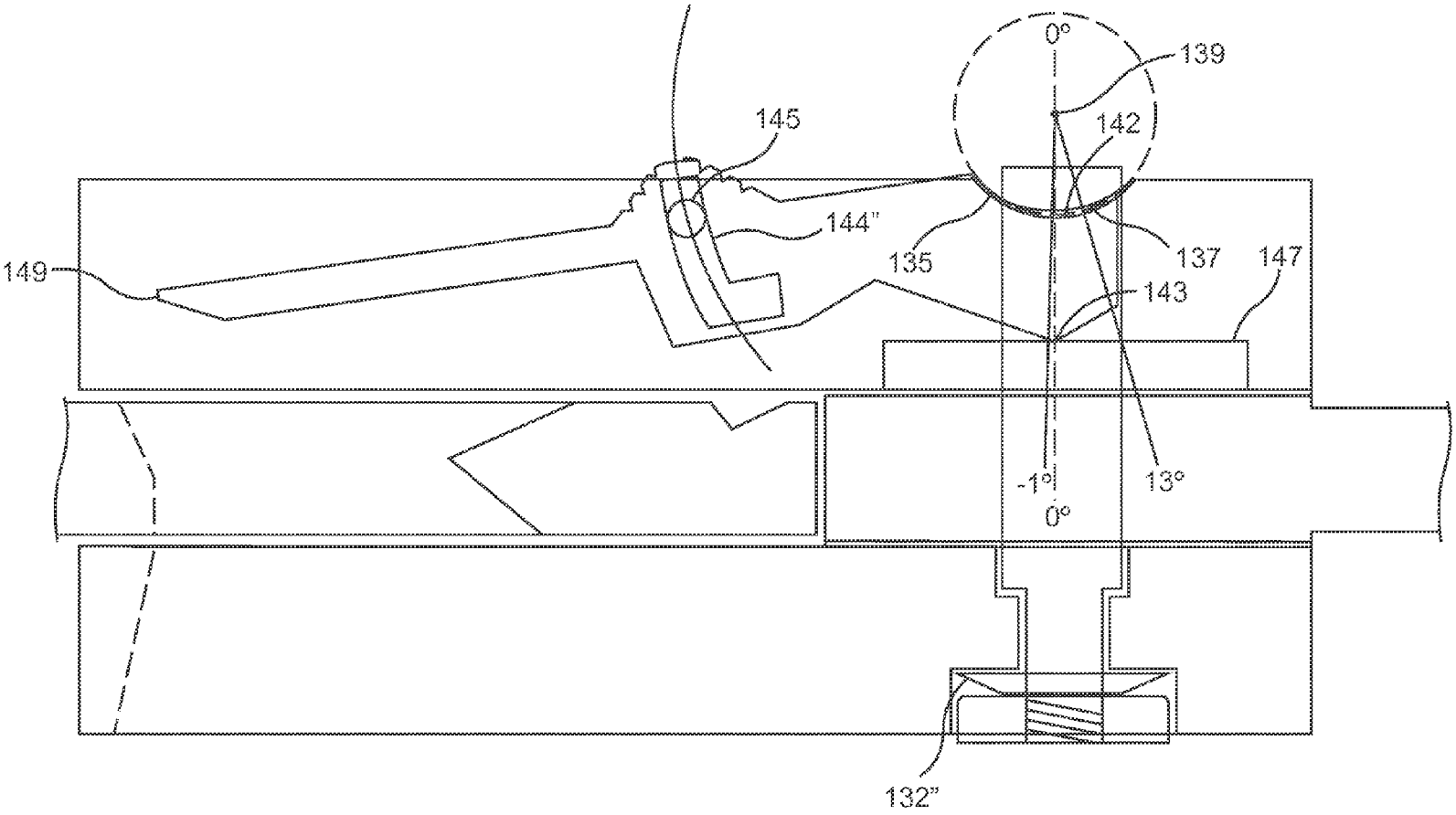
FIG. 32 is a partial cross-section of the folding knife assembly as shown in FIG. 31 illustrating the cam lock member in a maximum over-center orientation.

As shown in FIGS. 31 through 33, a pivot pin 145 is positioned through guide channel 144 of the cam lock member 141, thereby moveably securing cam lock member 141 to the movable blade bolster 117. As noted above, the pivot pin 148 is positioned through pivot pin channels 119 in the movable blade bolter 117, and the pivot pin 145 is secured thereto via connector 145', as shown in FIG. 24, via LOCTITE®, or other mechanical fastening means. FIG. 24 further illustrates a notch 145" near the center of pivot pin 145, the notch 145" comprising a predetermined geometry dimensioned and configured to engage the inner surface of guide channel 144, and more in particular, release channel 144", when the cam lock member 141 is disposed in an unlocked orientations, so as to limit unwanted movement of the cam lock member 141 about pivot pin 145.

FIGS. 31 through 33 are illustrative of the operation of an "over-center" cam type locking assembly actuated and released via a cam lock member 141, in accordance with one embodiment of the present invention. Looking first to FIG. 31, the cam lock member 141 is positioned at the initiation of a locking operation. As shown in FIG. 31, the cam lock member 141 is positioned forward towards positioning pin 131 to the full extent permitted by pivot pin 145 in release channel 144'. In this position, the engagement surfaces 142 of cam lock member 141 are disposed immediately adjacent and just abutting corresponding positioning surfaces 137 of the positioning pin 131. FIGS. 31 through 33 further illustrate an engagement interface 135 disposed along the interface between the engagement surfaces 142 of cam lock member 141 and corresponding positioning surfaces 137 of the positioning pin 131. FIG. 31 also shows fixed blade portion 121 and movable blade portion 123 disposed in substantially planar orientation relative to one another, just prior to being locked in an open orientation. Furthermore, in the pre-locked orientation of FIG. 31, the washer 132" is disposed in a relaxed, fully extended state, as will become more apparent with reference to FIG. 32.

FIG. 31 further illustrates that when the cam lock member 141 is disposed in this pre-locked orientation, the biasing surface 143 is offset by an angle of about 13 degrees from an axis through a length of the positioning pin 131 and a pivot axis 139, which is offset and exists above and along the axis through the length of positioning pin 131. The pivot axis 139 is defined as the center of a circle circumscribed along the convex arcuate positioning surface 137 of positioning pin 131, as illustrated in FIGS. 31 through 33. It is important to note that by virtue of an offset pivot axis 139, the actual distance which a thumb lever 149 and biasing surface 143 of a cam lock member 141 must travel during rotation through a given angle of rotation is significantly decreased, thereby resulting in a substantially flush mount cam lock member 141. In accordance with at least one embodiment of the present invention, a thumb lever 149 having a length of about 1.2 inches from biased surface 143 only travels a distance of about 0.02 inches per degree of rotation about an offset pivot axis 139. As such, in order to rotate through a full 18 degree range of rotation, which is all this is required in accordance with at least one embodiment of the present invention, the thumb lever 149 only travels an actual distance of about 0.4 inches. Once again, it is noteworthy that by providing an offset pivot axis 139, a substantially flush mount cam lock member 141 may be utilized, as the distance required for travel of the thumb lever 149 in order to fully actuate the cam lock member 141 is minimized, while the torque required to operate the cam lock member 141 remains well within the range of operation by a thumb of an average person.

Turning next to FIG. 32, the thumb lever 149 has been depressed sufficiently to rotate the biasing surface 143 approximately 13 degrees relative to the offset pivot axis 139, such that the cam lock member 141 is disposed in a maximum over center portion, thereby applying maximum force against wear plate 147. This is appreciated with reference to washer 132", which is now disposed in a fully compressed state. As noted above, in at least one embodiment, washer 132" comprises a conical spring or Belleville type washer. In one further embodiment, the Belleville washer 132" is rated for about 80 pounds of torque to deform from a fully relaxed state to a fully compressed state, such as is shown in FIG. 32. In one further embodiment of the present invention, the wear plate 147 may be constructed of a material having a sufficient modulus of elasticity which permits the wear plate 147 to reversibly deform a sufficient distance upon contact with biasing surface 143, such that washer 132" is not required. FIG. 32 further illustrates the engagement surface 142 is rotatably positionable along positioning surface 137 through pivot axis 139.

FIG. 33 is illustrative of an embodiment of the locking assembly 140 comprising a cam lock member 141 disposed in a fully locked orientation. As shown in FIG. 33, the thumb lever 149 has been fully depressed into thumb lever channel 128 of the fixed blade portion 121, and the cam lock member 141 has come to rest in cam lock seat 129. Further, the pivot pin 145 is disposed adjacent the closed end of locking channel 144", such that no further rotation of the cam lock member 141 about offset axis 139 is possible. Once again, the fixed blade portion 121 and movable blade portion 123 are now disposed in a substantially planar configuration, such that the fixed blade portion 121 and the movable blade portion 123 of the blade assembly 120 form a quasi-single blade element which will exhibit improved strength and handling characteristics comparable to those of a single blade knife having part of the blade; i.e., the blade tang, fixedly secured in a handle member.

In order to release the cam lock member 141, and thus blade assembly 120, from the locked orientation shown in FIG. 33, the user simply applies a slight inward force on thumb lever 149 through thumb lever channel 128' until the biasing surface 143 is rotated about 6 degrees from its fully locked position such that the biased surface 143 is now "under-center", at which point, a slight closing force on the movable blade portion 123 will cause the cam lock member 141 to retract to a fully unlocked orientation, with pivot pin 145 being disposed adjacent the closed end of release channel 144'. It is noteworthy that, in at least one embodiment of the present invention, the movement of biased surface 143 about 6 degrees is achieved by moving thumb lever 149 less than about 0.12 inches, once again, providing a substantially flush mount locking assembly 140.

FIGS. 36 through 51 present still another illustrative embodiment of a folding knife assembly, generally as shown as 200 throughout these figures, in accordance with the present invention. More in particular, and similar to the previously disclosed embodiments, the present embodiment of a folding knife assembly 200 includes a handle 212 having a fixed handle member 214 and a movable handle member 216 which are cooperatively structured to substantially overlie a blade system 220, while the blade system 220 is disposed in a closed configuration, such as is illustrated best in FIG. 38.

As before, it will be appreciated that any of a number of materials of construction may be selected that will be suitable for a handle 212, or portions thereof, in accordance with the present invention. A few examples include, but are in no manner limited to, a G-10 fiberglass resin laminate, or a high pressure laminates of linen, canvas, paper, fiberglass, carbon fiber or other fabric in a thermosetting plastic, for example, MICARTA® manufactured by Norplex-Micarta Industrial Composites, NYLON®, fiberglass reinforced nylon (FRN), such as ZYTEL® manufactured by DuPont, or other synthetic materials exhibiting similar strength, handling, and manufacturability characteristics. It is well within the scope and intent of the present invention to incorporate one or more additional or alternative materials of construction into a handle 212 or portions thereof including, but not limited to, titanium, and/or aluminum. In at least one embodiment, the components of the handle 212 are manufactured to tolerances of +/−0.005 inch.

Figure 39:
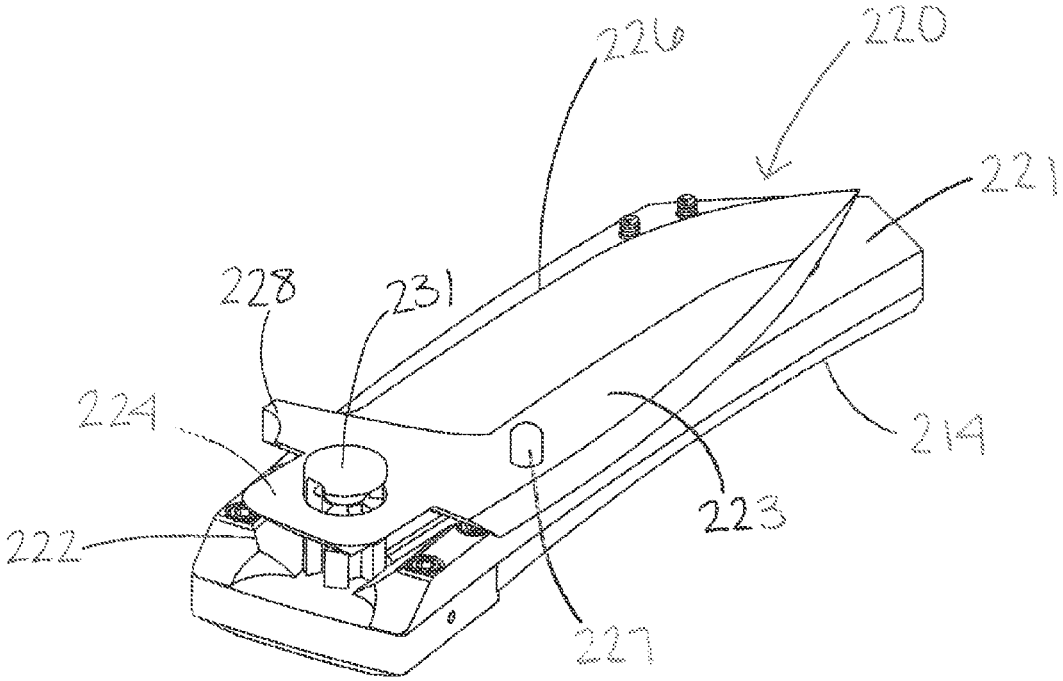
FIG. 39 is a partial cutaway perspective view of the illustrative embodiment of FIG. 38 wherein a movable handle member is removed to illustrate a blade system disposed in a closed configuration.
Figure 40:
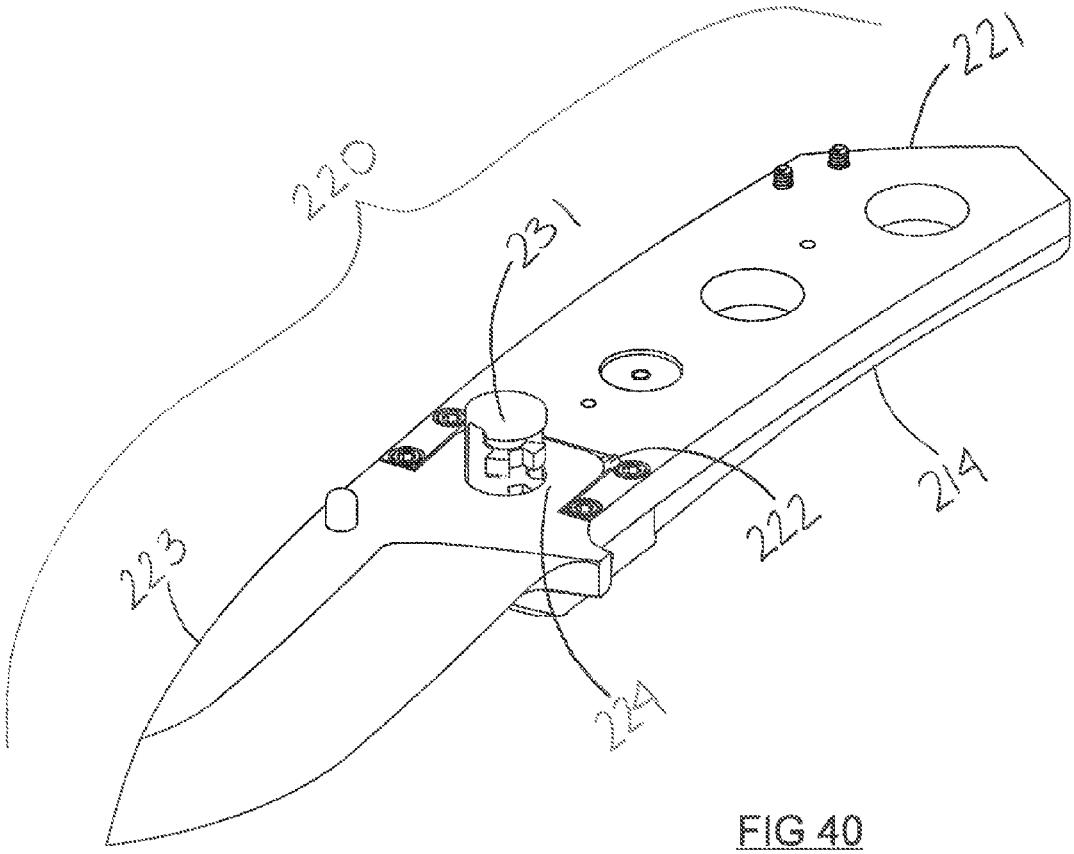
FIG. 40 is a partial cutaway perspective view of the illustrative embodiment of FIG. 39 wherein the blade system is disposed in an open configuration.
Figure 41:
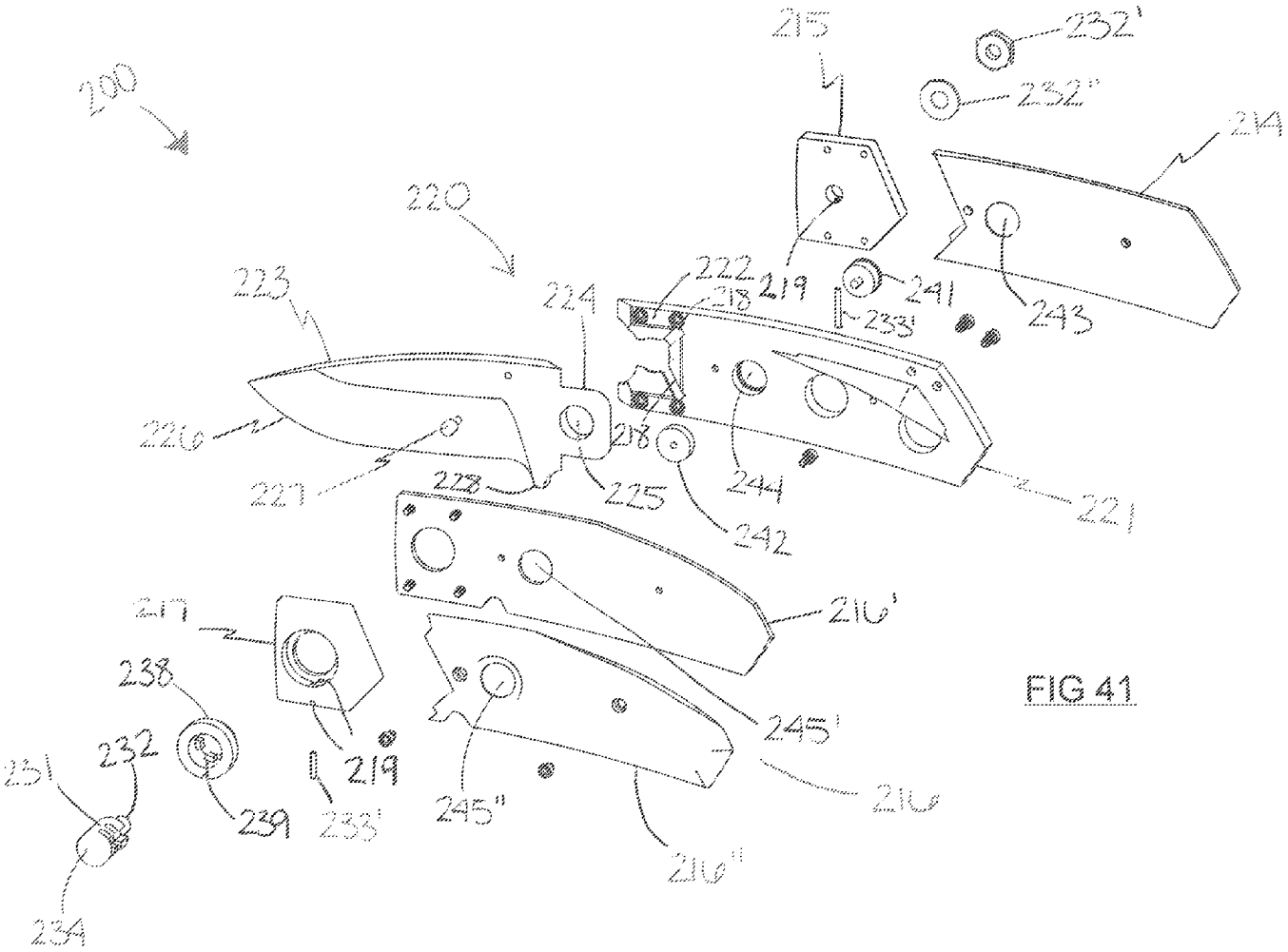
FIG. 41 is an exploded perspective view of the illustrative embodiment of the folding knife assembly of FIGS. 36 through 40.

As noted above, the handle 212 of the present folding knife assembly 200 is structured to house a blade system 220. The blade system 220, common to each embodiment of the folding knife assembly 200 in accordance with the present invention, comprises a fixed blade portion 221 and a moveable blade portion 223, as best illustrated in FIGS. 39 through 41. As illustrated in the figures, the fixed blade portion 221 includes a fixed interlock 222 which comprises a cut-out of one end of the fixed blade portion 221. As noted above, the blade system 220 further comprises a movable blade portion 223, wherein the movable blade portion 223 comprises a movable interlock 224, again, as shown best in FIGS. 39 through 41.

Figure 36:
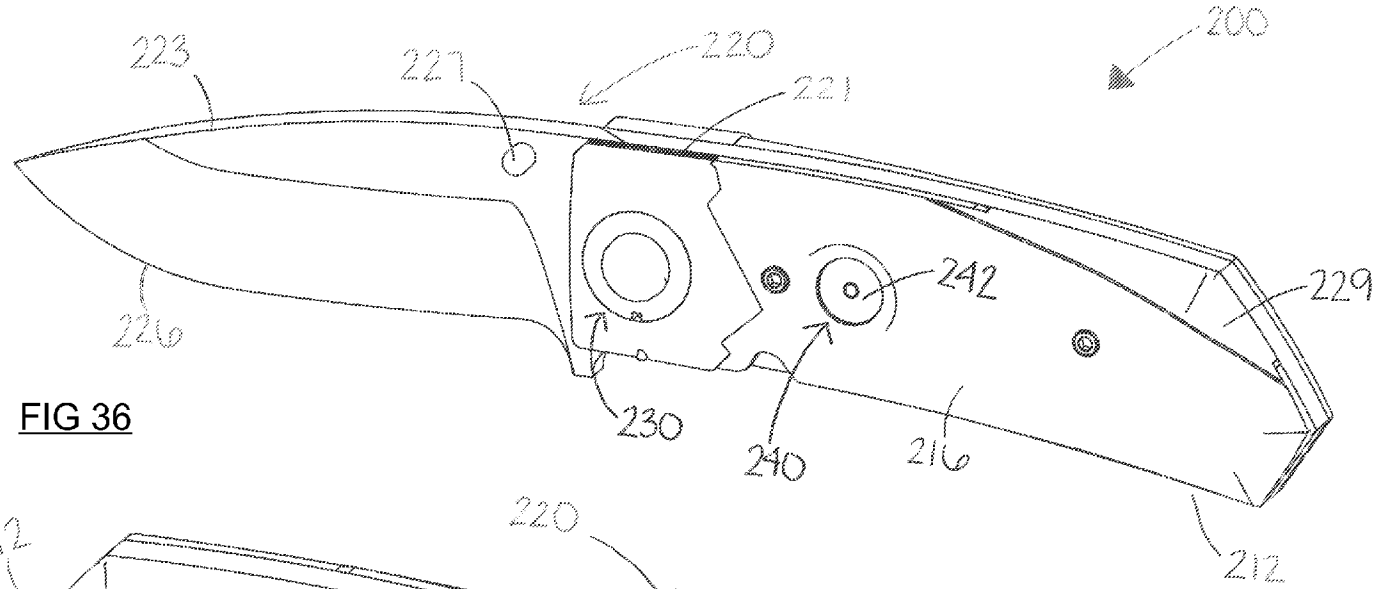
FIG. 36 is a perspective view of one side of still another illustrative embodiment of a folding knife assembly in accordance with the present invention disposed in an open configuration.
Figure 37:
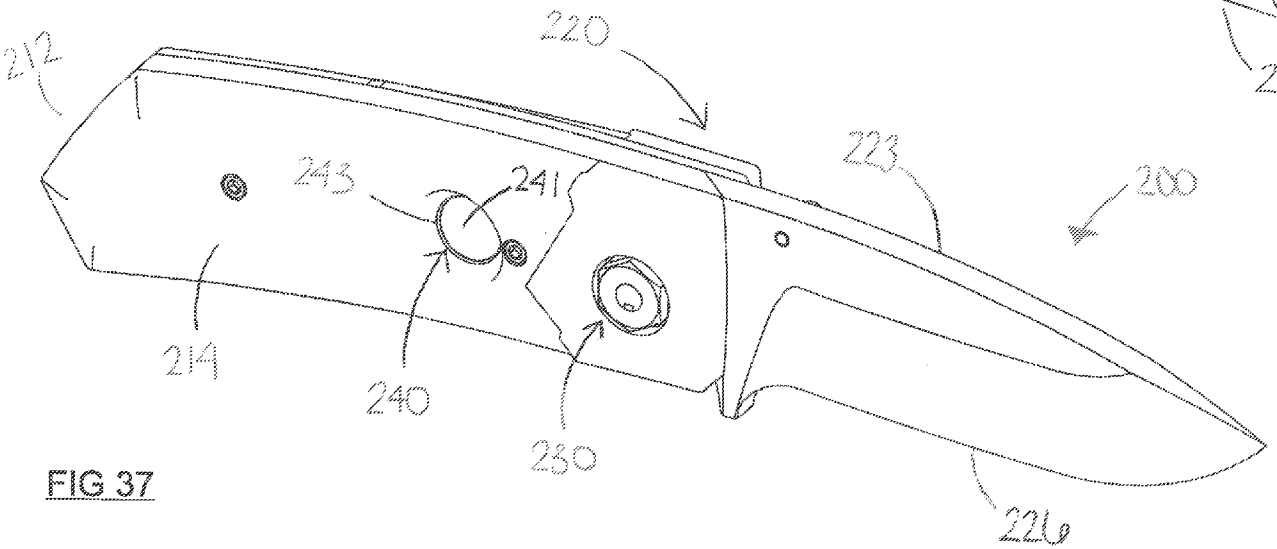
FIG. 37 is a perspective view of the opposite side of the illustrative embodiment of the folding knife assembly of FIG. 36.

Looking further to FIG. 40, which is a partial cutaway view illustrative of one embodiment of a folding knife assembly 200 in accordance with the present invention, a movable interlock 224 of movable blade portion 223 is disposed in an interlocked orientation with a fixed interlock 222 of a fixed blade portion 221. As demonstrated best in the illustrative embodiment of FIG. 40, while the blade system 220 is disposed in an open configuration, the fixed blade portion 221 and the movable blade portion 223 are disposed in an interlocked orientation with one another so as to create a quasi-single blade element, part of which, i.e., the fixed blade portion 221, remains closed within the handle 212, and part of which, i.e., the movable blade portion 223, remains exposed in an open configuration from the handle 212, to permit use of the same, as shown by way of example in the illustrative embodiment of FIG. 36. FIG. 36 further illustrates one embodiment of a cutting edge seat 229 in accordance with the present invention. Looking again to FIG. 40, while disposed in an open configuration, fixed blade portion 221 and movable blade portion 223 are disposed in substantially planar arrangement relative to one another. More in particular, this planar arrangement results in combining the fixed blade portion 221 and the movable blade portion 223 of the blade system 220 to form a quasi-single blade element which will exhibit improved strength and handling characteristics comparable to those of a single blade knife having part of the blade, i.e., the blade tang, fixedly secured in a handle member.

It is within the scope and intent of the present invention to initially forge a blade system 220 as a single unitary blade, and then separate the single unitary blade into its separate components, i.e., fixed blade portion 221 and moveable blade portion 223, by any of a number of techniques including, but not limited to, wire electrical discharge machining, laser cutting, die cutting, fine blanking individual components followed by CNC finishing, forging individual components followed by CNC finishing, or pressing the single unitary blade to form fixed interlock 222 and corresponding moveable interlock 224 thereon, respectively. This procedure will not only simplify the manufacturing process, but will insure structural compatibility of the fixed blade portion 221 and the movable blade portion 223 of each blade system 220 in accordance with the present invention.

As before, the components of a blade system 220 in accordance with the present invention may be constructed from any of a variety of suitable materials including, but not limited to, metals and/or metals alloys and/or synthetic materials, such as previously indicated. As one example, the blade system 220, and more in particular, the fixed blade portion 221 and the movable blade portion 223, may be constructed from 440C stainless steel, 420 stainless steel, carbon steel alloy, etc. In one further example, all contacting surfaces of the fixed blade portion 221 and the movable blade portion 223 comprise a diamond like coating ("DLC"), and/or are heat treated to 58-60 RC, or equivalent. In yet one further embodiment, the components of the blade system 220 in accordance with the present invention are manufactured to tolerances of +/−0.001 inch.

Figure 38:
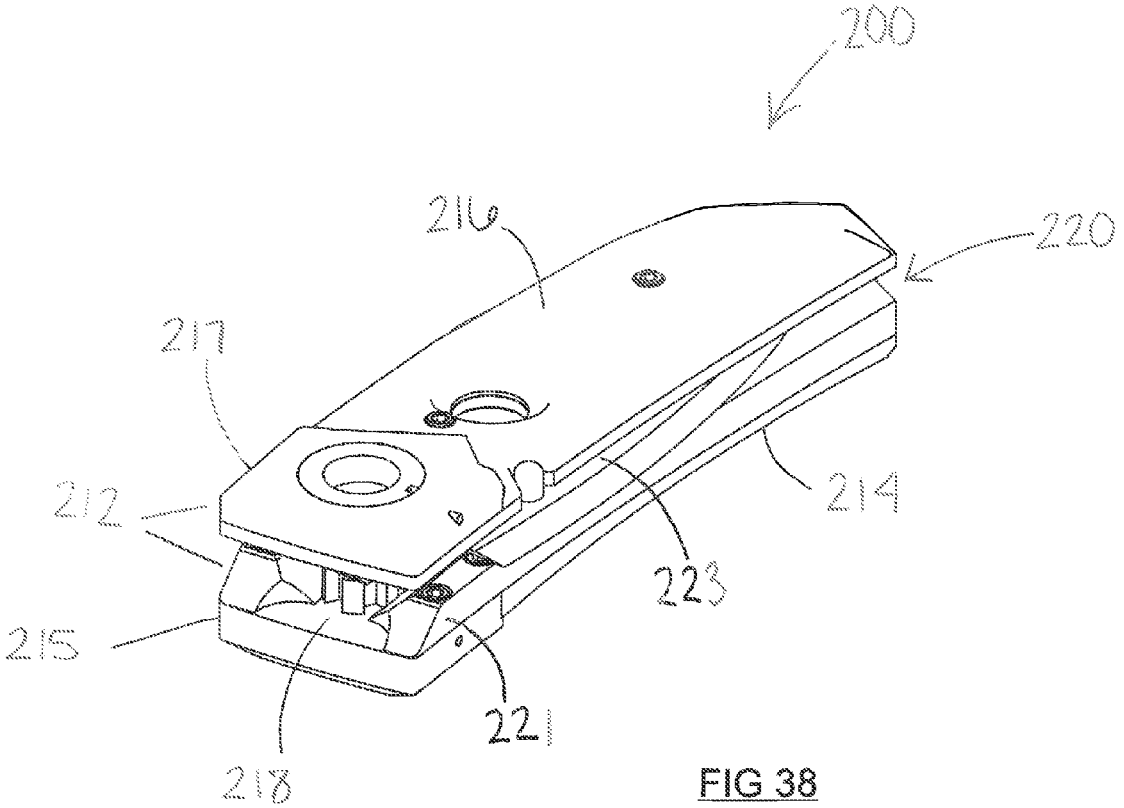
FIG. 38 is a perspective view of the illustrative embodiment of the folding knife assembly of FIGS. 36 and 37 disposed in a closed configuration.

FIGS. 38 and 39 are illustrative of one embodiment of a blade system 220 in a closed configuration, wherein the fixed blade portion 221 and the movable blade portion 223 are disposed in a substantially overlying arrangement with one another, as shown best in the illustrative embodiment of FIG. 39. It is noteworthy from FIGS. 38 and 39 that the fixed blade portion 221 and movable blade portion 223 are not disposed in a substantially planar arrangement with one another while the blade system 220 is disposed in a closed configuration, rather, the fixed blade portion 221 and movable blade portion 223 are disposed in offset opposite planes from one another.

As illustrated via FIGS. 38 and 39, the moveable blade portion 223 is configured such that the cutting edge 226 is substantially concealed by the handle 212 when the blade system 220 is disposed in a closed configuration. However, in at least one embodiment, the movable blade portion 223 may comprise an extended length such that at least a section of the cutting edge 226 of the movable blade portion 223 remains exposed and useable even while the blade system 220 is disposed in the closed configuration. Of course, in such an embodiment, a sheath or other appropriate storage means may be employed to permit safe transport and storage of the folding knife assembly 200.

In at least one embodiment, the blade system 220 comprises a self-cleaning construction in order to minimize and/or prevent dirt and debris from accumulating which may impede movement of the blade system 220 between open and closed configurations. The self-cleaning construction may comprise a coating on the surface of the movable blade portion 223 and/or along the surface of fixed blade portion 221, to reduce friction on the corresponding surface or surfaces. In at least one embodiment, the movable blade portion 223 and/or the fixed blade portion 221 may be polished to a Grade A mirror finish or Grade B mirror finish.

When a coating is employed, it will comprise substantial friction reduction properties so as to prevent the accumulation or adherence of dirt and/or debris to either movable blade portion 223 or fixed blade portion 221, which could impede the opening and closing of the folding knife assembly 200. The coating selected must be compatible with the material of construction of the blade system 220 itself which may comprise 440C stainless steel, 420 stainless steel, S7 tool steel, A2 tool steel, carbon steel alloy, or other such materials exhibiting similar strength and hardness properties, as noted above. In addition, the coating must have sufficient inherent structural integrity to withstand the rigorous operating condition to which a knife blade may be subjected, such as is exhibited by various high wear diamond-like coatings ("DLC"). Examples of suitable coatings include, but are not limited to, high wear coatings such as aluminum titanium nitride or aluminum chromium nitride.

The coating may be applied by a number of known processes, such as physical vapor deposition or heat treatment.

In at least one further embodiment, the self-cleaning construction comprises at least one debris channel 218, such as is shown in the illustrative embodiment of FIG. 38. In one embodiment, a debris channel 218 comprises a predetermined geometry structured to facilitate the transport of dirt and debris therethrough. More in particular, one or more debris channel 218 provide clearance between the movable blade portion 223 and the fixed blade portion 221 and/or fixed interlock 222, to provide a pathway for dirt or debris which may adhere to the moveable blade portion 223 to be displaced and exit from the interior of the folding knife assembly 200 of the present invention. As such, debris channel(s) 218 prevents, or at least minimizes, impeding the operation of the folding knife assembly 200, specifically, preventing dirt and/or debris from impeding the positioning of the moveable blade portion 223 between an open and a closed configurations. In at least one embodiment, fixed handle member 214 may also comprise one or more debris channel 218 so as to provide further clearance for dirt and debris which may adhere to movable blade portion 223.

Figure 51:
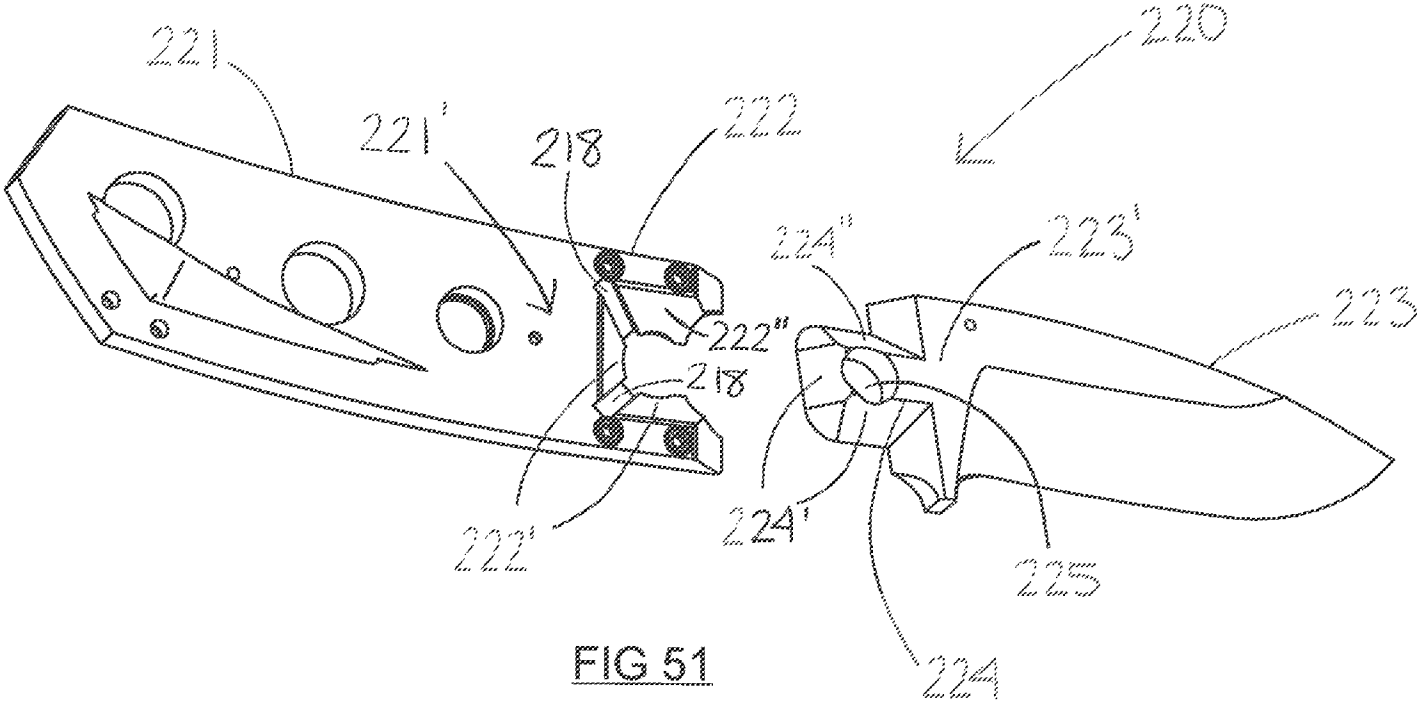
FIG. 51 is an exploded and partially rotated perspective view of one illustrative embodiment of blade system in accordance with the present invention.

With reference to the illustrative embodiment of FIGS. 41 and 51, the fixed blade portion 221 further comprises debris channels 218 to permit debris which may enter the interior of the folding knife assembly 200 of the present invention during use, to be discharged through the debris channels 218, such as, during movement of the movable blade portion 223 into and out of an open orientation. As shown in FIGS. 41 and 51, in at least one embodiment, debris channels 218 are sloped downwardly and outwardly from the interior of the folding knife assembly 200 to facilitate the transfer of debris from the interior to the exterior of the assembly 200. As will be further appreciated, with reference to FIG. 51, the fixed tabs 222' of the fixed interlock 222 and the corresponding sliding tabs 224' of movable interlock 224 create a spacing between portions of the fixed interlock 222 and movable interlock 224, such that debris may pass therethrough and out via debris channels 218.

The folding knife assembly 200 in accordance with the present disclosure further includes a positioning system such as is shown at 230 throughout the figures. The positioning system 230 is structured to facilitate disposition of the blade system 220 between the open configuration, as illustrated for example in FIGS. 36 and 37, and the closed configuration, such as is illustrated in FIG. 38. Additionally, in at least one embodiment, the positioning system 230 is structured to facilitate positioning parts of the handle 212, and more in particular, fixed handle member 214 and movable handle member 216, relative to one another, and as a result, relative to the blade system 220. In at least one embodiment, and as illustrated best in FIGS. 41 and 51, movable blade portion 223 comprises a pivot aperture 225 disposed through a portion of movable interlock 224. The pivot aperture 225 of movable blade portion 223 is structured to engage a positioning pin 231 in a manner that allows the movable blade portion 232 to be positionable about and relative to positioning pin 231 between a closed configuration and an open configuration, such as is shown best in the illustrative embodiment of FIGS. 39 and 40, respectively.

Operation of the positioning system 230 to dispose the blade system 220 from a closed and locked configuration to an open and locked configuration is explained in detail below with reference to the illustrative embodiment of FIGS. 45 through 50.

In accordance with the present invention, the positioning system 230 comprises a positioning pin 231. As shown in the illustrative embodiment of FIG. 41, positioning pin 231 comprises a fixed end 232 and a free end 234. In at least one embodiment, fixed end 232 of the positioning pin 231 is securely mounted to a fixed blade bolster 215 of the folding knife assembly 200. A fastener 232' and a washer 232" are utilized in one embodiment to securely mount the fixed end 232 of the positioning pin 231 to the fixed blade bolster 215. In one embodiment, both the fastener 232' and the washer 232" are constructed of at least 17 or 300 series stainless steel.

In at least one further embodiment, an adhesive, such as LOCTITE®, as manufactured and distributed by Henkel Corp., USA, is utilized to secure fastener 232' to threads on a fixed end 232 of a positioning pin 231. In one further embodiment, a washer 232" is positioned around the fixed end 232 of the positioning pin 231 before the fastener 232' is secured thereto. In at least one embodiment, a compressive washer, such as a conical spring or Belleville washer is utilized, and in yet one further embodiment, the Belleville washer 232" has a predetermined torque rating of at least 150 pounds of torque.

In accordance with at least one embodiment, a positioning pin 231 further comprises an alignment notch 233 formed in the fixed end 232, such as is shown best in the illustrative embodiment of FIGS. 42D and 42E. With reference once again to FIG. 41, in at least one embodiment, the fixed blade bolster 215 comprises an alignment channel 219 through a portion thereof which is dimensioned to receive an alignment pin 233' therethrough, and to retain the same therein via a friction fit due to close tolerances between the diameter of the alignment pin 233' and the alignment channel 219 through the movable blade bolster 217 during the manufacture of these components. The alignment pin 233' comprises a length slightly less than the combined length of the alignment channel 219 plus the depth of the alignment notch 233 in the fixed end 232 of the positioning pin 231. As such, precise alignment of the positioning pin 231 relative to the fixed blade bolster 215, and thus, to the remaining components of the folding knife assembly 200, and in particular, the positioning sleeve 238, is assured once alignment pin 233' is positioned completely through alignment channel 219 of the fixed blade bolster 215 and into alignment notch 233, which is evidenced by the alignment pin 233' being fully disposed into the alignment channel 219 in the fixed blade bolster 215, i.e., the alignment pin 233' in not extending outwardly from the alignment channel 219 through the fixed blade bolster 215.

In a similar manner, positioning sleeve 238 is precisely aligned relative to a movable blade bolster 217, and the other components of the folding knife assembly 200, such as, positioning pin 231. As shown best in the illustrative embodiment of FIG. 43D, positioning sleeve 238 includes an alignment notch 238'. Furthermore, and with reference once again to FIG. 41, the movable blade bolster 217 comprises an alignment channel 219 extending through a portion thereof which is dimensioned to receive another alignment pin 233' therethrough, and to retain the same therein via a friction fit due to close tolerances between the diameter of the alignment pin 233' and the alignment channel 219 through the movable blade bolster 217 during the manufacture of these components. As before, the alignment pin 233' comprises a length slightly less than the combined length of the alignment channel 219 plus the depth of the alignment notch 238' in the positioning sleeve 238. As such, precise alignment of the positioning pin 231 relative to the movable blade bolster 217, and thus, to the remaining components of the folding knife assembly 200, and in particular, the positioning pin 231, is assured once alignment pin 233' is positioned completely through alignment channel 219 of the movable blade bolster 217 and into alignment notch 238', which is evidenced by the alignment pin 233' being fully disposed into the alignment channel 219 in the movable blade bolster 217, i.e., the alignment pin 233' in not extending outwardly from the alignment channel 219 through the movable blade bolster 217.

FIGS. 42A through 42D are representative of at least one embodiment of a positioning pin 231 in accordance with the present invention. As noted above, in at least one embodiment, positioning pin 231 includes a fixed end 232 and a free end 234. In at least one further embodiment, the fixed end 32 of positioning pin 231 is threaded to facilitate secure attachment of the fixed end 232 to a part of the fixed blade bolster 215 via a fastener 232', as described above. In at least one embodiment, a positioning pin 231 comprises one or more positioning tab 235'. As shown in FIGS. 42B, 42D, and 42E, the positioning pin 231 comprises a positioning array 235 formed thereon, comprising a plurality of cooperatively dimensioned and disposed positioning tabs 235'. Looking to FIGS. 42A and 42C, at least some of the plurality of positioning tabs 235' are arranged so as to form one or more transport channel 236 extending linearly at least partially along a length of the positioning pin 231. Looking to FIG. 42E, at least some of the plurality of positioning tabs 235' are further arranged so as to form one or more locking channel 237 extending radially at least partially around a circumference of the positioning pin 231.

Turning next to FIGS. 43A through 43F, various perspective views of one embodiment of a positioning sleeve 238 in accordance with the present invention are presented. As before, with regard to positioning pin 231, a positioning sleeve 238 in accordance with one embodiment of the present invention comprises one or more positioning tab 239. Likewise, in at least one further embodiment, a positioning sleeve 238 comprises one or mere positioning channel 239'.

As shown in the illustrative embodiment of FIGS. 43E and 43F, the positioning sleeve 238 comprises a plurality of positioning tabs 239 disposed around and along one end thereof. Further, and with reference to FIG. 43B, a plurality of positioning channels 239' are formed between the plurality of positioning tabs 239. As will be appreciated with reference to FIGS. 42A through 42F relative to 43A through 43F, the positioning tabs 239 of the positioning sleeve 238 are cooperatively dimensioned and configured to travel along and between the transport channel(s) 236 and locking channel(s) 237 of the positioning pin 231. Likewise, the positioning tabs 235' of the positioning pin 231 are cooperatively dimensioned and configured to travel along and between the positioning channel(s) 239' of the positioning sleeve 239.

In at least one embodiment of the present invention, a positioning pin 231 and/or the positioning sleeve 238 are manufactured from 440C stainless steel, 420 stainless steel, or equivalent, having a DLC and/or are heat treated to 58-60 RC, or equivalent. At least one further embodiment of the present invention envisions manufacturing the positioning pin 231 and/or the positioning sleeve 238 from a S90V or similar vanadium alloy steel. The manufacturing tolerances for a positioning pin 231 and a poisoning sleeve 238 in accordance with one embodiment of the present invention are in the range of about +/−0.001 inch.

The fixed blade bolster 215 and the movable blade bolster 217, in at least one embodiment, are manufactured from 420 stainless steel having a DLC and/or are heat treated to 58-60 RC, or equivalent. The manufacturing tolerances for the fixed blade bolster fixed 215 and movable blade bolster 217 in accordance with one embodiment of the present invention are +/−0.001 inch. In one further alternate embodiment, an outer surface of either or both the fixed blade bolster 215 and the movable blade bolster 217 not in contact with the fixed blade portion 221 or the movable blade proton 223 may be coated with ZYTEL® FRN materials, a G-10 fiberglass resin laminate, MICARTA®, NYLON®, etc., as disclosed above. In one further embodiment, high strength titanium and/or steel alloy or other suitable composite material is utilized to form the fixed blade bolster 215 and/or movable blade bolster 217. Furthermore, in accordance with at least one embodiment of the present invention, either or both a fixed handle member 214 and a movable handle member 216 comprise a single unitary construction with a fixed blade bolster 215 and a movable blade bolster 217, respectively.

The interaction of the positioning pin 231 relative to the positioning sleeve 238, which facilitates operation of the folding knife assembly 200 with a single hand in accordance with the present invention, as described below, is demonstrated with reference to the illustrative embodiment of FIGS. 43A through 43B.

To begin, FIG. 43A is a perspective view of one illustrative embodiment of a positioning system 230 in accordance with the present invention disposed in an expanded and locked orientation. As will be appreciated, while the positioning system 230 is an expanded orientation, the blade system 220 may be disposed into a closed orientation, wherein the movable blade portion 223 is disposed in a substantially overlying relation to the fixed blade portion 231, such as is shown best in the illustrative embodiment of FIG. 39. More in particular, FIG. 43A illustrates a positioning pin 231 disposed in an expanded and locked orientation relative to a positioning sleeve 238. Specifically, and as shown in FIG. 43A, positioning tabs 235' of the positioning pin 231 are rotated out of alignment with the positioning channels 239' of the positioning sleeve 238. Concurrently, the positioning tabs 239 of the positioning sleeve 238 are rotated out of alignment with the transport channels 236 of the positioning pin 231 and into a locked orientation along a locking channel 237 (not shown) of the positioning pin 231.

Figure 44C:
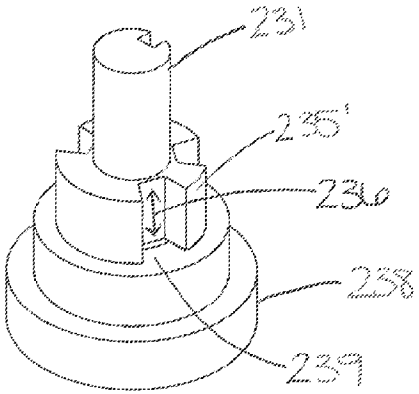
FIG. 44C is a perspective view of the illustrative embodiment of the positioning system in accordance of FIG. 44A disposed in a collapsed and aligned orientation in accordance with the present invention.
Figure 44D:
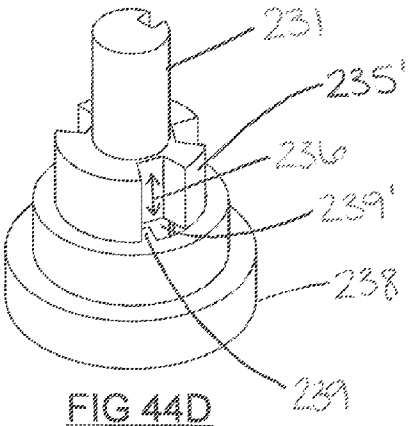
FIG. 44D is a perspective view of the illustrative embodiment of the positioning system in accordance of FIG. 44A disposed in a collapsed and locked orientation in accordance with the present invention.
Figure 44A:
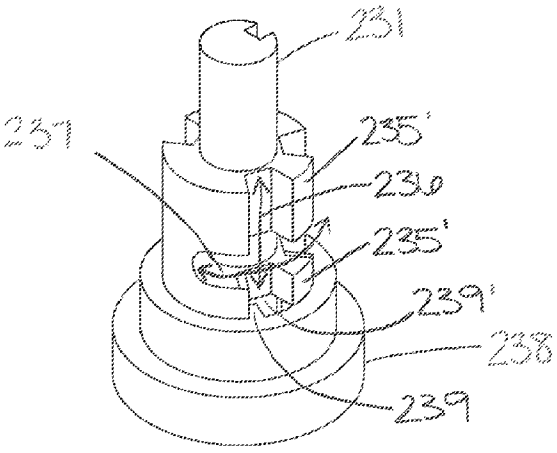
FIG. 44A is a perspective view of one illustrative embodiment of a positioning system in accordance with the present invention disposed in an expanded and locked orientation.
Figure 44B:
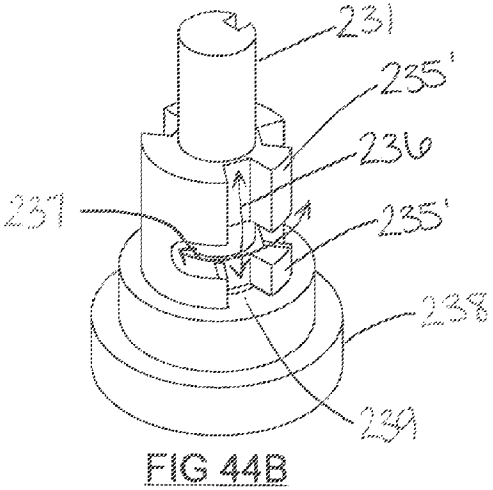
FIG. 44B is a perspective view of the illustrative embodiment of the positioning system in accordance of FIG. 44A disposed in an expanded and aligned orientation in accordance with the present invention.

Looking next to FIG. 44B, the positioning system 230 is disposed in an expanded and aligned orientation, wherein positioning tabs 235' of the positioning pin 231 are rotated into alignment with the positioning channels 239' (not shown) of the positioning sleeve 238 and, once again, concurrently, the positioning tabs 239 of the positioning sleeve 238 are rotated into alignment with the transport channels 236 of the positioning pin 231.

With reference to FIG. 44C, the positioning system 230 is now disposed in a collapsed and aligned orientation, wherein at least some of the positioning tabs 235' of the positioning pin 231 have been moved into and through corresponding positioning channels 239' of the positioning sleeve 238. Similarly, positioning tabs 239 of the positioning sleeve 238 have been moved into and through a portion of the transport channels 236 of the positioning pin 231.

Finally, turning to FIG. 44D, the positioning system 230 in is now disposed in a collapsed and locked orientation. As will once again be appreciated, while the positioning system 230 is a collapsed orientation, the blade system 220 may be disposed into an open orientation wherein the movable blade portion 223 is rotated outwardly and positioned in a coplanar arrangement with the fixed blade portion 231, such as is shown best in the illustrative embodiment of FIG. 40.

Specifically, and similar to the orientation of FIG. 44A, positioning tabs 235' of the positioning pin 231 are rotated out of alignment with the positioning channels 239' of the positioning sleeve 238, while the positioning tabs 239 of the positioning sleeve 238 are rotated out of alignment with the transport channels 236 of the positioning pin 231 and into a locked orientation along a locking channel 237 (not shown) of the positioning pin 231.

As previously indicated, a folding knife assembly 200 in accordance with the present invention comprises a locking system, generally as shown as 240 throughout the Figures. More in particular, in at least one embodiment, a locking system 240 comprises an outer lock member 241 and an inner lock member 242, such as are shown in the illustrative embodiment of FIG. 41. With continued reference to FIG. 41, a fixed handle lock aperture 243 is disposed through fixed handle member 214 and a correspondingly aligned fixed blade lock aperture 244 is disposed through the fixed blade portion 241. With reference once again to FIG. 41, a corresponding pair of movable handle lock apertures 245' and 245" are formed through inner movable handle member 216' and outer movable handle member 216", respectively. As will be appreciated, in an embodiment having a unitary movable handle member 216, a single movable handle lock aperture 245' or 245" is provided.

In at least one embodiment, outer lock member 241 is cooperatively structured with fixed handle lock aperture 243 so as to permit the outer lock member 241 to be disposed into but not through the fixed handle lock aperture 243. In at least one embodiment, cooperatively structured tapers and/or flanges are utilized so as to prevent outer lock member 241 from being able to pass completely through the fixed handle lock aperture 243. Similarly, inner lock member 242 is cooperatively structured with movable handle lock apertures 245', 245" so as to prevent movement of inner lock member 242 completely through movable lock apertures 245', 245". As will be appreciated, once a folding knife assembly 200 is fully assembled, the locking system 240 and more in particular, outer lock member 241 and inner lock member 242 are attached to one another and are free to move transversely through fixed blade lock aperture 244.

As will be further appreciated, when the folding knife assembly 200 is disposed in a closed orientation, for example, such as is shown in the illustrative embodiment of FIG. 38, the inner lock member 242 of the locking system 240 will butt up against the movable blade portion 223, and will serve to at least partially and releasably secure the movable blade portion 223 in the closed configuration therein via friction forces between the inner lock member 242 and movable blade portion 223. Conversely, when the folding knife assembly 200 in accordance with the present invention is disposed in a fully open and locked orientation, such as is shown in the illustrative embodiments of FIGS. 36 and 37, the locking system 240, and more in particular inner lock member 242, will be seated in moveable handle lock apertures 245', 245", thereby preventing the movable blade portion 223 from inadvertently being moved into the closed configuration, until the inner lock member 242 is released from the moveable handle lock apertures 245', 245", such as by pushing inwardly thereon by a user.

Figure 45:
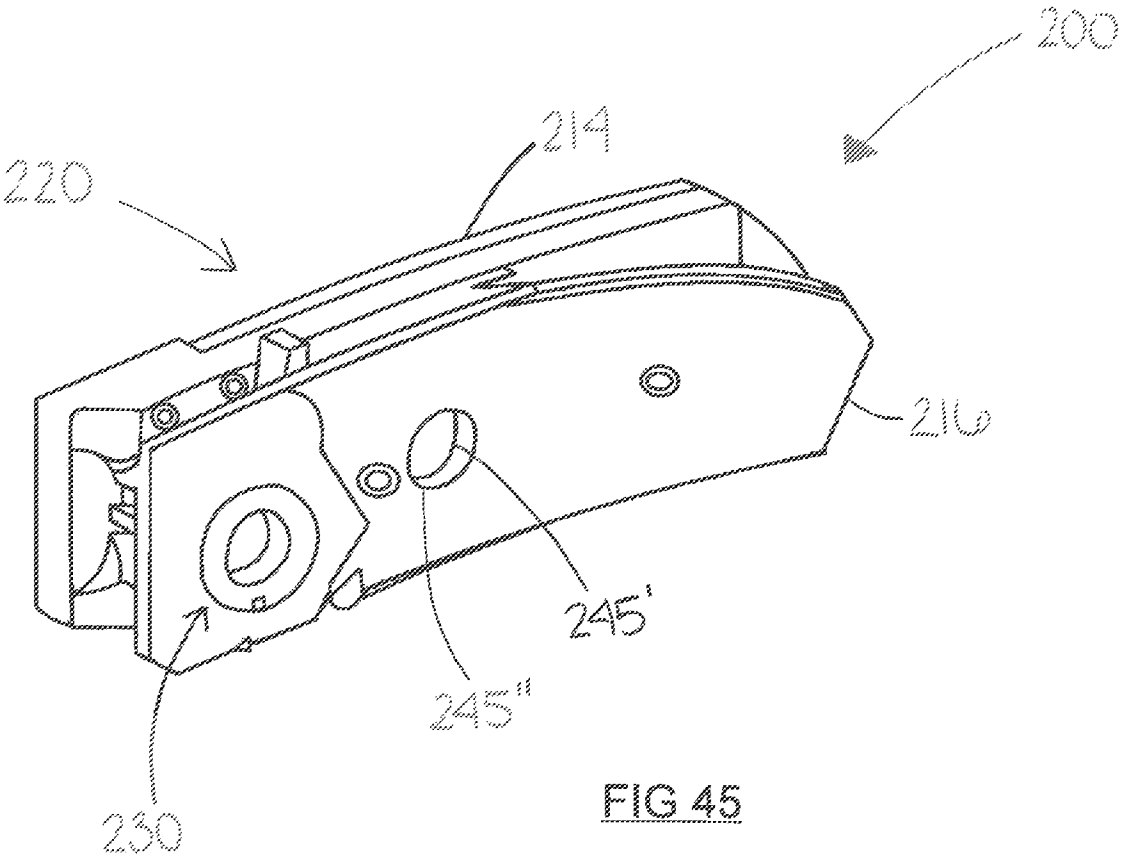
FIGS. 45 through 50 are illustrative of the folding knife assembly of FIGS. 36 through 40 as it is operated from a fully closed and locked configuration to a fully open and locked configuration.

Operation of a folding knife assembly 200 in accordance with the present invention will now be described with reference to the illustrative embodiment of FIGS. 45 through 50. To begin, FIG. 45 illustrates the folding knife assembly 200 disposed in a fully closed orientation, wherein the blade system 220 is disposed between the fixed handle member 214 and the movable handle member 216. As further illustrated in FIG. 45, inner lock member 242 is not present in either movable handle lock aperture 245' or 245", due to the fact that while in the closed configuration, inner lock member 242 is abutting the movable blade portion 223 on the side opposite the movable handle member 216. While the folding knife assembly 200 is disposed in the closed orientation as shown in FIG. 45, the positioning system 230 is disposed in an expanded and locked orientation, such as is shown in the illustrative embodiment of FIG. 44A.

Figure 46:
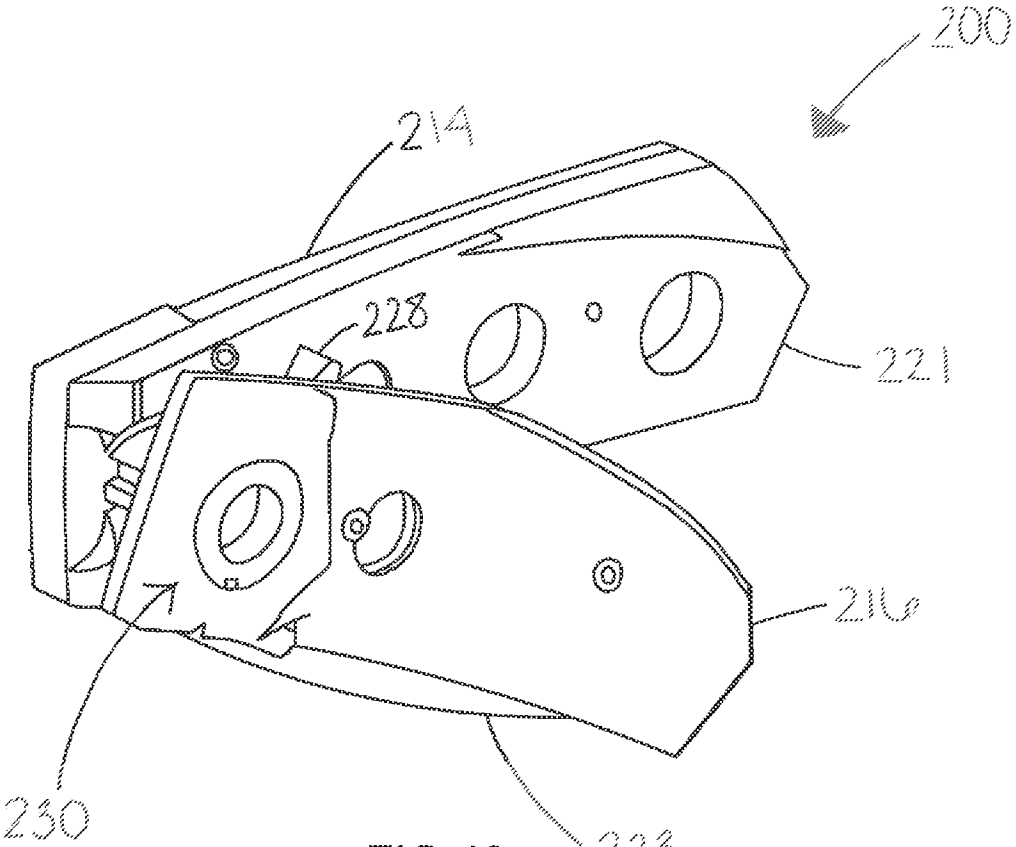

With reference to FIG. 46, while a user holds the folding knife assembly 200 in one hand, a user's thumb may be used to rotate movable handle member 216 and movable blade portion 223 about positioning system 230, while fixed blade portion 221 and fixed handle member 214 remain in a substantially fixed orientation. As before, friction forces between the inner lock member 242 and the movable blade portion 223 at least partially and releasably secure the movable blade portion 223 in the closed orientation. While disposed in the orientation illustrated in FIG. 46, the positioning system 230 is disposed in an expanded and aligned arrangement such as is shown in the illustrative embodiment of FIG. 44B.

Figure 47:
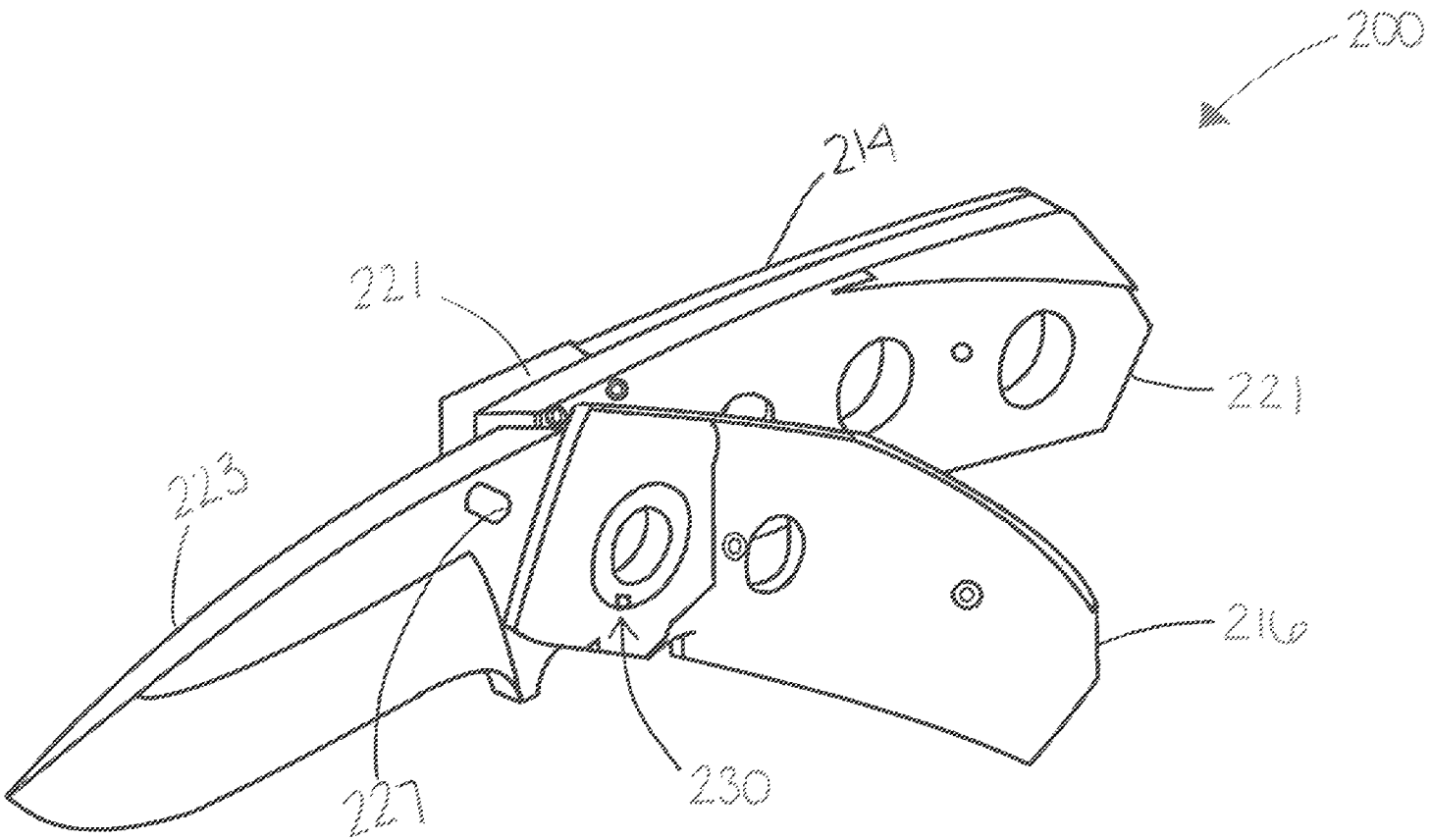

Turning next to the illustrative embodiment of FIG. 47, using his or her thumb, a user can follow through and push down on release tab 227 thereby displacing the movable blade portion 223 from the closed configuration, as shown in FIG. 46, to the open configuration, as shown in the illustrative embodiment of FIG. 47. It is noteworthy that while the positioning system 230 is disposed in an expanded and locked orientation, movable blade portion 223 is not free to rotate about positioning pin 231. It is further noteworthy from the illustrative embodiment of FIG. 47 that, at least initially, when the movable blade portion 223 is disposed into an open orientation, the fixed blade portion 221 and the movable blade portion 223 are disposed in offset opposite planes from one another.

Figure 48:
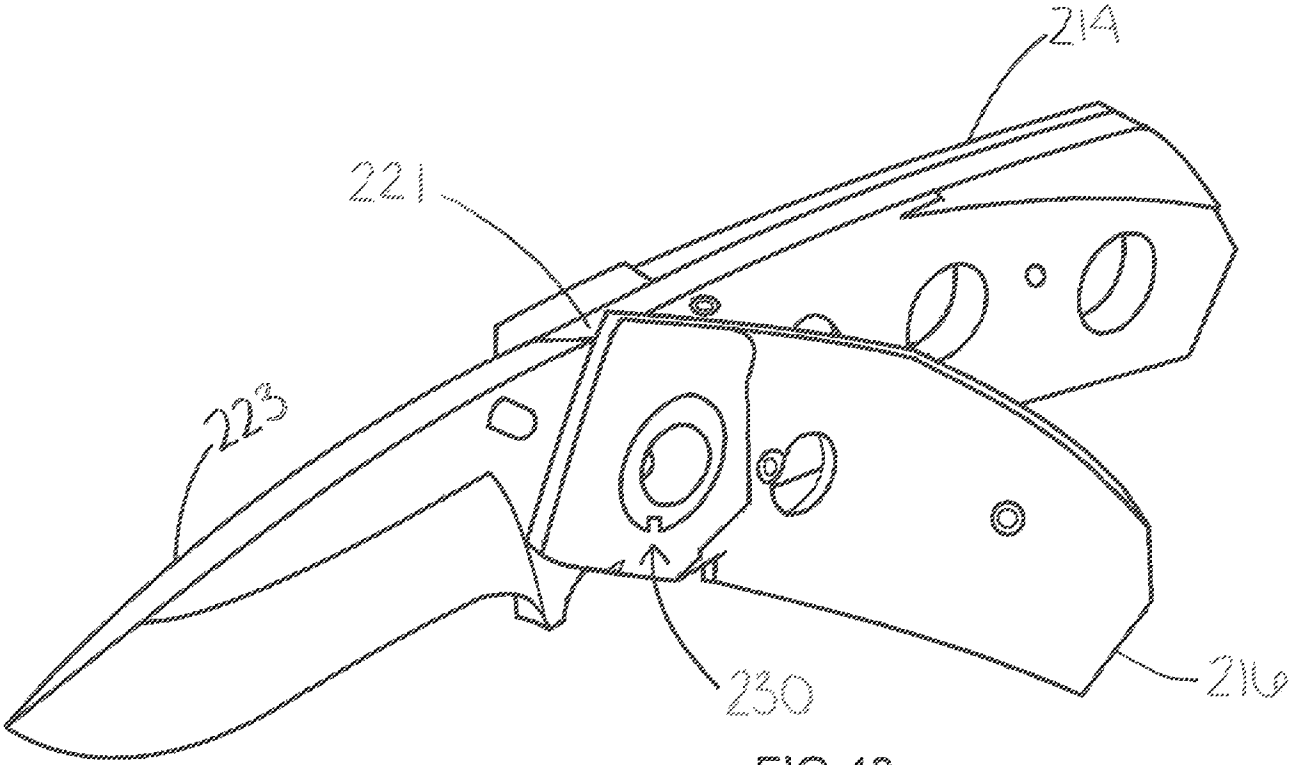

Looking next to the illustrative embodiment of FIG. 48, once movable blade portion 223 is disposed in a fully open orientation, as was shown in FIG. 47, a user applies pressure to the movable handle member 216 towards the fixed handle member 214, thereby repositioning movable blade portion 223 into a coplanar alignment with fixed blade portion 221, as is clearly shown in the illustrative embodiment of FIG. 48. While disposed in the configuration of the illustrative embodiment of FIG. 48, positioning system 230 is disposed in a collapsed and aligned orientation, such as is shown in the illustrative embodiment of FIG. 44C.

Figure 49:
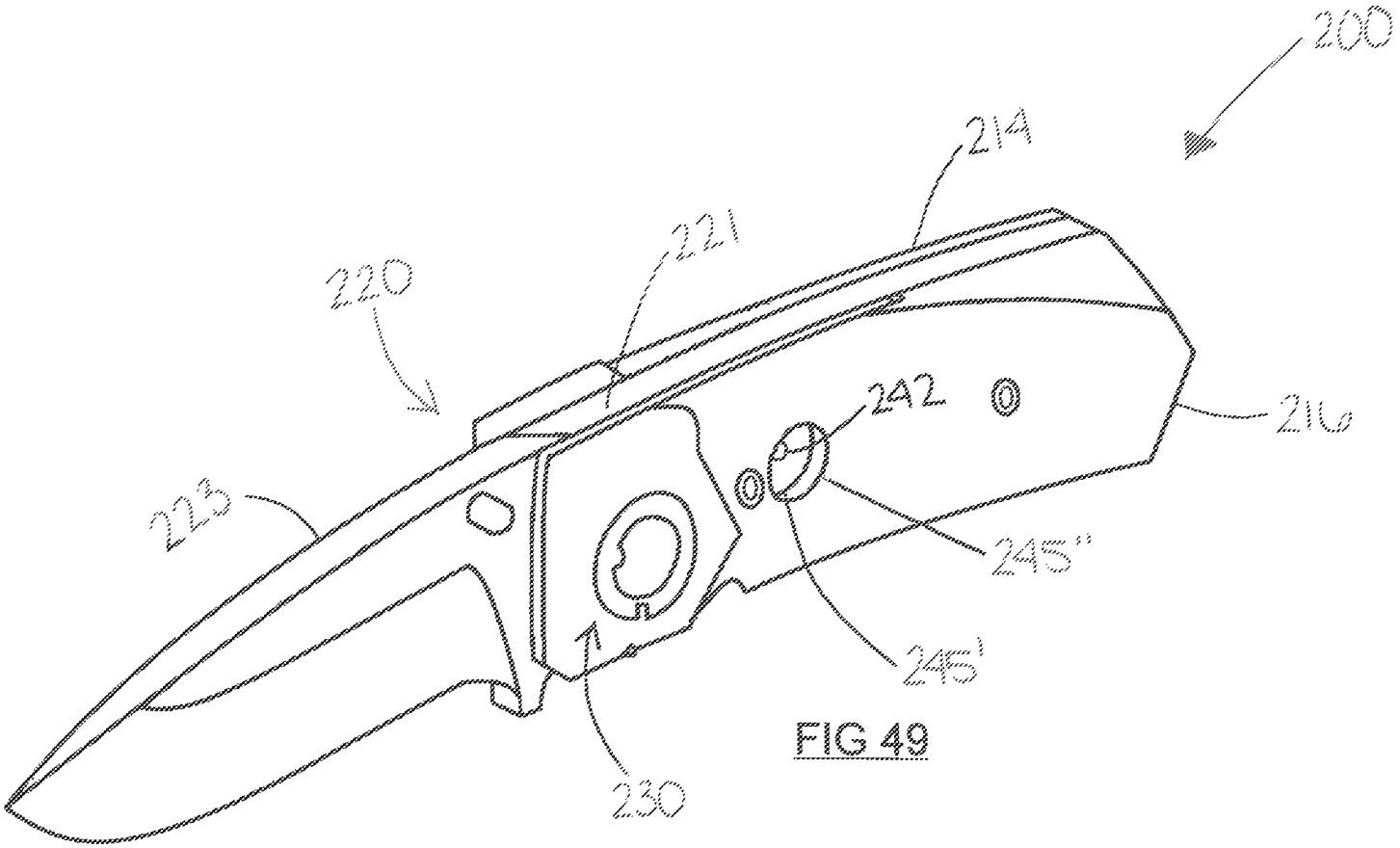

Looking next to the illustrative embodiment of the folding knife assembly 200 in accordance with FIG. 49, the blade system 220 is disposed in a fully open configuration wherein the fixed blade portion 221 and the movable blade portion 223 are disposed in a substantially coplanar alignment with one another, such as was shown in FIG. 48. Furthermore, the user's finger or thumb can reposition the movable handle member 216 upward and into a substantially overlying relation to the fixed blade portion 221. When disposed in the orientation as shown in the illustrative embodiment of FIG. 49, the positioning system 230 is now disposed into a collapsed and locked orientation, such as is shown in the illustrative embodiment of FIG. 44D. As further shown in the illustrative embodiment of FIG. 49, a portion of inner lock member 42 is just visible through movable handle lock apertures 245' and 245". As a final step, and as shown in the embodiment of FIG. 50, a user's finger or thumb is used to push outer lock member 241 (not shown) transversely through fixed blade portion 221 such that inner lock member 242 is disposed through movable lock handle aperture 245' (not shown) and into movable handle lock aperture 245".

Figure 50:
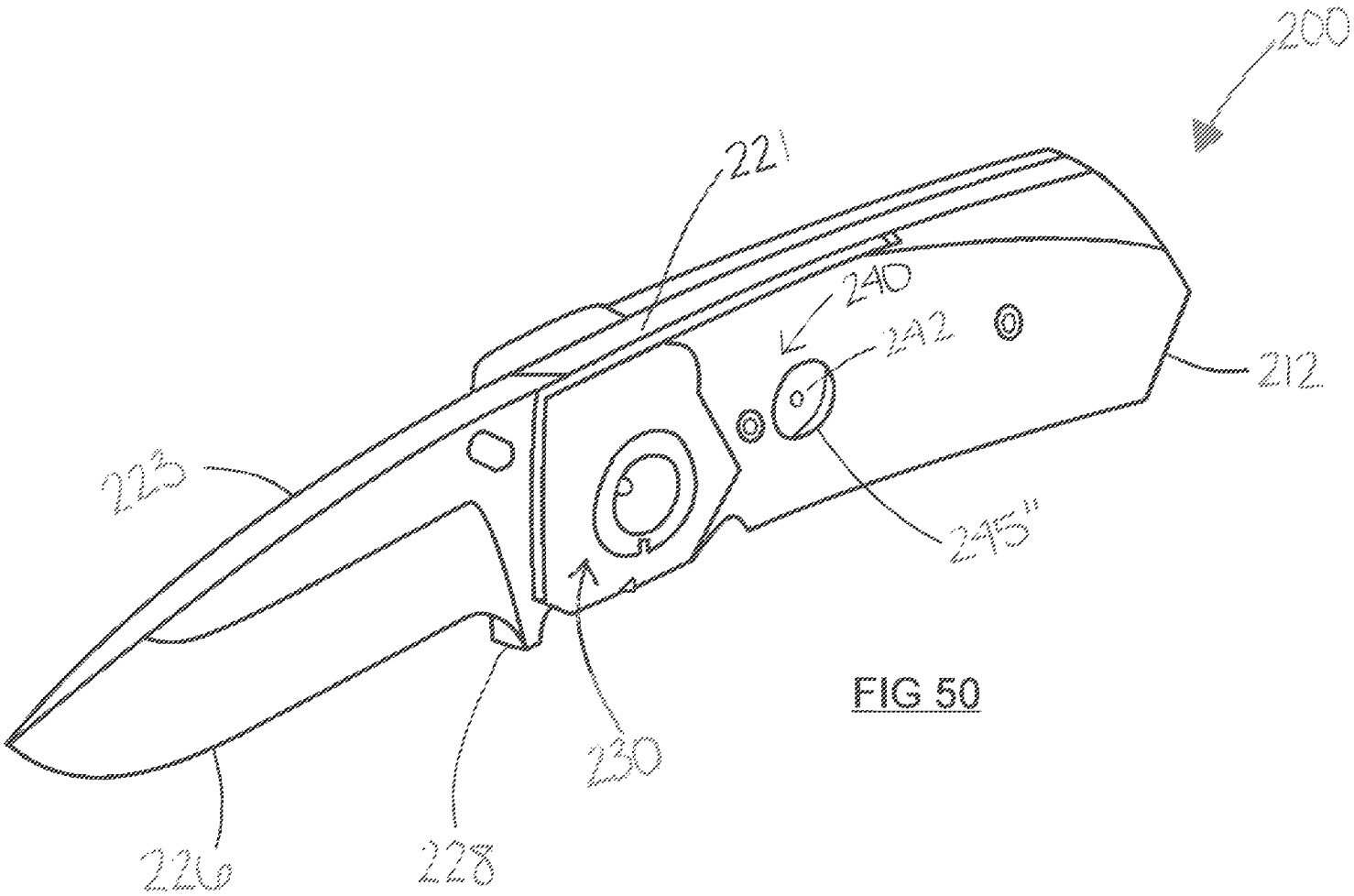

Thus, as will be appreciated, the locking system 240 prevents inadvertent movement of the movable handle member 216 while the folding knife assembly 200 is disposed in a fully open and locked orientation, once again, as shown in the illustrative embodiment of FIG. 50.

FIG. 50 further illustrates a stop 228 positioned adjacent the cutting edge 226 of the movable blade portion 223 so as to prevent a user's finger(s) from inadvertently sliding off of the handle 212 and onto the cutting edge 226.

Looking again to the illustrative embodiment of the blade system 220 of FIG. 51, the individual components of a blade system 220, namely, a fixed blade portion 221 and a movable blade portion 223 having a fixed interlock 222 and a movable interlock 224, respectively, are presented in greater detail. As will be appreciated, the fixed blade portion 221 and the movable blade portion 223 as shown in FIG. 51 are rotated 180 degrees relative to one another such that the corresponding fixed tabs 222' and sliding tabs 224', respectively, are visible. As before, the movable interlock 224 is structured and disposed to releasably engage the fixed interlock 222 in an interlocked orientation, while the blade system 220 is disposed in an open configuration, such that the fixed blade portion 221 and the movable blade portion 223 are disposed in a substantially planar arrangement relative to one another.

With continued reference to FIG. 51, a fixed blade portion 221 comprises a fixed interlock 222 at one end thereof, as previously disclosed. Of particular interest, and as shown in FIG. 51, a plurality of fixed tabs 222' are provided in fixed interlock 222, wherein each fixed tab 222' extends downwardly and outwardly from an inner surface 221' of fixed blade portion 221. As FIG. 51 further illustrates, by virtue of this downward and outward extension, each fixed tab 222' defines a fixed slope 222" associated therewith. In one embodiment, the fixed slope 222" is at least partially defined by an angle θ which is in a range of about 30 to 60 degrees formed between a plane through inner surface 221' and a plane through fixed slope 222". In another embodiment, the fixed slope 222" is at least partially defined by an angle θ which is less than about 45 degrees formed between a plane through inner surface 221' and a plane through fixed slope 222", and in still one further embodiment, the fixed slope 222" is at least partially defined by an angle θ which is in a range of about 40 to 45 degrees.

FIG. 51, as previously noted, is also illustrative of one embodiment of a movable blade portion 223 comprising a movable interlock 224 in accordance with the present invention. Further, the movable blade portion 223 comprises a pivot aperture 225 through a portion of the movable interlock 224 which is structured to operatively engage a portion of positioning system 230, as previously disclosed. FIG. 51 shows a plurality of sliding tabs 224' each of which correspond to a fixed tab 222' of a fixed blade portion 221. Similar to the fixed tabs 222' of the fixed blade portion 221, each of the plurality of sliding tabs 224' extend downwardly and outwardly from an inner face 223' of movable blade portion 223, thereby defining a corresponding sliding slope 224". In one embodiment, the sliding slope 224" is at least partially defined by an angle θ' which is in a range of about 30 to 60 degrees formed between a plane through inner face 223' and a plane through sliding slope 224". In another embodiment, the sliding slope 224" is at least partially defined by an angle θ' which is greater than about 45 degrees formed between a plane through inner face 223' and a plane through sliding slope 224", and in still one further embodiment, the sliding slope 224" is at least partially defined by an angle θ' which is in a range of about 45 to 50 degrees.

As will be appreciated from FIGS. 25 and 26, the movable interlock 124 of movable blade portion 123, and in particular, the plurality of sliding tabs 124' are cooperatively constructed and configured to releasably engage fixed interlock 122, and once again, more in particular, a corresponding plurality of fixed tabs 122' therein, in an interlocked orientation, while the blade system 220 is disposed in an open configuration, such that the fixed blade portion 121 and the movable blade portion 123 are disposed in a substantially planar arrangement relative to one another. Thus, corresponding pairs of fixed tabs 122' and sliding tabs 124' are cooperatively structured and disposed such that the movable blade portion 123 releasably engages the fixed blade portion 121 when the movable interlock 124 is positioned in an operatively alignment with the fixed interlock 122.

It will further be appreciated that fixed slope 122" and sliding slope 124" of corresponding ones of the fixed tabs 122' and sliding tabs 124' comprise complementary angles having a sum of about 90 degrees. As one example, corresponding pairs of fixed tabs 122' and sliding tabs 124' may each comprise corresponding fixed slopes 122" and sliding slopes 124" each at least partially defined by angles θ, θ', respectively, of about 45 degrees. In one further embodiment, a fixed tab 122' comprises a fixed slope 122" at least partially defined by an angle θ of about 40 degree while a corresponding sliding tab 124' comprises a sliding slope 124" at least partially defined by an angle θ' of about 50 degrees.

The significance of the aforementioned configuration of corresponding ones of the fixed tabs 222' and sliding tabs 224', and more in particular, corresponding fixed slopes 222" and sliding slopes 224", is that the moveable interlock 224 of moveable blade portion 223 may be easily rotated upward and outward out of the fixed interlock 222 of the fixed blade portion 221 with minimal force. This allows the folding knife assembly 200 of the present invention to be closed using a single hand, once the positioning system 230 is disposed in a collapsed and aligned orientation, as shown in FIG. 44C and as corresponds to the orientation of the embodiment of FIG. 49, as only minimal force is required to rotate the movable blade portion 223 from an open configuration to a closed configuration, by virtue of the dishing off effect between the corresponding fixed slopes 222" and sliding slopes 224".

As shown throughout the figures, the fixed tabs 222' extend outwardly and into the fixed interlock 222, and may be formed in this manner such as via wire electrical discharge machining, laser cutting, die cutting, pressing, fine blanking individual components followed by CNC finishing, forging individual components followed by CNC finishing, as previously disclosed. However, in at least one embodiment, the fixed tabs 222' may be formed by etching the interior surfaces of fixed interlock 222. Similarly, sliding tabs 224' may be formed via etching the surfaces of movable interlock 224.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A folding knife assembly which is operable with a single hand, said assembly comprising:

a blade system having a fixed blade portion and a movable blade portion, said blade system disposable between an open configuration and a closed configuration, wherein said fixed blade portion and said moveable blade portion cooperatively engage one another while said blade system is disposed in said open configuration, and a positioning system structured to facilitate disposition of said blade system between said open configuration and said closed configuration, and said positioning system disposable between an expanded orientation and a collapsed orientation.

2. The assembly as recited in claim 1 wherein said fixed blade portion and said movable blade portion are disposed in a substantially planar arrangement relative to one another while said blade system is disposed in said open configuration.

3. The assembly as recited in claim 2 wherein said fixed blade portion and said movable blade portion are disposed in a substantially overlying arrangement relative to one another while said blade system is disposed in said closed configuration.

4. The assembly as recited in claim 3 wherein said fixed blade portion comprises a fixed interlock and said movable blade portion comprises a movable interlock.

5. The assembly as recited in claim 4 wherein said movable interlock is structured and disposed to releasably engage said fixed interlock in an interlocked orientation while said blade system is disposed in said open configuration.

6. The assembly as recited in claim 5 wherein said positioning system comprises a positioning pin and a cooperatively configured positioning sleeve.

7. The assembly as recited in claim 6 wherein said positioning pin and said positioning sleeve are operable between said expanded orientation and said collapsed orientation.

8. The assembly as recited in claim 2 wherein said positioning system is disposed into said collapsed orientation to at least partially releasably secure said movable blade portion into said substantially planar arrangement with said fixed blade portion.

9. The assembly as recited in claim 8 wherein said positioning system is disposed into a collapsed and aligned orientation to permit movement of said movable blade portion out of said substantially planar arrangement with said fixed blade portion.

10. The assembly as recited in claim 9 wherein said positioning system is disposed into an expanded and aligned orientation to permit movement of said movable blade portion into a substantially overlying arrangement with said fixed blade portion.

11. The assembly as recited in claim 10 wherein said positioning system is disposed into said expanded orientation to at least partially releasably secure said movable blade portion into said substantially overlying arrangement with said fixed blade portion.

12. A folding knife assembly which is operable with a single hand, said assembly comprising:

a blade system having a fixed blade portion and a movable blade portion, said blade system disposable between an open configuration and a closed configuration, wherein said fixed blade portion and said moveable blade portion cooperatively engage one another while said blade system is disposed in said open configuration, a positioning system structured to facilitate disposition of said blade system between said open configuration and said closed configuration, said positioning system disposable between an expanded orientation and a collapsed orientation, a locking system comprising an inner lock member which abuts said movable blade portion while said blade system is disposed in said closed configuration and at least partially releasably secures said blade system in said closed configuration.

13. The assembly as recited in claim 12 wherein said locking system further comprises an outer lock member cooperatively structured to operatively engage said inner lock member.

14. The assembly as recited in claim 13 wherein locking system comprises a fixed handle lock aperture cooperatively structured to receive said outer lock member at least partially therein but not therethrough while said blade system is disposed in said closed configuration.

15. The assembly as recited in claim 14 wherein said locking system further comprises a fixed blade lock aperture dimensioned to receive said inner lock member at least partially therethrough while said blade system is disposed in said open configuration.

16. The assembly as recited in claim 15 wherein said locking system further comprises at least one movable handle lock aperture cooperatively structured to receive said inner lock member at least partially therein but not therethrough while said blade system is disposed in said open configuration.

17. A folding knife assembly which is operable with a single hand, said assembly comprising:

a blade system having a fixed blade portion and a movable blade portion, wherein said fixed blade portion comprises a fixed interlock and said movable blade portion comprises a movable interlock, said blade system disposable between an open configuration and a closed configuration, wherein said movable interlock is structured and disposed to releasably engage said fixed interlock in an interlocked orientation while said blade system is disposed in said open configuration, a positioning system structured to facilitate disposition of said blade system between said open configuration and said closed configuration, said positioning system disposable between an expanded orientation and a collapsed orientation, and a locking system comprising an inner lock member which abuts said movable blade portion while said blade system is disposed in said closed configuration and at least partially releasably secures said blade system in said closed configuration.

18. The assembly as recited in claim 17 wherein said fixed interlock comprises a plurality of fixed tabs, each of said fixed tabs comprising a fixed slope.

19. The assembly as recited in claim 18 wherein said movable interlock comprises a plurality of sliding tabs, wherein each of said plurality of sliding tabs comprises a sliding slope.

20. The assembly as recited in claim 19 wherein each of said plurality of sliding tabs engages a corresponding one of said plurality of fixed tabs while said moveable interlock is disposed in said interlocked orientation with said fixed interlock, and wherein each of said plurality of fixed slopes and a corresponding one of said plurality of sliding slopes are cooperatively structured and disposed to facilitate rotation of said movable interlock upwardly and outwardly from said fixed interlock.

* * * * *